US007175034B2

(12) United States Patent
Nook et al.

(10) Patent No.: US 7,175,034 B2
(45) Date of Patent: Feb. 13, 2007

(54) MODULAR, ADJUSTABLE DISPLAY RACK

(75) Inventors: Thomas J. Nook, Grand Haven, MI (US); Gregory D. Gavin, Grand Haven, MI (US); Robert J. Johnson, Grand Haven, MI (US); Dathan G. Zang, Grand Haven, MI (US)

(73) Assignee: Harbor Industries, Inc., Grand Haven, MI (US)

( * ) Notice: Subject to any disclaimer, the term of this patent is extended or adjusted under 35 U.S.C. 154(b) by 127 days.

(21) Appl. No.: 10/462,350

(22) Filed: Jun. 16, 2003

(65) Prior Publication Data

US 2004/0060884 A1 Apr. 1, 2004

Related U.S. Application Data

(60) Provisional application No. 60/388,891, filed on Jun. 14, 2002.

(51) Int. Cl.
*A47B 43/00* (2006.01)

(52) U.S. Cl. ..... 211/189

(58) Field of Classification Search ..... 211/94.01, 211/87.01, 88.01, 90.01, 90.02, 90.04, 103, 211/186, 187, 96, 99; 248/242; 312/245
See application file for complete search history.

(56) References Cited

U.S. PATENT DOCUMENTS 3,129,042 A * 4/1964 Liener-Kunde ..... 312/246
3,130,693 A * 4/1964 Shell ..... 108/108
4,489,995 A * 12/1984 Barr ..... 312/236
4,508,231 A * 4/1985 Honickman ..... 211/199
4,730,738 A * 3/1988 Bartus et al. ..... 211/90.02
4,747,025 A * 5/1988 Barton ..... 362/147
4,800,821 A 1/1989 Nook et al.
4,875,590 A 10/1989 Martin et al.
4,887,783 A * 12/1989 Franklin ..... 248/220.41
4,915,460 A 4/1990 Nook et al.
4,934,645 A * 6/1990 Breslow ..... 248/242
5,040,688 A 8/1991 Martin et al.
5,228,579 A * 7/1993 Kaufman ..... 211/94.01
5,373,793 A 12/1994 Crossman ..... 108/42
5,427,255 A 6/1995 Nook
5,439,123 A 8/1995 Nook
5,452,875 A * 9/1995 Kern ..... 248/242
5,505,319 A * 4/1996 Todd, Jr. ..... 211/95
5,582,116 A * 12/1996 Spimpolo ..... 108/108
5,622,010 A * 4/1997 Weber ..... 52/36.4

(Continued)

*Primary Examiner*—Sarah Purol
(74) *Attorney, Agent, or Firm*—VanDyke, Gadrner Linn & Burkhart, LLP

(57) ABSTRACT

A point of purchase display stand for displaying products includes shelving, lights, cabinets, signs, baskets, and other items that may be supported on a slot wall positioned in the back of the stand. The slot wall may be made up of horizontal slots that allow the aforementioned items to be positioned at a plurality of vertical locations and a virtually infinite number of horizontal locations. End panels and doors may also be added to the display stand for providing security to the contents of the display stand. The shelves may only require a small amount of rotation to be removed from the slot wall. The shelves may be oriented in a plurality of different angular orientations, and they may be optionally connected with adjacent shelves so that any sagging of a given shelf is transmitted to the adjacent shelves, thereby maintaining the shelves in horizontal alignment with each other.

63 Claims, 88 Drawing Sheets

U.S. PATENT DOCUMENTS 5,655,674 A * 8/1997 Holztrager ..... 211/94.01
5,775,521 A 7/1998 Tisbo ..... 211/94.1
5,794,794 A * 8/1998 Hull ..... 211/26
5,941,026 A * 8/1999 Eisenreich et al. ..... 52/36.5
5,944,203 A * 8/1999 Vlah et al. ..... 211/189
6,015,053 A * 1/2000 Sheng ..... 211/188
6,073,399 A 6/2000 Shipman et al. ..... 52/36.1
6,152,048 A 11/2000 Vander Park ..... 108/50.02
6,193,085 B1 2/2001 Nook et al.
6,199,705 B1 * 3/2001 Portner ..... 211/26
6,199,706 B1 * 3/2001 Shea ..... 211/87.01
6,220,461 B1 * 4/2001 Dickinson ..... 211/90.01
6,234,328 B1 * 5/2001 Mason ..... 211/90.02
6,467,637 B2 * 10/2002 Riga ..... 211/94.01
6,527,565 B1 * 3/2003 Johns ..... 439/116
6,533,134 B1 * 3/2003 Menaged et al. ..... 211/87.01
6,578,498 B1 * 6/2003 Draudt et al. ..... 108/50.02
6,811,043 B2 * 11/2004 Perkins et al. ..... 211/94.01
6,827,465 B2 * 12/2004 Shemitz et al. ..... 362/125
2003/0051415 A1 3/2003 Remelts et al. ..... 52/36.1

* cited by examiner

MODULAR, ADJUSTABLE DISPLAY RACK

CROSS REFERENCE TO RELATED APPLICATIONS

This application claims priority to U.S. provisional application Ser. No. 60/388,891 filed Jun. 14, 2002 and entitled MODULAR, ADJUSTABLE DISPLAY RACK. This disclosure of this provisional application is incorporated herein in its entirety by reference.

BACKGROUND OF THE INVENTION

This invention relates generally to display racks, and more particularly to adjustable display racks used to display products for sale in retail locations.

Retail display racks are used to display a wide variety of different products that are offered for sale. In the past, these retail display racks have suffered from a number of disadvantages. For example, past retail displays have often been manufactured having a fixed size and fixed arrangement for displaying the products. These past displays have also been limited in the location, arrangement, and ease of re-arrangement of the advertising and signs that accompany the display and which help to sell the products stored thereon. The individual shelves on past display racks have also often been difficult to adjust without removing the surrounding shelves. This is due to the fact that prior shelves must have their front ends lifted vertically a certain distance before they can be removed and secured at a different height. This certain distance is often more than the vertical distance that separates the shelves. The person attempting to adjust the shelf therefore must remove all of the shelves above the shelf that is to be adjusted before the adjustment can be made.

Furthermore, some display racks are also sold or provided to retailers by the manufacturer of the product that is to be placed on the display. When this is done, the manufacturer of the product has an interest in ensuring that the display is used to display their product, and not the products of another manufacturer. Past displays have offered no assistance in ensuring that retailers did not use the displays to promote other manufacturer's products. As a result, manufacturers of products who provide displays for their products to retailers often find that their displays are altered and used to sell other products. The need can therefore be seen for a display rack that helps alleviate these and other disadvantages of past display racks.

SUMMARY OF THE INVENTION

Accordingly, the present invention provides a display rack that overcomes these and other disadvantages. The display rack is constructed of a multitude of modular components that can be easily assembled without the use of special tools or separate fasteners. Moreover, once assembled, the components can easily be re-arranged into a variety of different display configurations. The display offers a great degree of flexibility in being constructed in different sizes and configurations. Numerous other advantages are also provided, as will be discussed in more detail below.

According to one aspect of the invention, a display stand is provided that includes a back wall and at least one shelf. The back wall includes a front face, a back face, a first side, and a second side. The front face includes a plurality of parallel, generally horizontal slots that continuously extend for a majority of the distance from the first side to the second side. The shelf is releasably attachable to the front face of the back wall and is adapted to fit into at least one of the slots to thereby support the shelf on the back wall. The shelf is attachable to the back wall at a plurality of different heights and at a plurality of different side-to-side positions.

According to another aspect of the invention, a display stand is provided that includes a generally vertical back wall, a plurality of shelves, and a connector. The back wall has a front face, a back face, a first side, and a second side. The front face of the back wall includes a plurality of slots. The shelves each have first and second sides and the shelves are releasably attachable to the front face of the back wall. The shelves also each include at least one insert that fits into at least one of the slots to thereby support the shelves on the back wall. The shelves are attachable to the back wall at a plurality of different heights and at a plurality of different side-to-side positions between the sides of the back wall. The connector is attached to each of the shelves and adapted to couple a first one of the shelves with a second one of the shelves when the first and second shelves are positioned adjacent to each other in a side-by-side arrangement. The connector maintains the first and second shelves in horizontal alignment with each other when the shelves are coupled together by the connector.

According to another aspect of the present invention, a display stand is provided that includes a generally vertical back wall and a plurality of shelves that are releasably attachable to the back wall. The back wall includes a plurality of slots. The shelves each include an upper insert and a lower insert. The upper and lower inserts are adapted to fit into separate ones of the slots defined on the back wall to thereby support the shelves on the back wall. The shelves are attachable to the back wall at a plurality of different heights, and at a plurality of different side-to-side positions. The slots in the upper and lower inserts are configured such that the shelves must be rotated to be removed from the back wall and the amount of rotation required to remove them from the back wall is less than 30°.

According to yet another embodiment of the present invention, a display stand is provided that includes a generally vertical back wall, a plurality of shelves, and a plurality of shelf brackets. The back wall has a front face, a back face, and first and second sides. The front face includes a plurality of slots. The shelves are adapted to be releasably attachable to the front face of the back wall by way of the shelf brackets. Each of the shelf brackets includes at least one insert adapted to fit into at least one of the slots to thereby support an associated shelf on the back wall. Each shelf bracket is attachable to the associated shelf in a plurality of different configurations such that the shelf bracket can support the associated shelf in a plurality of different orientations with respect to the back wall.

According to other aspects of the present invention, each shelf may include a shelf base and a shelf tray, wherein the shelf base is insertable into at least one of the slots on the slot wall and the shelf tray is releasably attachable to the shelf base. The shelf base may be designed such that it can accommodate a plurality of different styles of shelf trays that are interchangeable with a given shelf base. These styles may include trays having dividers adapted to separate product supported on the shelf, as well as trays that lack such dividers. The trays may be slidingly coupled to the shelf bases such that they can slide forward on the shelf base to allow them to be more easily accessed. The display stand may further include one or more signs that can be coupled to the back wall at different locations. The signs may include a graphic panel and at least one light positioned behind the graphic panel in order to illuminate the graphic panel. End walls may further be attached to the back wall, as well as a plurality of divider panels that may be attached at any desirable side-to-side position on the back wall. A cabinet may also be attached to the back wall at any desired location. Doors may be included on the display stand such that the contents of the display stand cannot be accessed without opening the doors. The doors preferably can be locked and may open either by pivoting about a vertical axis or by sliding along tracks.

The display stand of the present invention provides a number of advantages over prior display stands. The display stand of the present invention can be configured in virtually an unlimited number of different manners so that users of the display stand can individually tailor it to their own specifications. This individual tailoring includes the selection and placement of different types of shelves, the selection and placement of cabinets, signs, lights, product dispensers, literature dispensers, and other items that may be incorporated into the display stand. Once a given configuration of the display stand has been chosen and implemented, changes to this configuration can be made quickly and easily, if desired. Additionally, the slots on the back wall of the display stand and the inserts on the shelves, and other items, may be shaped in a nonstandard manner so that conventional shelving may not fit into the slots, thereby discouraging retailers from using the display stand to display other types of products. These and other advantages of the present invention will be apparent to one skilled in the art from the following specification when read in conjunction with the accompanying drawings.

DETAILED DESCRIPTION OF THE INVENTION

Figure 1:
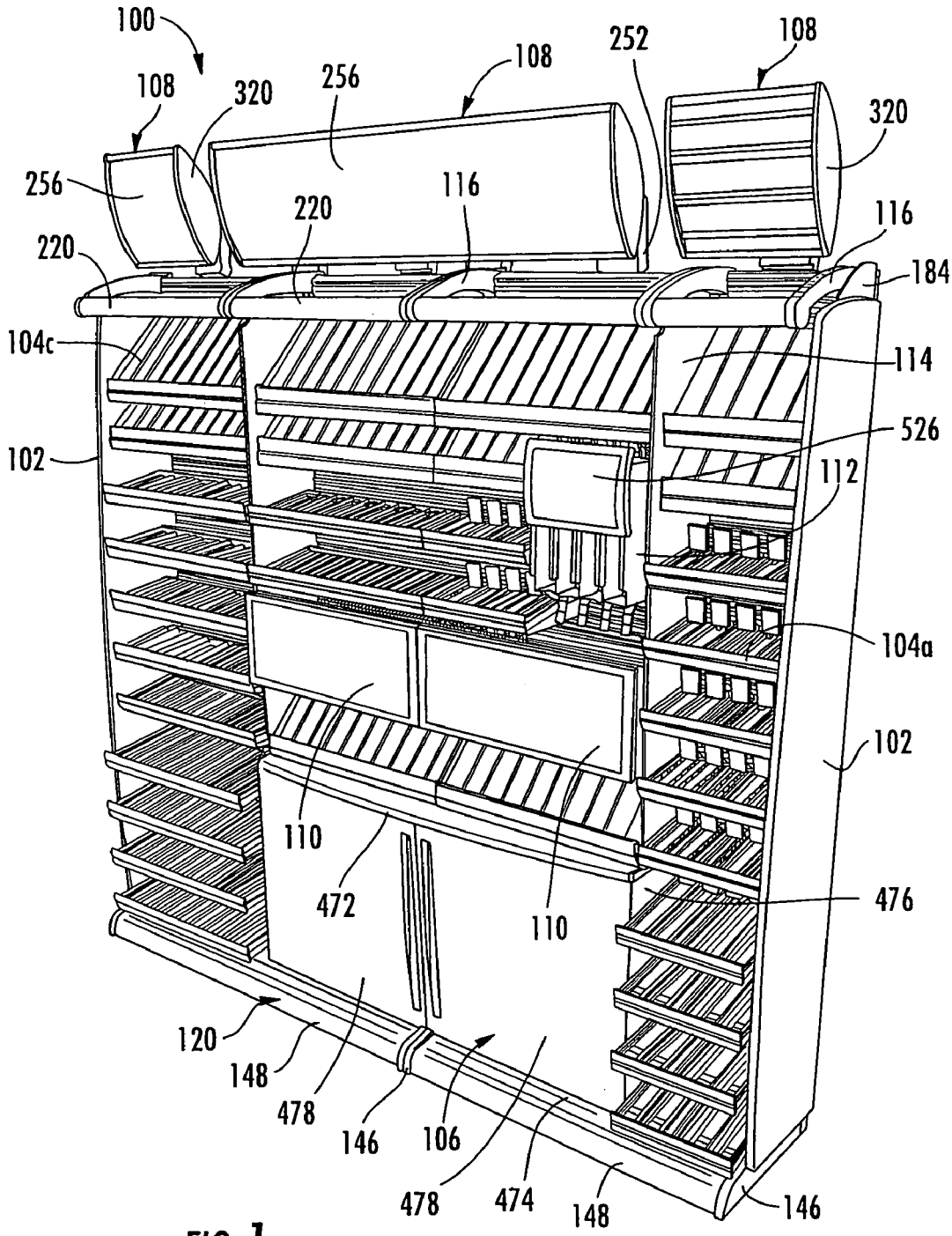
FIG. 1 is a perspective view of a display stand according to one embodiment of the present invention.

The present invention will now be described with reference to the accompanying drawings where the reference numerals in the following written description correspond to like-numbered elements in the several drawings. A display stand 100 according to one embodiment of the present invention is depicted in FIG. 1. Display stand 100 includes a pair of vertical end panels 102 positioned at the ends of stand 100, a plurality of shelves 104, a cabinet 106, a plurality of illuminated top signs 108, a plurality of interior signs or light boxes 526, and a gravity fed product dispenser 112. A pair of vertical divider panels 114 divide the shelves into a plurality of columns. One or more light brackets 116 may also be included along the top of display stand 100 to support the lights that help illuminate the product positioned on the shelves. While display stand 100 can be used to support any type of products, the illustrated embodiment is especially suited for supporting and displaying cigarette packs and cartons. The containers of cigarettes may be positioned on the shelves 104, in the dispenser 112, and in the cabinet 106.

Figure 2:
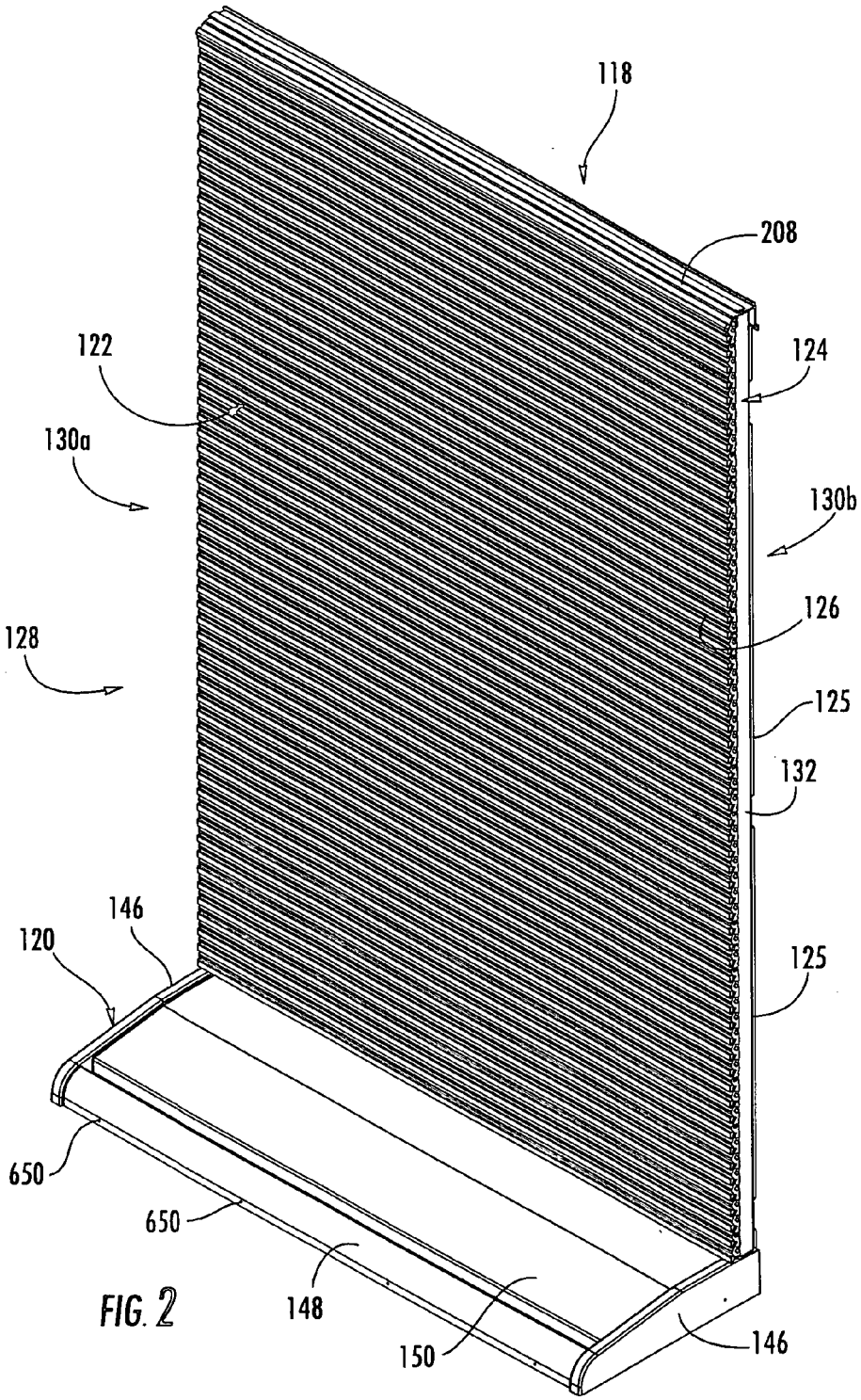
FIG. 2 is a perspective view of a back wall and base of the display stand.

All of the aforementioned components of display stand 100 are mounted onto a back wall 118 that is supported on a base 120 (FIG. 2). Back wall 118 is made up of a slot wall 122 secured to a frame 124. Frame 124 is, in turn, secured to base 120. Slot wall 122 includes a plurality of parallel, generally horizontal elongated slots 126 defined on a front 128 of back wall 118. Slots 126 are continuous and extend all the way from a first side 130*a* to an opposite side 130*b*. It will be understood that slots 126 could alternatively extend for only a portion of the way between sides 130*a* and 130*b*. Still further, slots 126 could be interrupted in one or more locations so that they are not continuous from one side 130*a* to another side 130*b*.

Slots 126 are used to releasably secure and support the various components of display stand 100 on back wall 118. Specifically, slots 126 are used to support shelves 104, end panels 102, cabinet 106, top signs 108, interior signs 526, product dispenser 112, divider panels 114, and light brackets 116. While the precise manner in which all of these components are supported on slot wall 126 will be described in more detail below, they all generally include one or more inserts that fit into one or more of the slots 126 on back wall 118. The insertion of these inserts into slots 126 allows the components to be hung on slot wall 122. Because the slots 126 in the illustrated embodiment extend all the way from one side 130*a* to another side 130*b*, the components can be hung in any side-to-side location between sides 130*a* and *b*. The components can also be hung at different heights by selecting slots 126 that are at the desired height for locating the display stand component.

Slot wall 122 thus provides a virtual blank slate for assembling display stand components thereon. The purchaser or user of display stand 100 has complete freedom in configuring display stand 100. For example, if the user of display stand 100 did not want to include cabinet 106, he or she could simply remove cabinet 106 from slot wall 122 and replace it with a different display stand component. The replacement display stand component could be one or more shelves 104, one or more interior signs 526, one or more product dispensers 112, or other items, or a combination of these items. Alternatively, if the user desired to have more than one cabinet 106, additional cabinets could be added in any desired location. The number of components, as well as their location, can thus be completely custom defined by the user of display stand 100. In addition, the size of display stand 100 can be easily varied. While the back wall 118 depicted in FIG. 2 may have a standard length, such as four feet, longer display stands 100 can be created by simply placing one or more back walls 118 and their associated bases 120 next to each other in an end to end manner. Any size length of display stands 100 can therefore be created that has a length that is an integer multiple of the standard length of a single back wall 118. The standard length of back wall 118 can, of course, be varied from the four foot length mentioned above.

Figure 3:
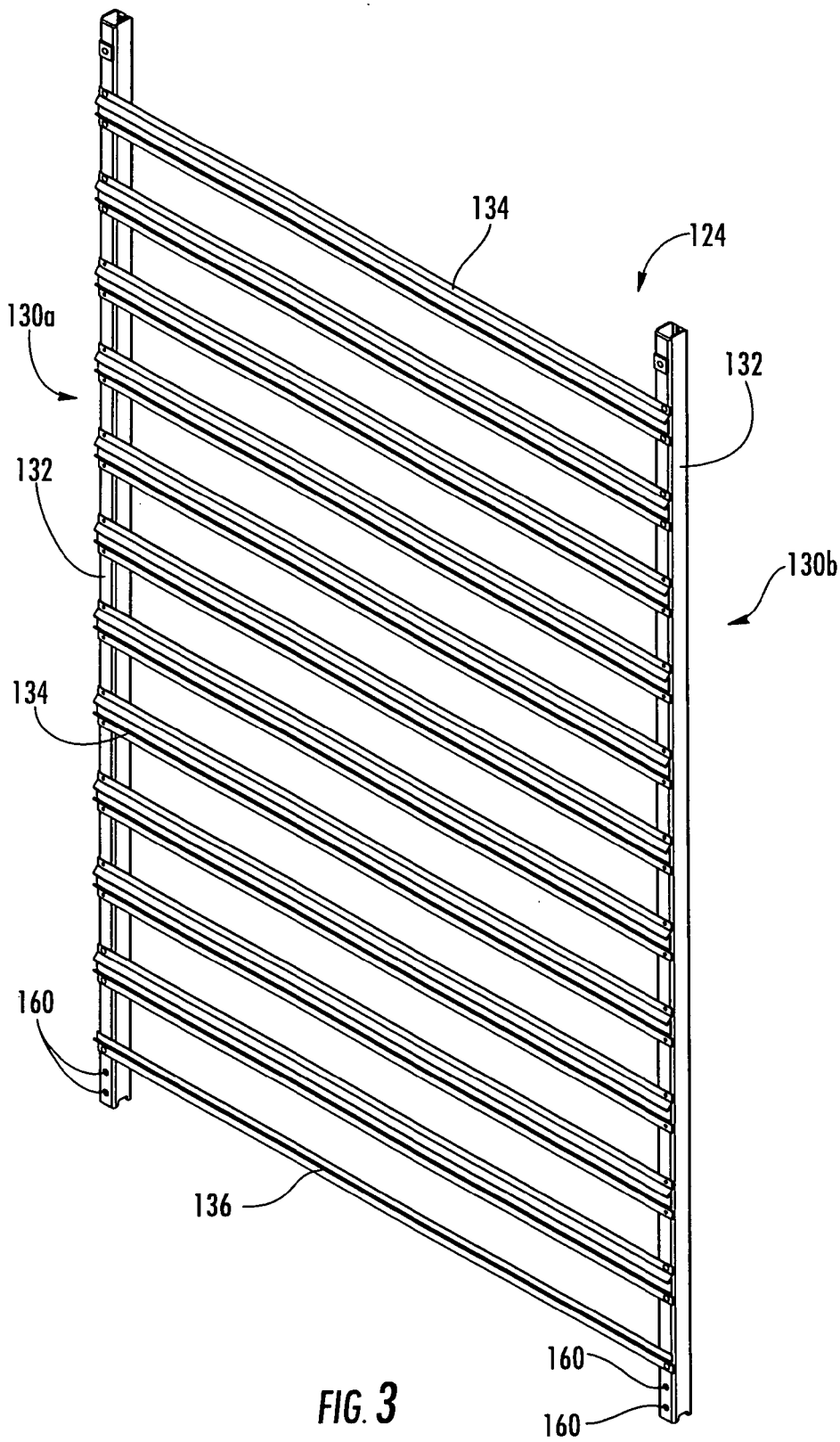
FIG. 3 is a perspective view of a frame of the display stand.
Figure 4:
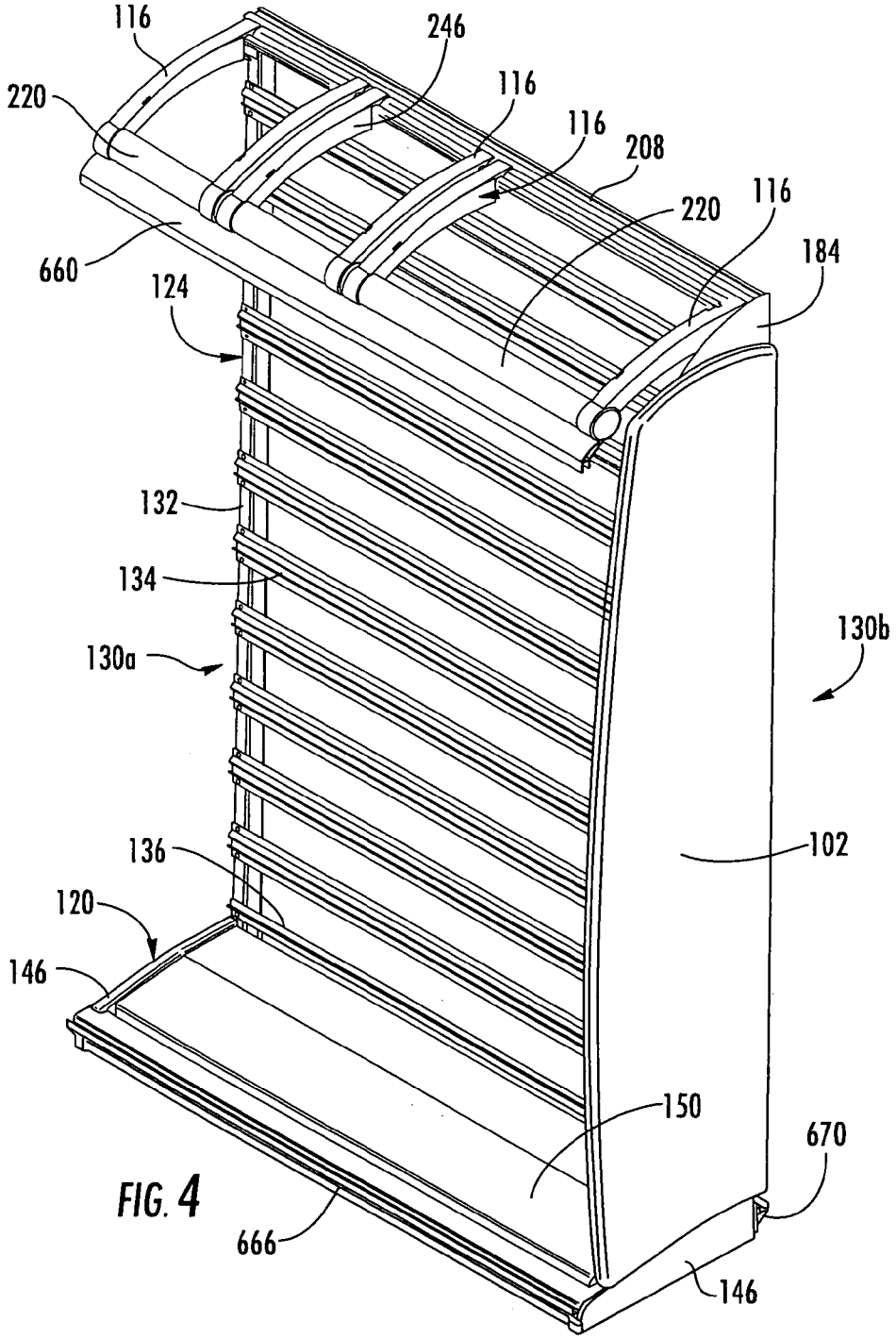
FIG. 4 is a perspective view of the frame, base, an end panel, and a plurality of overhead lights and light brackets.
Figure 8:
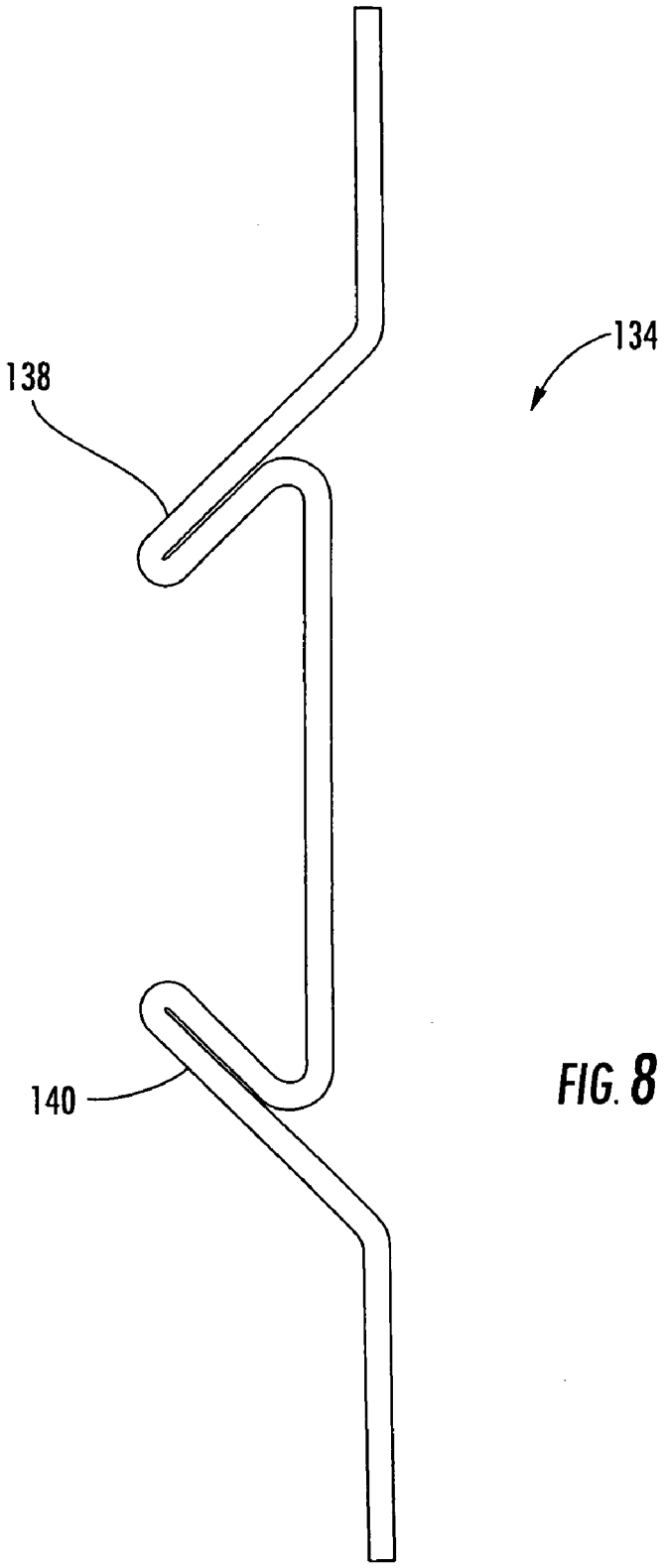
FIG. 8 is a side, elevational view of a double hanger rail of the frame.
Figure 9:
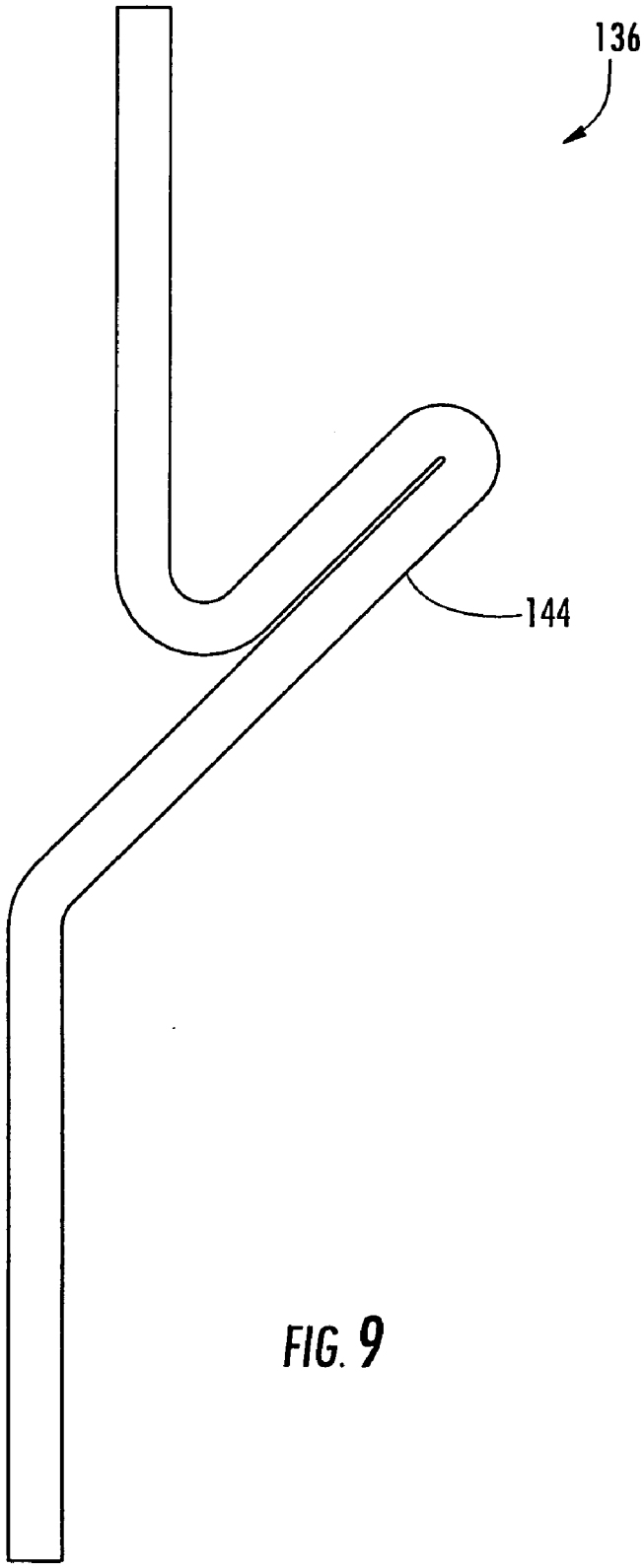
FIG. 9 is a side, elevational view of a single hanger rail of the frame.
Figure 20:
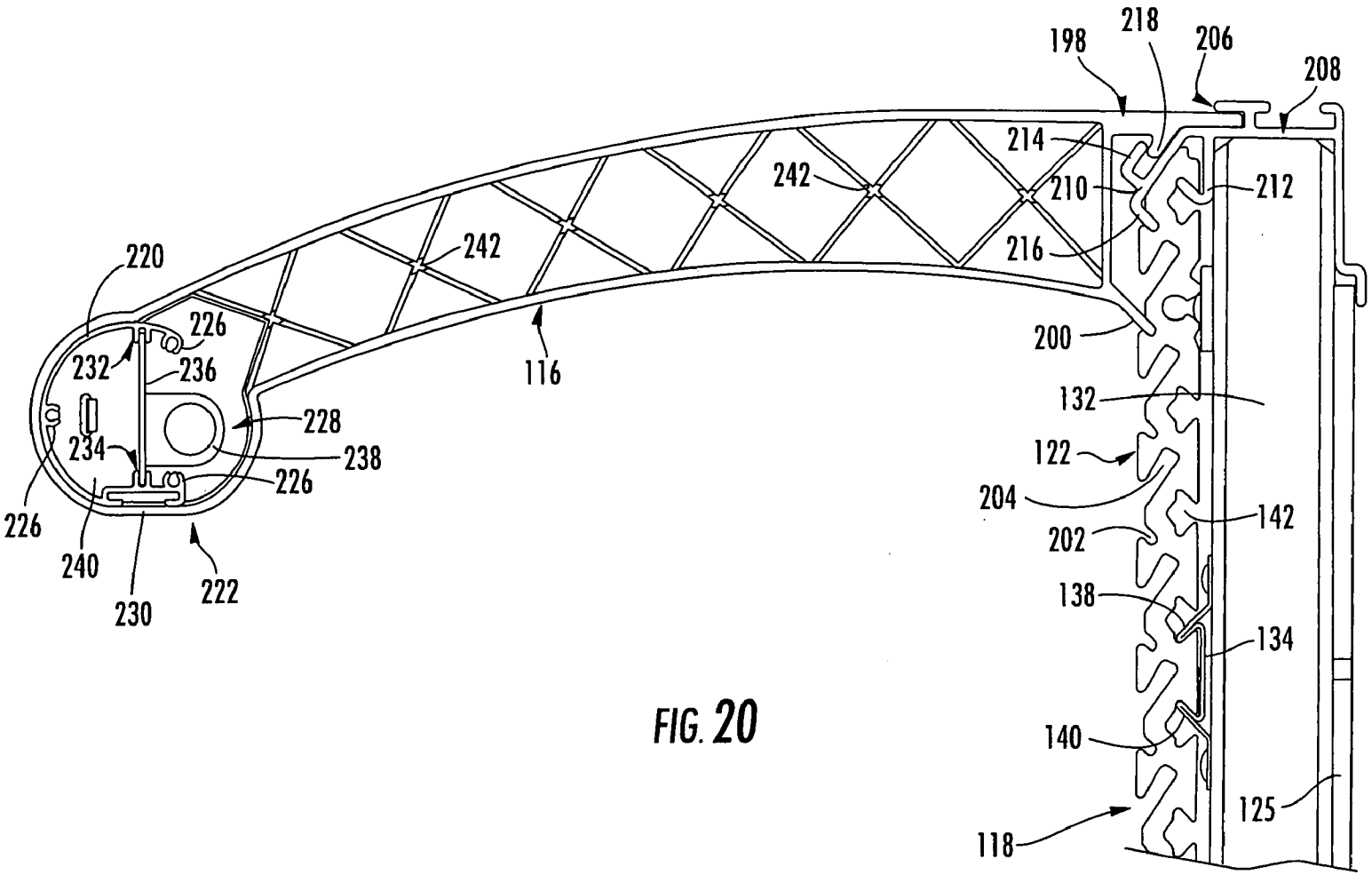
FIG. 20 is a partial, side elevational view of a light bracket shown attached to the top end of the back wall.

The construction of frame 124 is depicted in more detail in FIG. 3. Frame 124 includes a pair of vertical posts 132 that are positioned at each end of frame 124. Posts 132 are oriented generally parallel to each other. Posts 132 are connected to each other by way of a plurality of horizontal, double hanger rails 134. A single hanger rail 136 is positioned adjacent the bottom of frame 124. Posts 132, double hanger rails 134, and single hanger rail 136 may all be manufactured from a suitable metal, such as steel. Other materials are also possible. Hanger rails 134 and 136 may be attached to posts 132 by any suitable means, such as rivets, screws, welding, or other means. Hanger rails 134 and 136 are used to support slot wall 122 on frame 124. More specifically, double hanger rails 134 each include an upper flange 138 and a lower flange 140 (FIG. 8). Each flange 138 and 140 fits into a rear slot 142 defined on the back of slot wall 122 (FIG. 20). Similarly, single hanger rail 136 includes a flange 144 that fits into one of the rear slots 142 on slot wall 122 (FIG. 9). The flanges on rails 134 and 136 thus secure slot wall 122 to frame 124. In order to insert flanges 138, 140, and 144 into rear slots 142 on slot wall 122, the slot wall 122 must be positioned adjacent one of the sides 130*a* or 130*b* of frame 124 such that the flanges are in alignment with rear slots 142. The slot wall 122 is then slid across frame 124 from one side 130*a* towards another side 130*b*. Slot wall 122 is slid until it is centered between posts 132 on frame 124. Once in this position, slot wall 122 is securely attached to frame 124 via hanger rails 134 and 136. In order to remove slot wall 122 from frame 124, it must be slid off one of the sides 130*a* or *b* of frame 124. A rear panel 125 may be attached by suitable means to the back side of frame 124.

While the accompanying drawings illustrate only a single slot wall 122 attached to frame 124 (e.g. FIG. 2), it will be understood that slot wall 122 may be comprised of a number of individual, smaller sized slot wall segments. This may be done in order to allow slot wall 122 to be more easily manufactured. While slot wall 122 can be made from any suitable material, it may advantageously be extruded from plastic. As such, it may be easier to manufacture sections of slot wall 122 having heights and widths that are less than that depicted in FIG. 2. In such a case, each section of the slot wall 122 is attached to frame 124 via hanger rails 134 and 136. Each slot wall section is suitably tall such that it will encompass at least one set of hanger rails 134 or 136, although more preferably at least two sets of rails 134 and 136. Thus, each section of the slot wall will be secured to frame 124 by way of rails 134 and 136. While the height of display stand 100 can be any desired height, the invention specifically contemplates heights ranging anywhere from three feet up to eight feet, or more. A sufficient number of slot wall segments are attached to frame 124 to cover the front of frame 124, regardless of its height.

Figure 12:
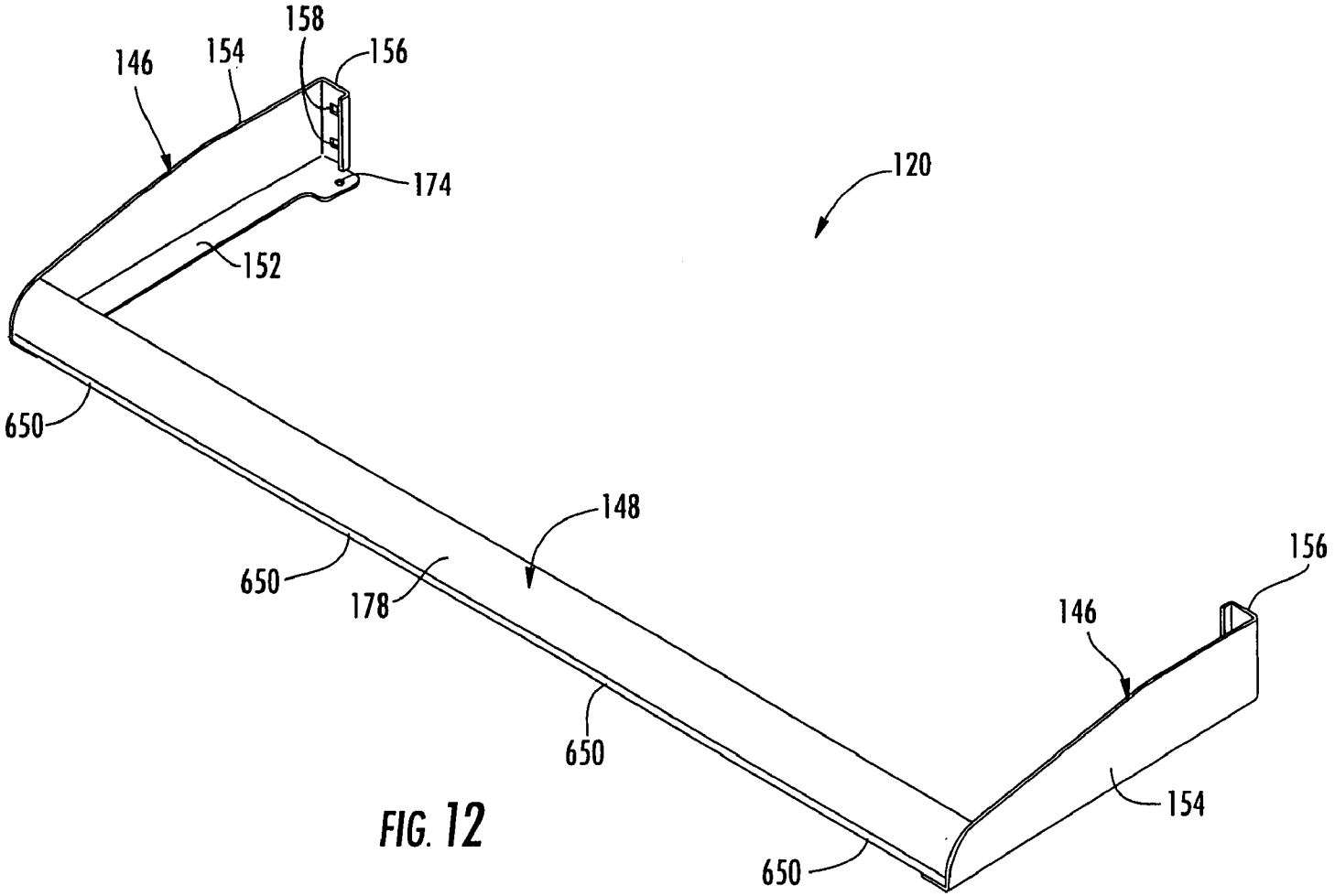
FIG. 12 is a perspective view of the base illustrated without a cover.
Figure 13:
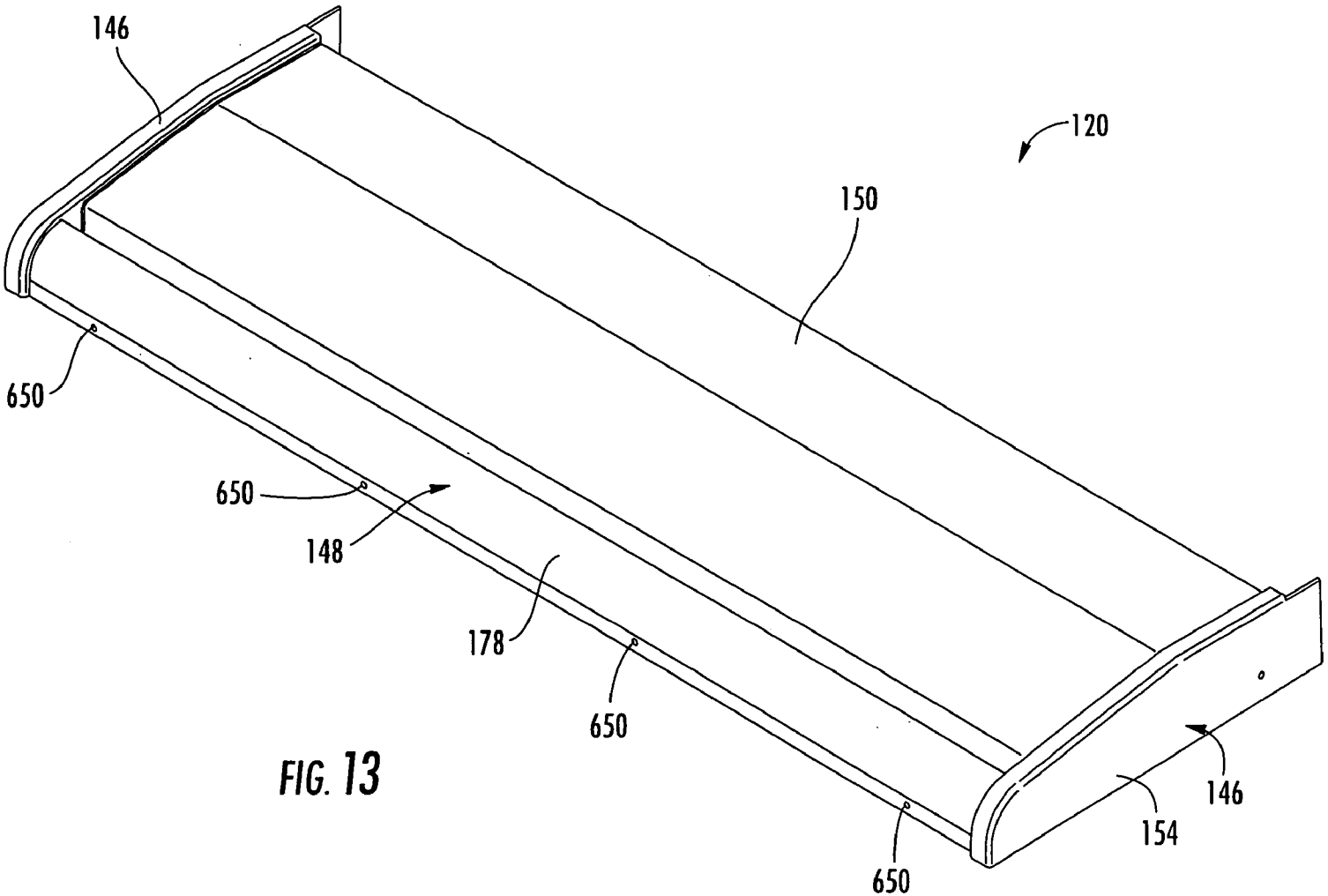
FIG. 13 is a perspective view of the base illustrated with a cover.
Figure 14:
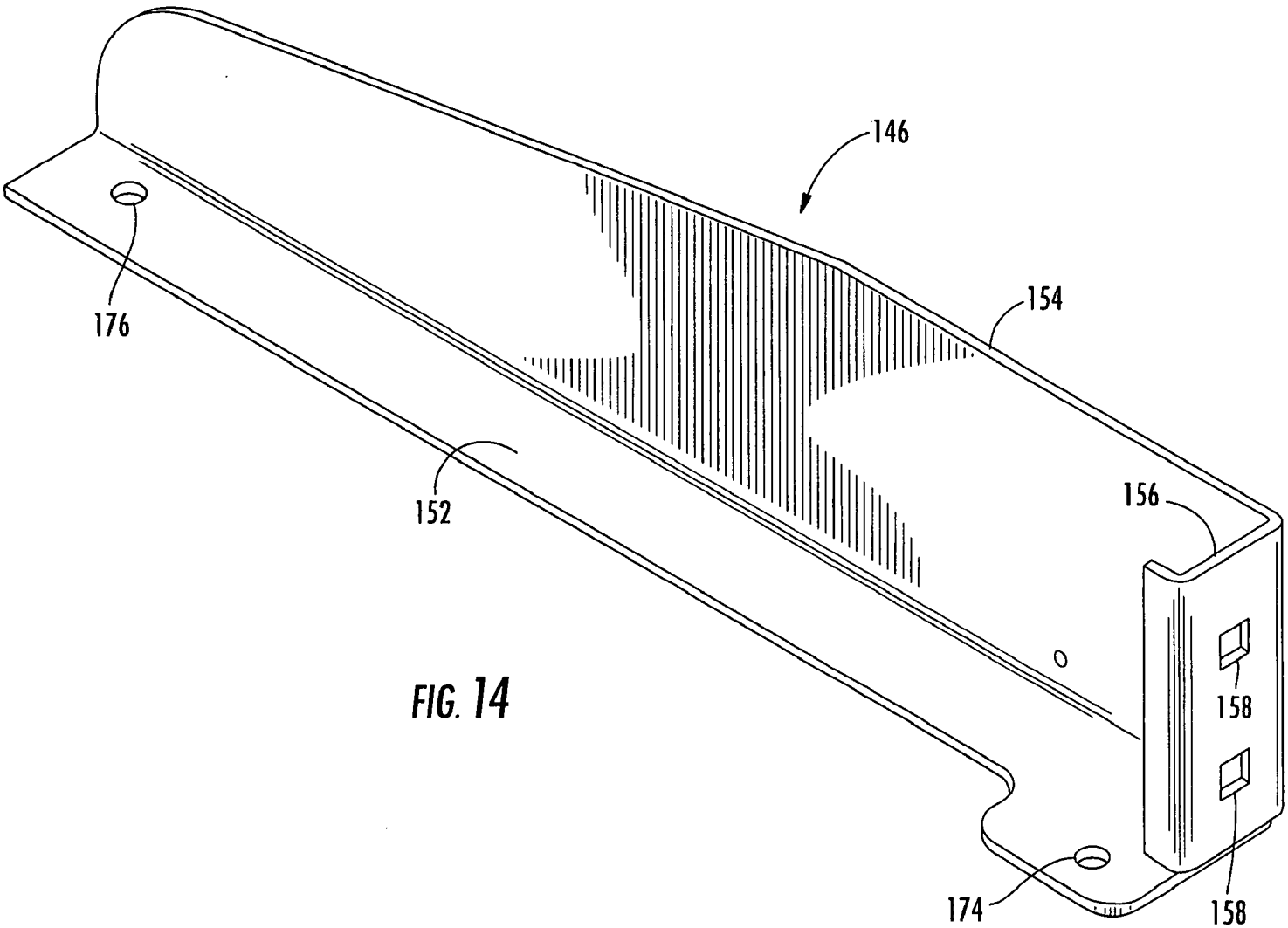
FIG. 14 is a perspective view of a foot in the base.
Figure 15:
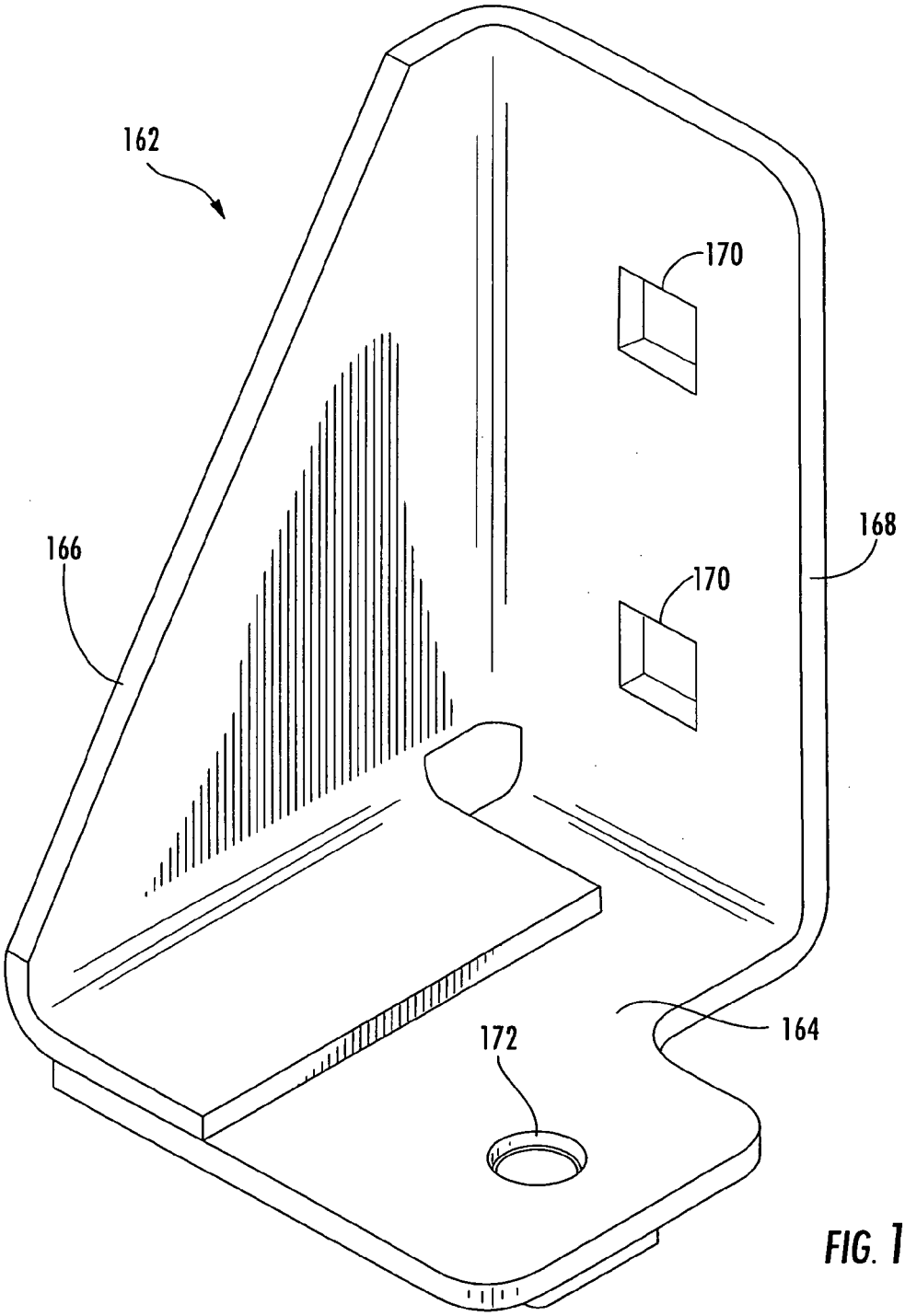
FIG. 15 is a perspective view of a leveler extension bracket.
Figure 16:
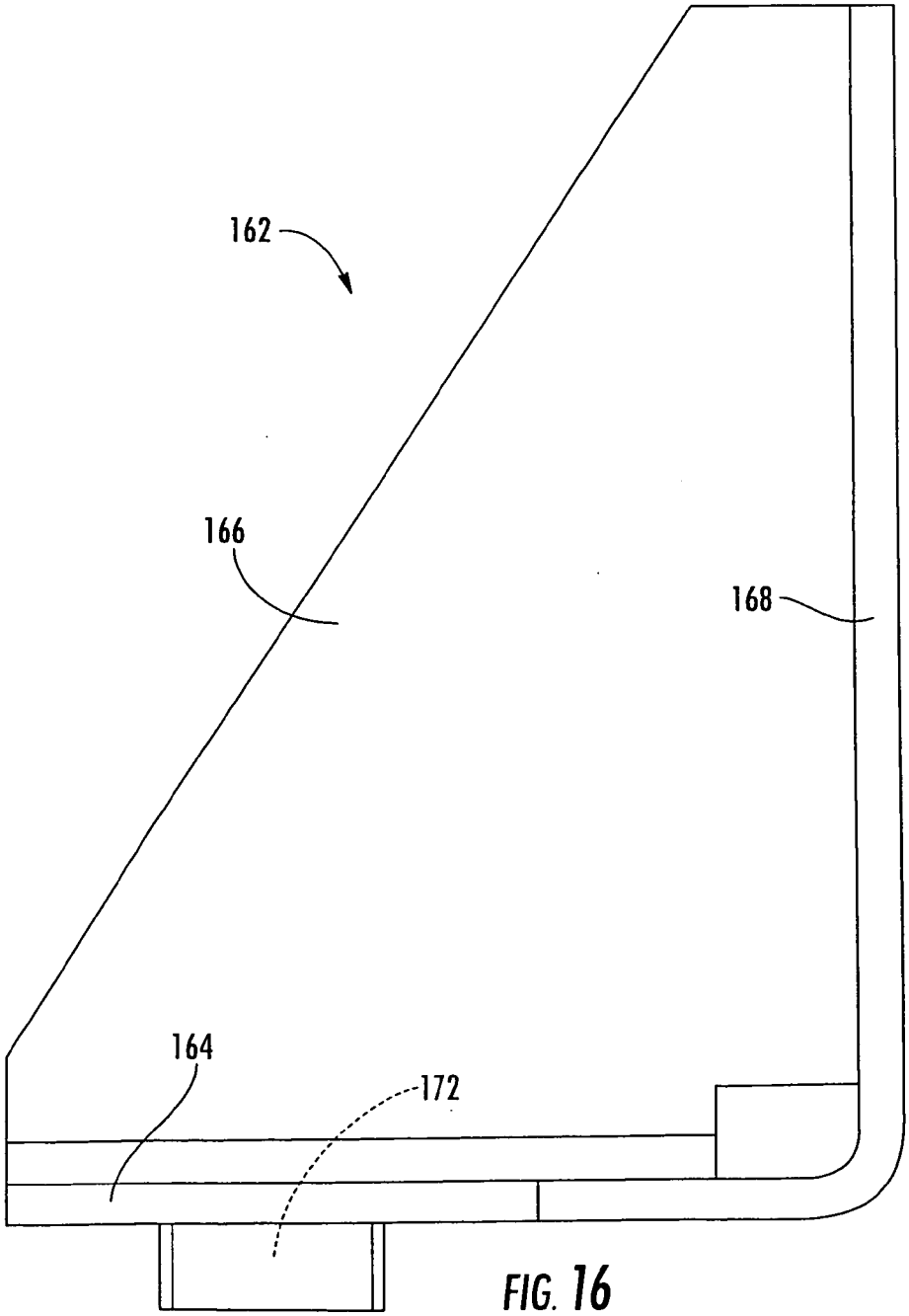
FIG. 16 is a side, elevational view of the bracket of FIG. 15.
Figure 17:
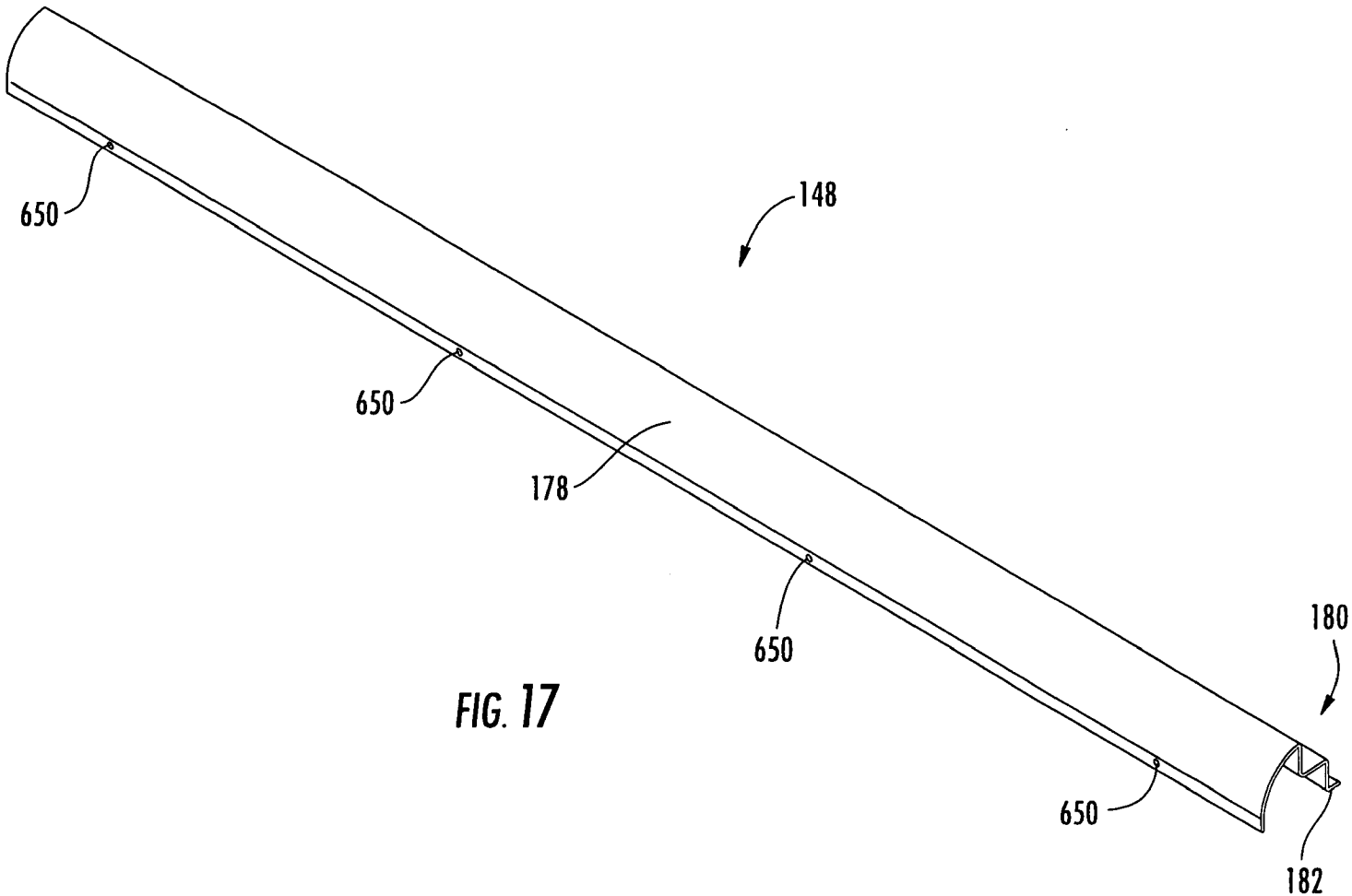
FIG. 17 is a perspective view of a front rail of the base.

Base 120, which is illustrated in more detail in FIGS. 2, 4, and 12–18, includes a pair of feet 146 that are connected together by a front rail 148. Base 120 may further include an optional cover 150 that helps conceal the interior space surrounded by feet 146 and front rail 148. As illustrated more clearly in FIG. 12, feet 146 are positioned at either end of front rail 148 and are oriented generally parallel to each other. Front rail 148 is oriented generally perpendicular to each foot 146. Front rail 148, which is depicted in detail in FIG. 17, is secured to each foot 146 by welding, or other suitable methods of attachment. Each foot includes a horizontal plate 152, a vertical side plate 154, and a vertical back plate 156 (FIG. 14). Each of the plates 152–156 may be formed by bending a blank sheet of metal. A pair of square apertures 158 are defined in vertical back plate 156 and are vertically aligned with each other. Square apertures 158 are used to secure base 120 to the posts 132 of frame 124. Specifically, each post 132 is positioned on top of horizontal plate 152 of each foot 146 in front of vertical back plate 156. When so positioned, square apertures 158 and vertical back plate 156 are aligned with a pair of post apertures 160 defined near the bottom of each of posts 132 (FIG. 3). A pair of carriage bolts may then be inserted through each pair of square apertures 158 into post apertures 160 in posts 132. The insertion of these bolts through square apertures 158 into post apertures 160 secures base 120 to post 132 and thus to frame 124 and the entire back wall 118.

In the embodiment of display stand 100 depicted in FIG. 1, there are two bases 120 attached to two frames 124. One frame 124 and one base 120 are positioned alongside of the other base 120 and frame 124. Each frame and base may have a standard length in which they are manufactured, such as four feet, although other lengths may be used. A display stand having any integer multiples of this standard length can then be easily constructed by positioning the selected number of frames and bases next to each other. Different sized display stands 100 can therefore be easily constructed.

In some instances, it may be desirable to provide additional front-to-back stability for display stand 100. A pair of leveler extension brackets 162 may be used for this purpose (FIGS. 15–16). Each leveler extension bracket 162 includes a bottom plate 164, a side plate 166, and a rear plate 168. Bottom plate 164 is positioned horizontally when leveler extension bracket 162 is attached to feet 146. Rear plate 168 includes a pair of square apertures 170. When used, square apertures 170 of leveler extension bracket 162 align with square apertures 158 of feet 146, which are also aligned with post apertures 160 of posts 132. In order to attach leveler extension bracket 162 to base 120, the carriage bolts that are inserted through square apertures 158 and post apertures 160 are also inserted through square apertures 170 in leveler extension bracket 162. When in use, rear plate 168 of leveler bracket 162 is positioned in contact with, and directly behind, vertical back plate 156 of foot 146. Bottom plate 164 of leveler bracket 162 is positioned such that it extends rearwardly away from frame 124. Leveler bracket 162 is then secured to feet 146 and post 132 by way of the carriage bolts. The rearward extension of bracket 162 from frame 124 provides additional resistance to tipping of stand 100.

Bottom plate 164 of leveler bracket 162 includes a threaded aperture 172 (FIGS. 15–16). A threaded screw, or other structure having an enlarged head, may be inserted through threaded aperture 172. By appropriately rotating the screw, or other structure, the distance of its head from bottom plate 164 can be adjusted. Further, by rotating this screw, or other structure, the height of the attached post 132 can be adjusted. By appropriately rotating this screw in both brackets 162, display stand 100 can be set up such that it is horizontally level regardless of any irregularities in the surface on which it is positioned. Each foot 146 further includes a front aperture 176 and a rear aperture 174 that are both threaded and which may be used to receive screws, or other structures, that allow additional leveling adjustments to be made to stand 100 (FIG. 14).

Figure 18:
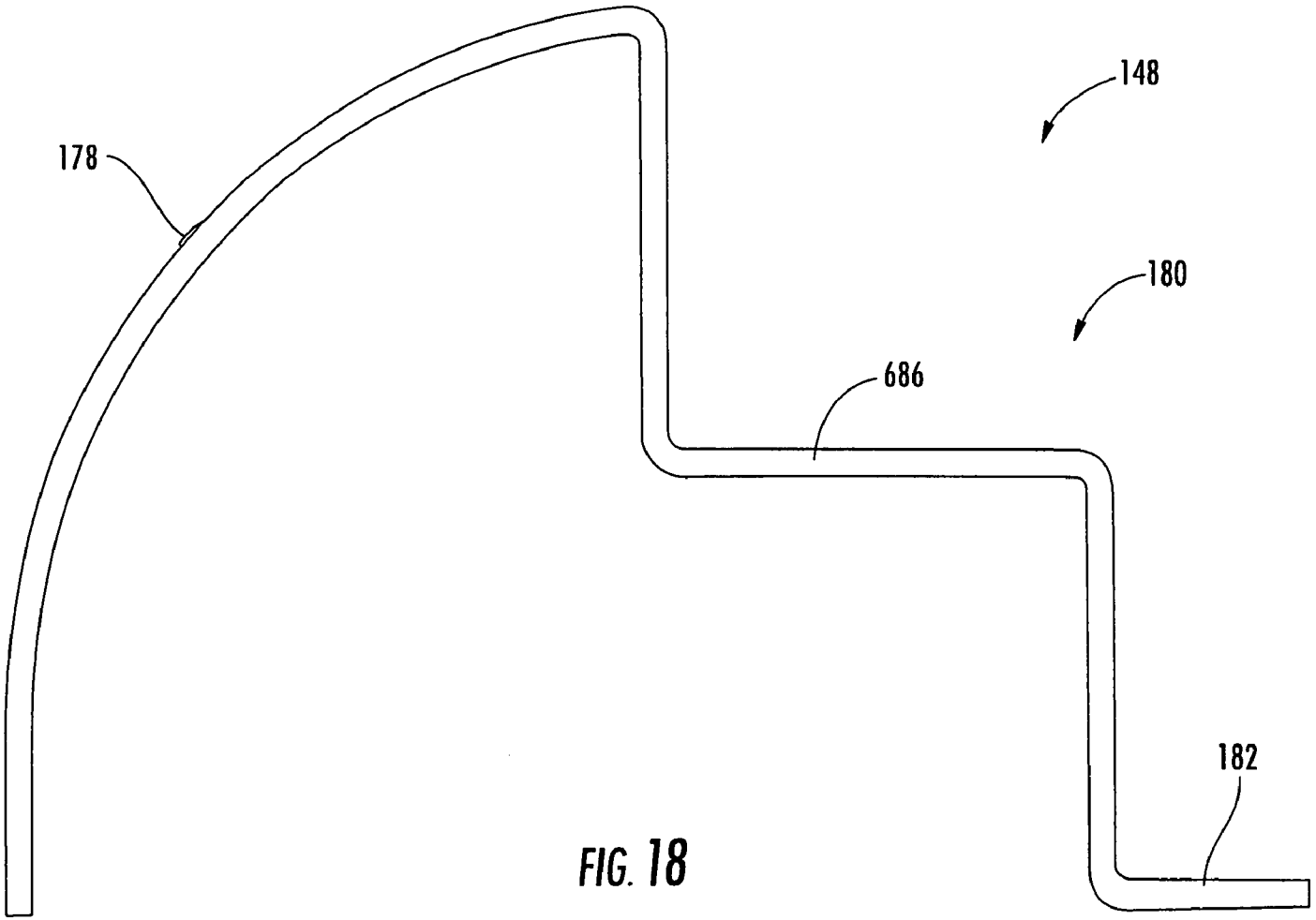
FIG. 18 is a side, elevational view of the rail of FIG. 17.
Figure 19:
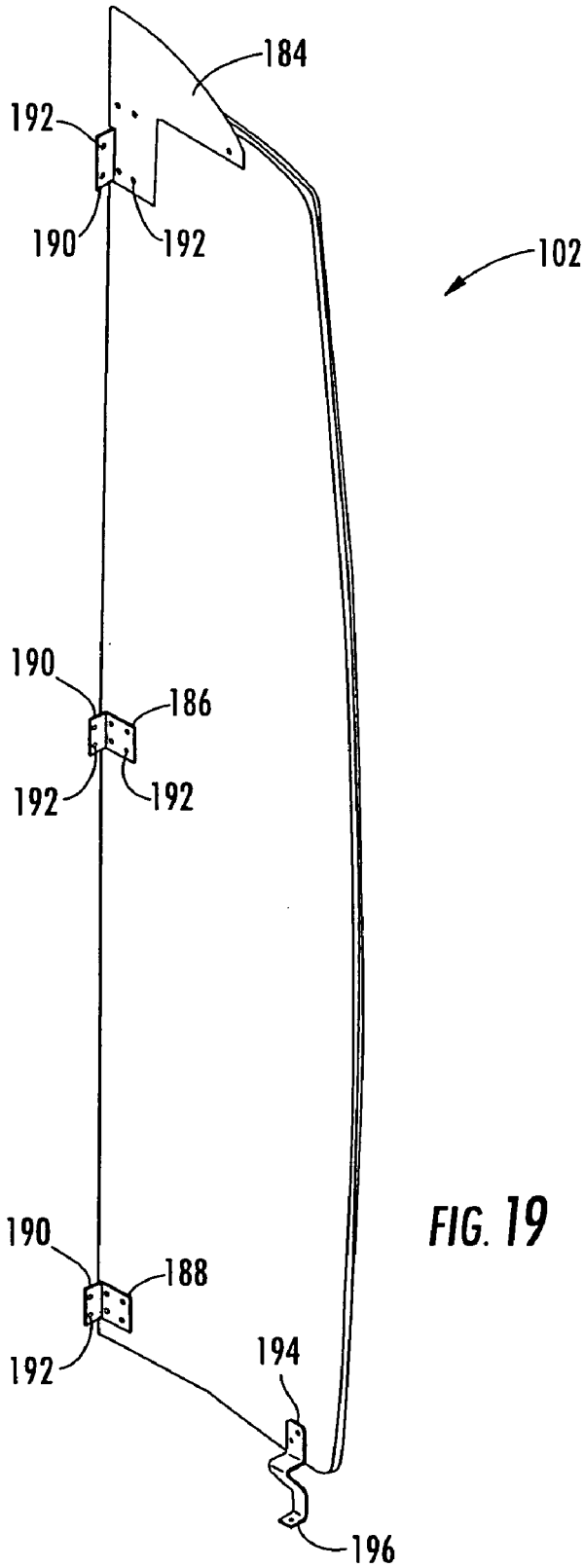
FIG. 19 is a perspective view of an end panel.

Front rail 148 of base 120 is depicted in more detail in FIGS. 17 and 18. Front rail 148 includes a curved front 178 and a stepped back 180. The stepped back 180 further includes a horizontal wall 686 that is used to partially secure the end panels 102 to display stand 100. As illustrated in FIG. 19, end panel 102 includes an upper bracket 184, a middle bracket 186, and a lower bracket 188. Each bracket 184–188 includes a perpendicular flange 190 having a plurality of fastener holes 192 defined therein. The fastener holes 192 receive screws, rivets, or any other suitable fastener for securing the brackets 184–188 to one of the posts 132. Specifically, these fasteners are inserted through fastener holes 192 and into the back side of the post 132. In addition to being attached to one of the posts 132, each bracket 184, 186, and 188 is attached to end panel 102. End panel 102 may be constructed out of wood, or any other suitable material. Screws, or any other suitable fasteners may be used to secure brackets 184, 186, and 188 to end panel 102.

Figure 6:
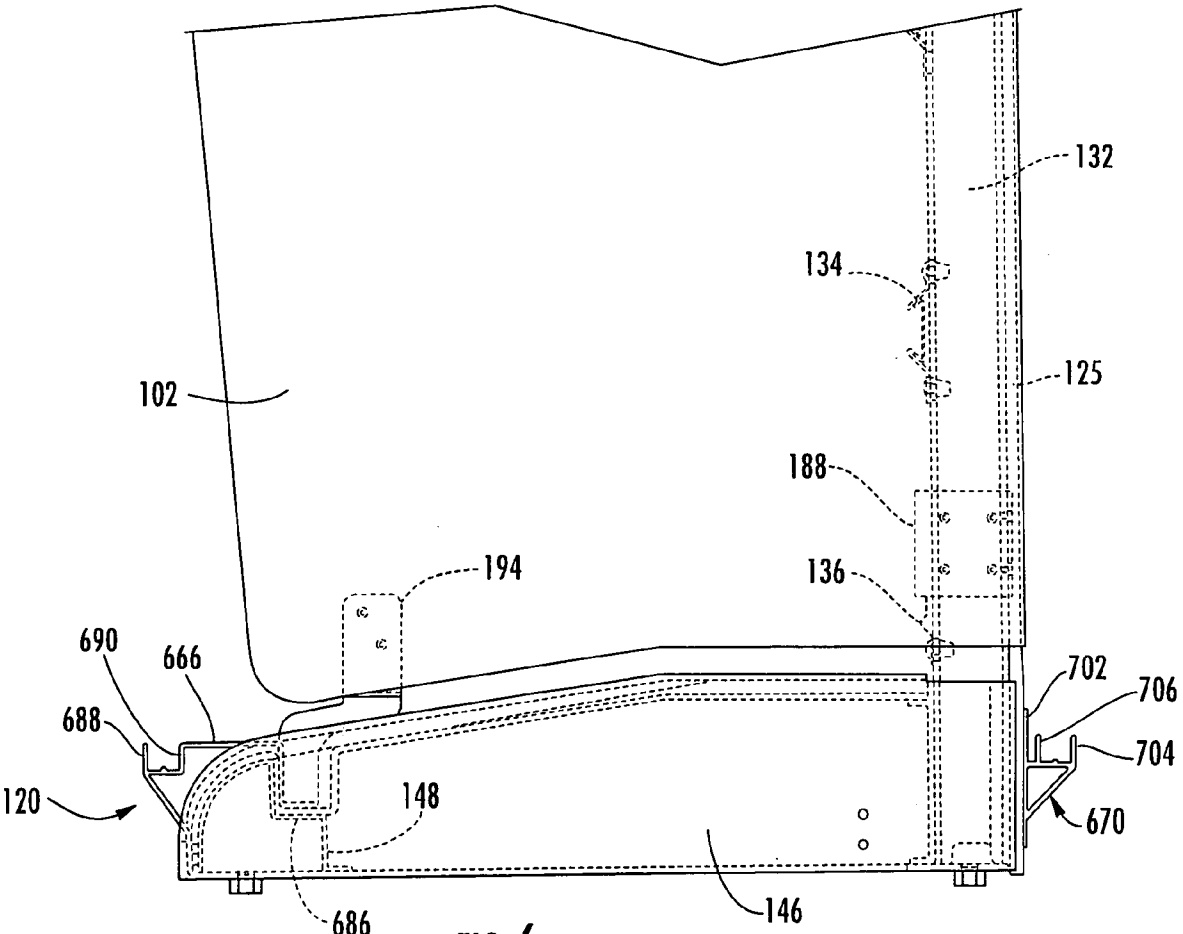
FIG. 6 is a partial, elevational view of the lower portion of the components of FIG. 4.
Figure 7:
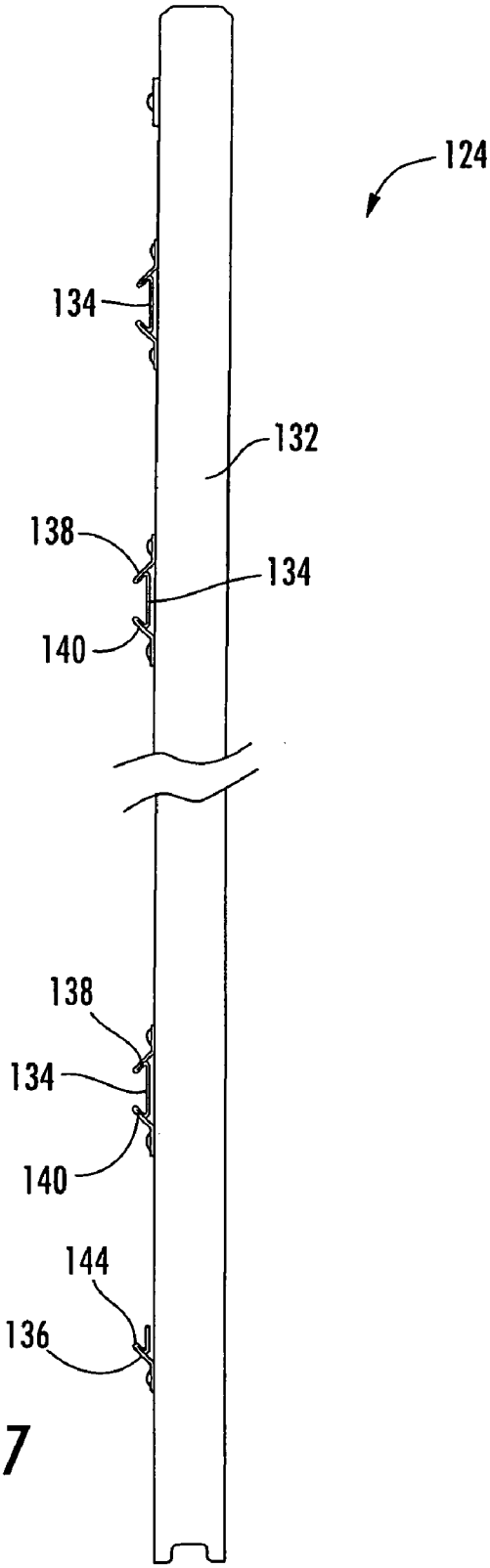
FIG. 7 is a side, elevational view of the frame.

In addition to brackets 184, 186, and 188, end panel 102 further includes a front, lower bracket 194. Front lower bracket 194 includes a bottom, horizontal flange 196 that has an aperture defined in it. When end panel 102 is attached to display stand 100, bottom, horizontal flange 196 is positioned on top of horizontal wall 686 of front rail 148. Bottom flange 196 may be secured thereto by a screw, rivet, welding, or any other suitable fastening technique (FIGS. 6 and 19).

Figure 10:
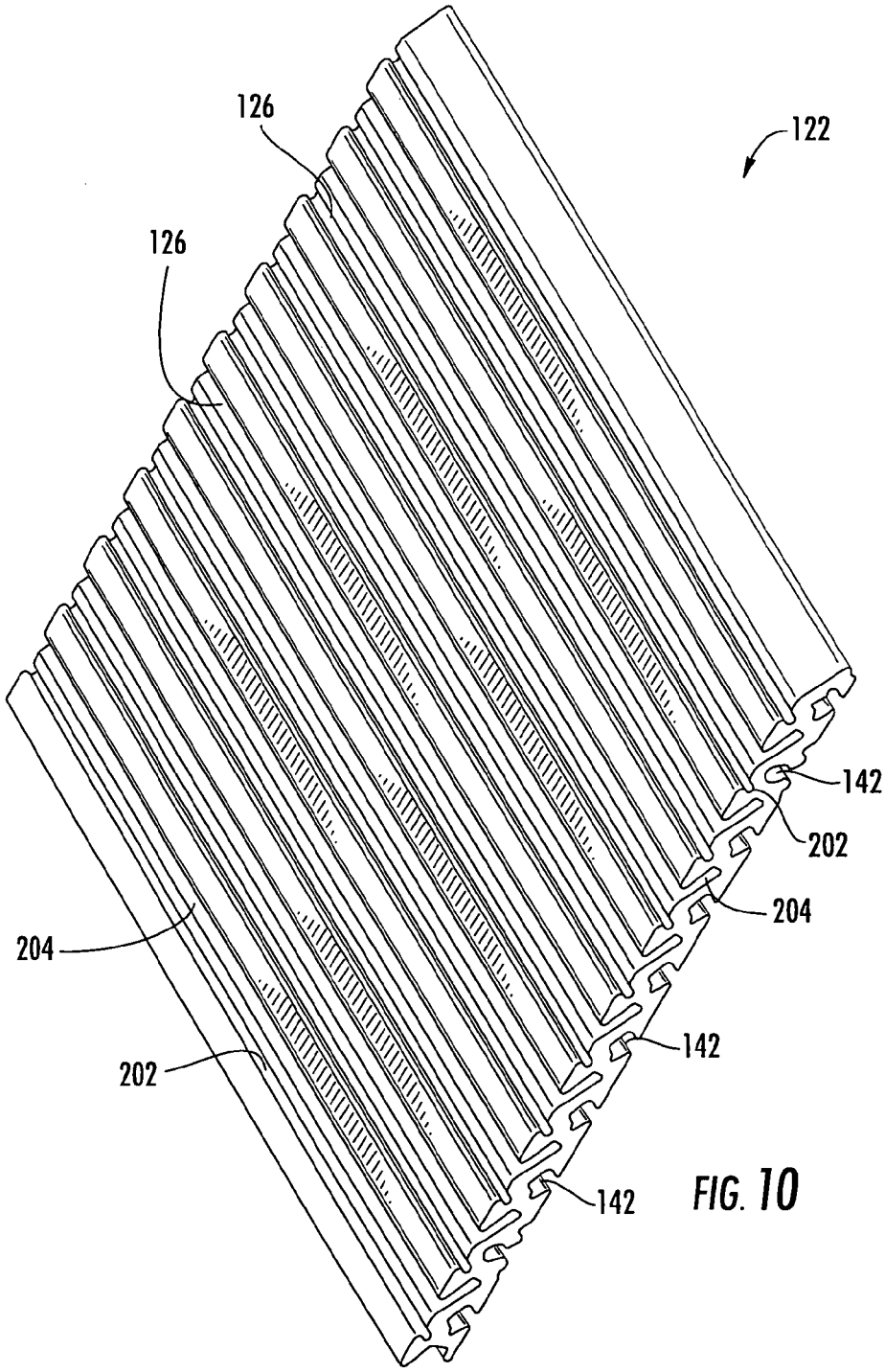
FIG. 10 is a perspective view of a portion of the slot wall.
Figure 11:
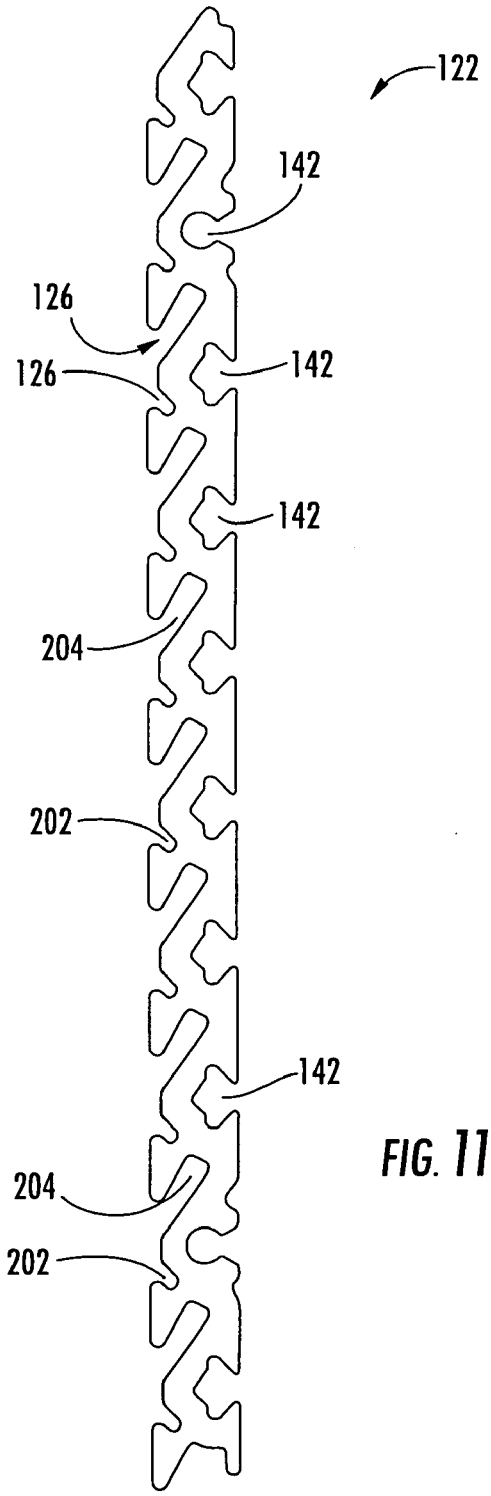
FIG. 11 is a side, elevational view of the slot wall.

The attachment of an upper light bracket 116 to back wall 118 is depicted in more detail in FIG. 20. Upper light bracket 116 attaches to the top end of back wall 118. The rear portion of light bracket 116 includes an upper insert 198 and a lower insert 200. Lower insert 200 fits into one of the slots 126 defined in slot wall 122. More specifically, lower insert 200 fits into one of a plurality of small slots 202 defined in slot wall 122. As illustrated in FIGS. 10–11 and 20, the slots 126 defined in slot wall 122 are of two different types. These include small slots 202 and large slots 204. Small slots 202 and large slots 204 are arranged in slot wall 122 in a vertically, alternating fashion. Small slots 202 extend into slot wall 122 a smaller amount than large slots 204. Small slots 202 are also angled downwardly into slot wall 122, while large slots 204 are angled upwardly into slot wall 122. Because the shapes of slots 202 and 204 are not standard, standard shelving that may be more suitable for supporting products not intended to be displayed on stand 100 are less likely to be positioned on stand 100. Slots 202 and 204 thus act to deter using stand 100 for displaying undesired products. The use of small slots 202 and large slots 204 will be described in more detail below.

As mentioned above, one of the lower inserts 200 on light bracket 116 fits into the second highest small slot 202 defined in slot wall 122 (FIG. 20). The upper insert 198 on light bracket 116 fits into a forward channel 206 defined in a top wall extrusion 208. Top wall extrusion 208 is fixedly attached to the top of back wall 118 by any suitable technique, such as riveting, welding, or other means. While top wall extrusion 208 is referred to as an extrusion, and indeed may be manufactured using an extrusion process, it will be understood that it could be constructed using other techniques. In fact, all parts referred to herein as "extrusions" can be made using an extrusion process, or some other manufacturing process.

Figure 25:
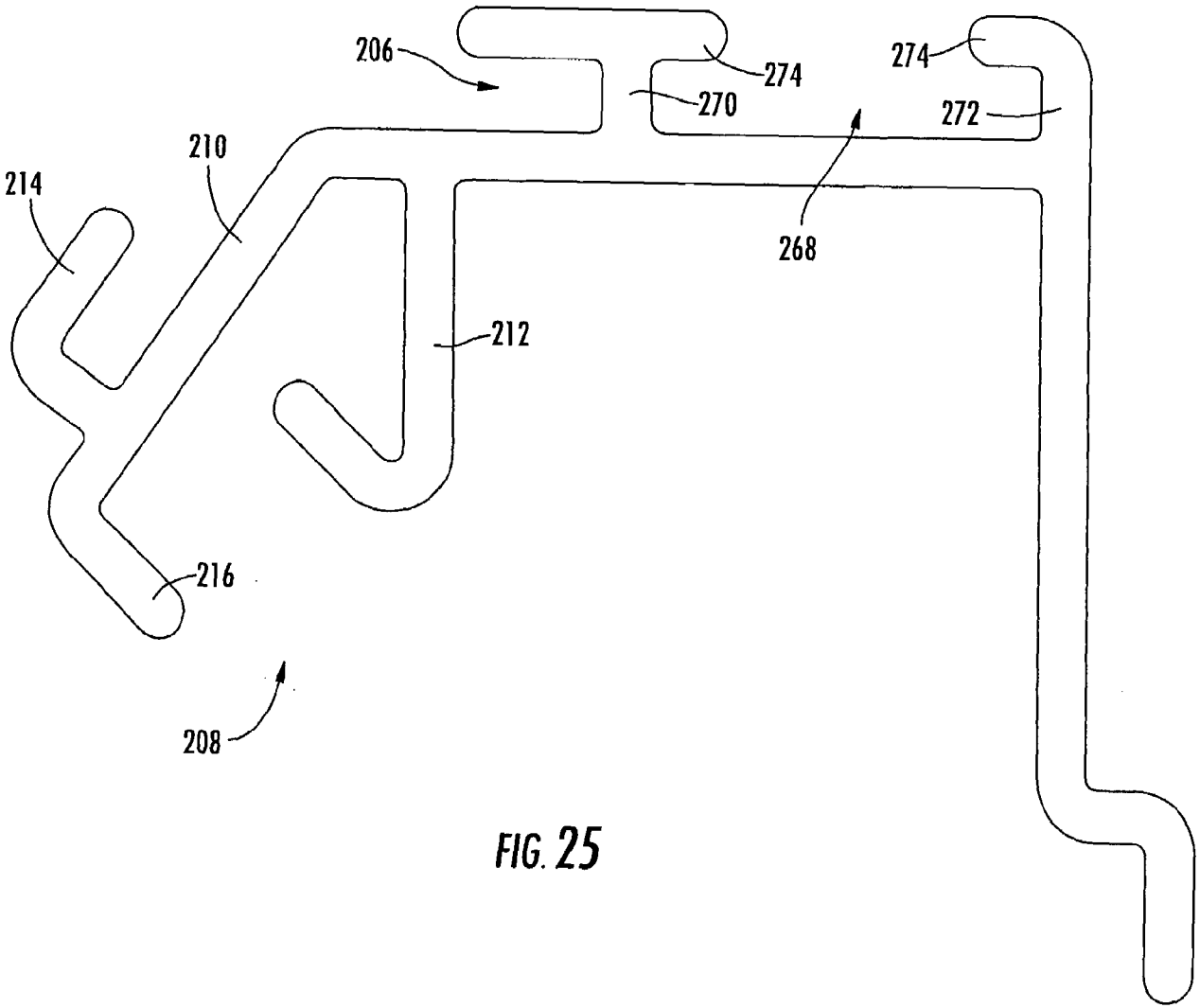
FIG. 25 is a side, elevational view of a top wall extrusion.

Top wall extrusion 208 includes a front lower arm 210 and an intermediate lower arm 212 (FIGS. 20 and 25). Intermediate lower arm 212 hooks into one of the rear slots 142 defined on the back side of slot wall 122. Intermediate lower arm 212 thus helps secure the top end of slot wall 122 to frame 124. Front lower arm 210 of top wall extrusion 208 includes an upper finger 214 and a lower finger 216. Lower finger 216 fits into the upper-most small slot 202 defined in slot wall 122 (FIG. 20). The engagement of lower finger 216 in this small slot 202 helps to further secure extrusion 208 to slot wall 122, which in turn secures slot wall 122 to frame 124. Upper finger 214 of front lower arm 210 functions to hold light bracket 116 on back wall 118 in a snap-fitting manner. Specifically, upper insert 198 of light bracket 116 includes a shoulder 218 that initially engages the tip of upper finger 214 when bracket 116 is attached to back wall 118. This engagement forces shoulder 218 to flex until shoulder 218 moves past upper finger 214. Once shoulder 218 has moved past upper finger 214, shoulder 218 snaps back to its unflexed condition. Thereafter, light bracket 116 cannot be removed from the top of back wall 118 without manually flexing shoulder 218 to allow it to be extracted past upper finger 214.

The attachment of light bracket 116 to the top of back wall 118 is thus accomplished by first inserting upper insert 198 into front channel 206 of top wall extrusion 208. After being inserted therein, the front end of light bracket 116 is pivoted downwardly, which causes shoulder 218 to push against upper finger 214. By applying sufficient downward force on the front end of light bracket 116, shoulder 218 can be snapped past upper finger 214. As this occurs, lower insert 200 fits into one of the small slots 202 defined in slot wall 122. Once light bracket 116 is attached to back wall 118 in this manner, it cannot be removed by simply lifting the light bracket 116 vertically. Rather, as has been mentioned above, shoulder 218 must be manually flexed to allow it to be retracted past upper finger 214. Shoulder 218 is preferably made out of a suitably flexible material, such as plastic. The snap-fitting attachment of light bracket 116 to back wall 118 provides a firm and secure connection between these two items.

Figure 21:
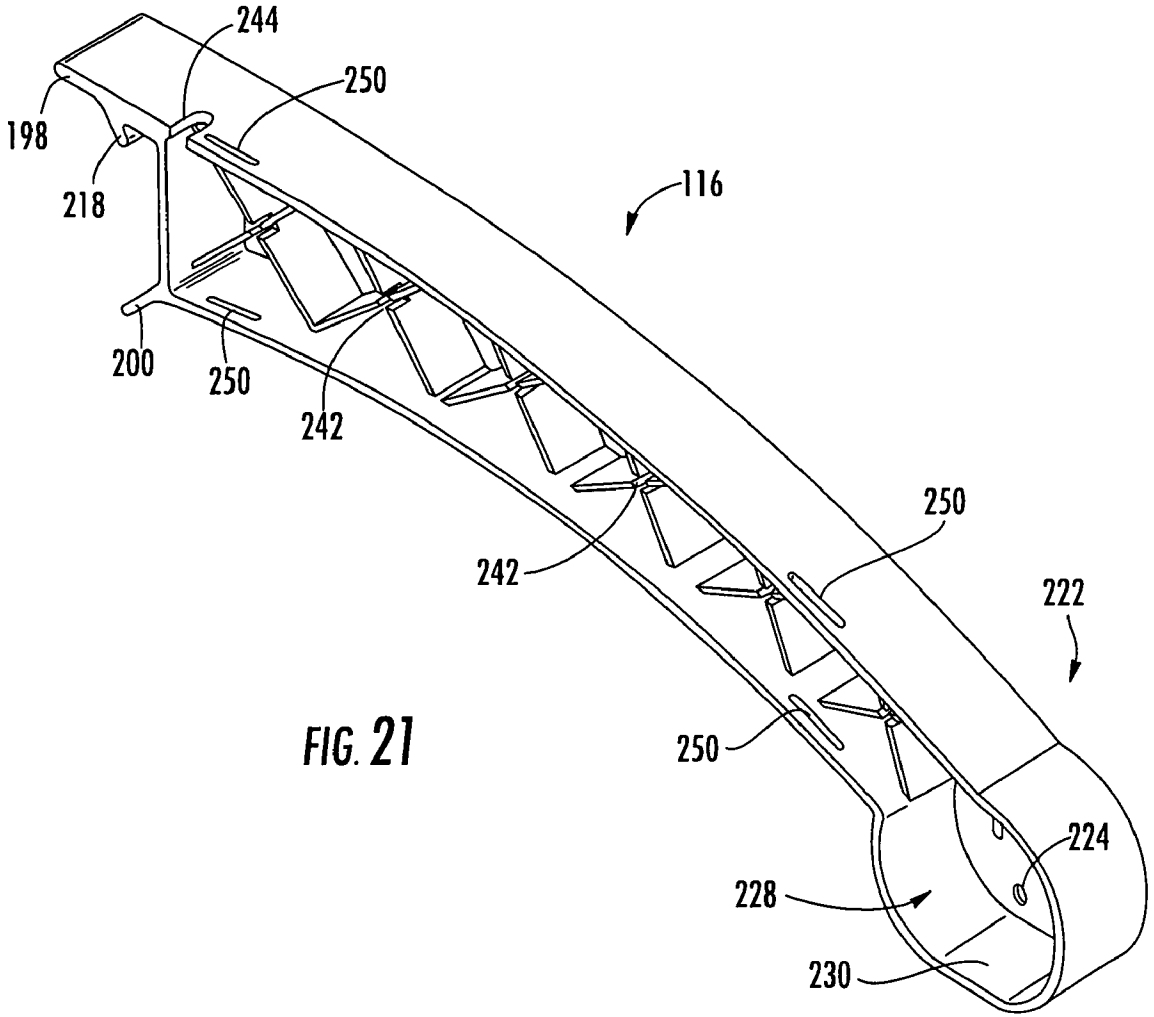
FIG. 21 is a perspective view of the light bracket of FIG. 20.
Figure 22:
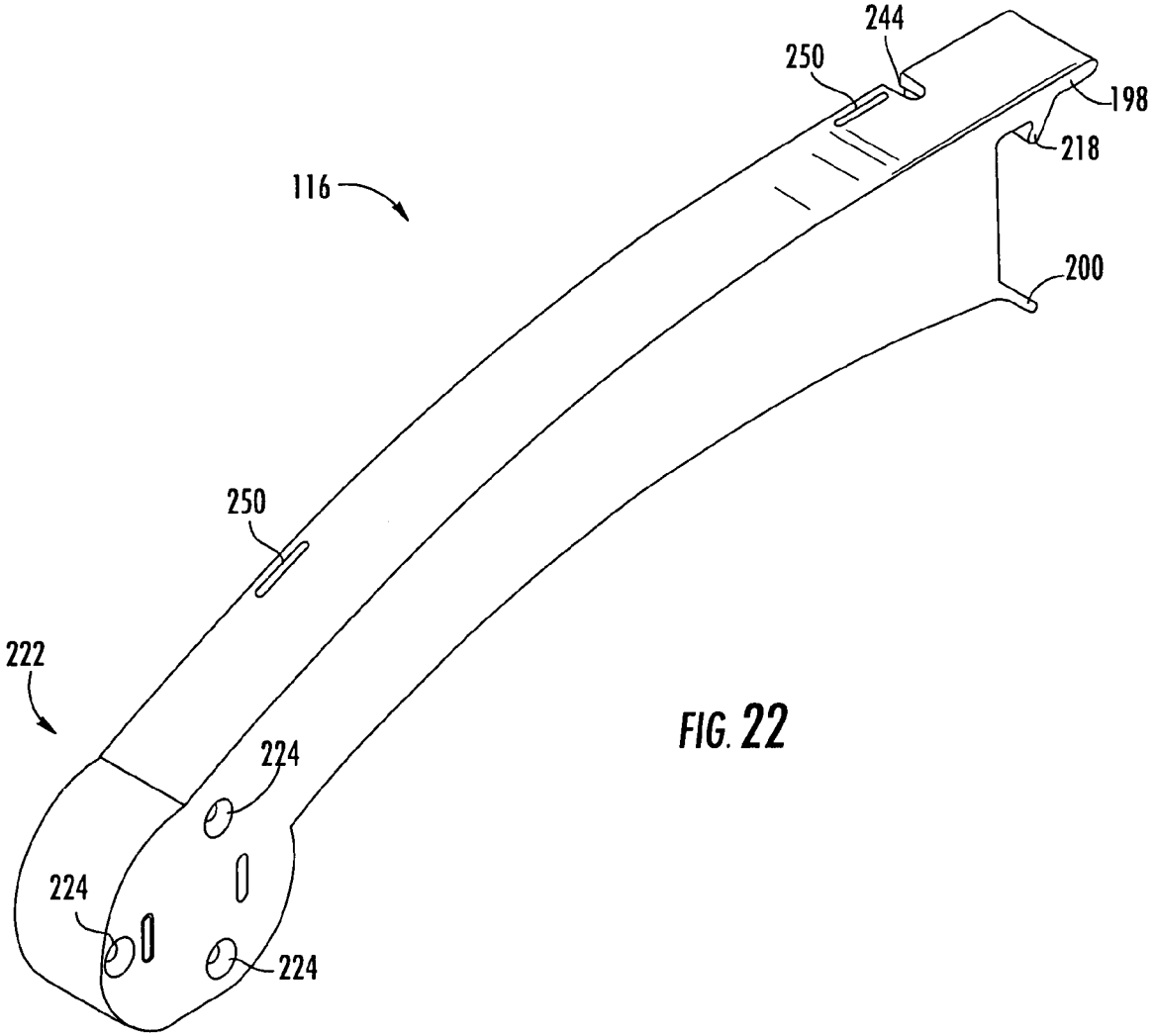
FIG. 22 is another perspective view of the light bracket taken from another angle.

Each light bracket 116 supports one end of a horizontal light bar 220 which, in turn, supports one or more fluorescent light bulbs. These light bulbs provide illumination to products being displayed on stand 100. Horizontal light bar 220 is supported at a front end 222 of light bracket 116. Three screw holes 224 are defined in the front end 222 of each light bracket 116. When light bar 220 is supported by light brackets 116, screw holes 224 are aligned with three screw bosses 226 defined in light bar 220. In order to secure horizontal light bar 220 to brackets 116, screws are inserted through each screw hole 224 into a corresponding screw boss 226 and tightened. Light bars 220 are further supported by light brackets 116 by partially fitting into an enclosure 228 defined in light brackets 116 (FIG. 21). Enclosure 228 includes a bottom wall 230 on which the ends of light bar 220 rest. Each light bar 220 is thus firmly attached to a pair of light brackets 116. Light bars 220 may be manufactured in one or more standard lengths. Depending on the length of display stand 100, more than one light bar may be attached using brackets 116 to ensure that light is provided to the entire top of stand 100.

Light bar 220 further includes an upper slot 232 and a lower slot 234. Upper and lower slots 232 and 234 receive a plate 236 (FIG. 20). A fixture 238 for a fluorescent light bulb is mounted on plate 236. When plate 236 is mounted to light bar 220 via upper and lower slots 232 and 234, a front enclosure 240 is defined. Front enclosure 240 provides a space for a ballast (not shown) for the fluorescent light bulb fixture 238. Electrical cords may also be positioned in front enclosure 240 and run along light bar 220 to either of the light brackets 116. Once the wires reach the light bracket 116, they may be positioned in a wire channel 242 defined in bracket 116. Wire channel 242 extends for substantially the entire length of bracket 116. A wire aperture 244 is defined on the top of bracket 116 adjacent its back end. Wire aperture 244 provides an aperture out of which the wires in bracket 116 may extend. From wire apertures 244, the wires may be inserted into power outlets connected to an electrical box positioned on the back of display stand 100, which will be discussed in more detail below.

Figure 23:
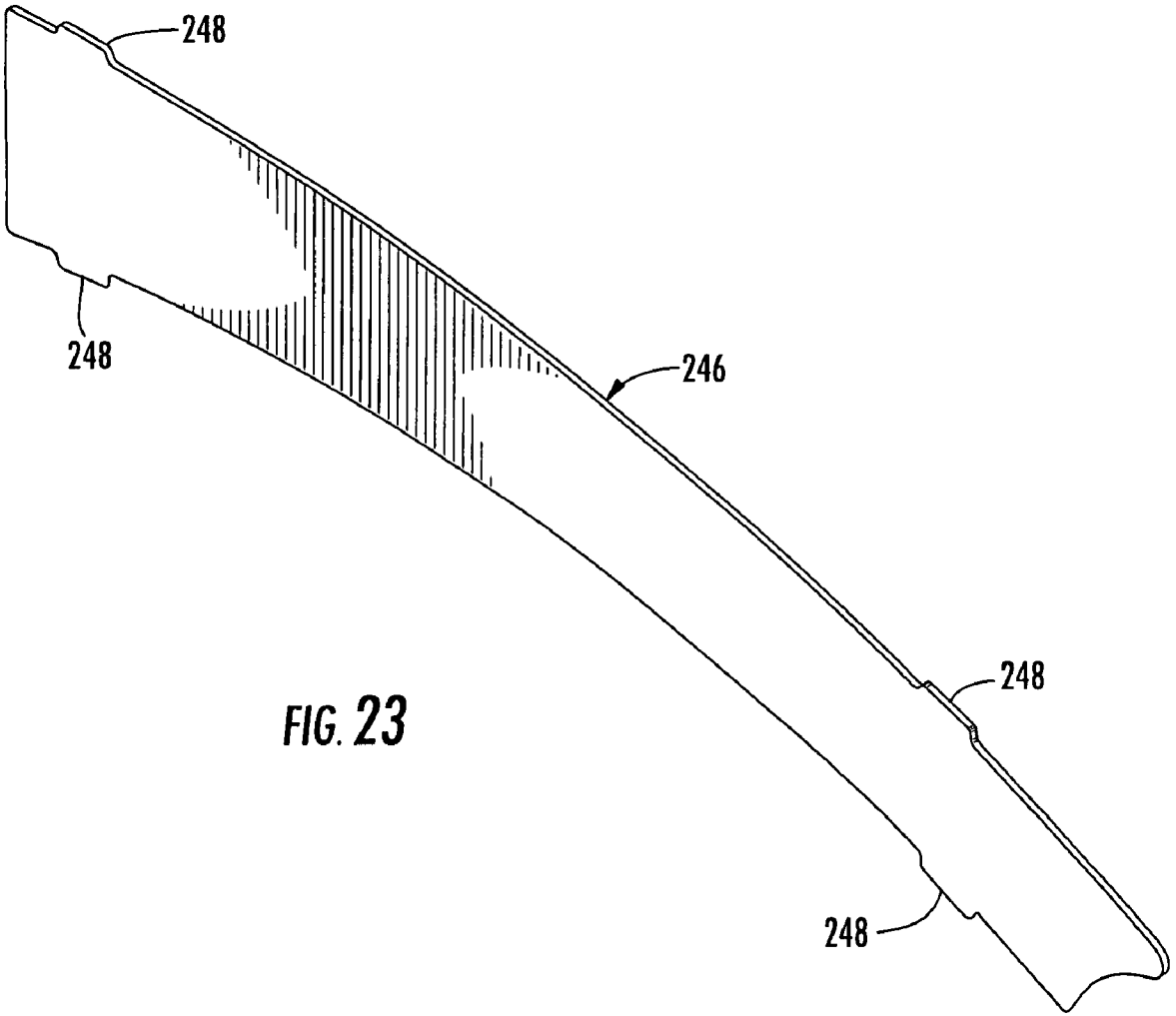
FIG. 23 is a perspective view of a cover for the light bracket.

In order to conceal the wires in bracket 116, as well as to provide a more visually appealing appearance for brackets 116, a cover 246 may be attached to each bracket 116 (FIG. 23). Cover 246 includes a plurality of tabs 248 that may be snap-fit into a plurality of tab apertures 250 defined on bracket 116. Cover 246 is preferably made from a generally flexible material, such as plastic. By pushing cover 246 into bracket 116, cover 246 will flex sufficiently to allow tabs 248 to move into tab apertures 250, where the tabs 248 will return to their unflexed position. Removal of cover 246 is thereafter prevented by the tabs 248 being inserted into tab apertures 250. In order to remove cover 246, it must be sufficiently flexed such that tabs 248 are flexed out of tab apertures 250.

Figure 26:
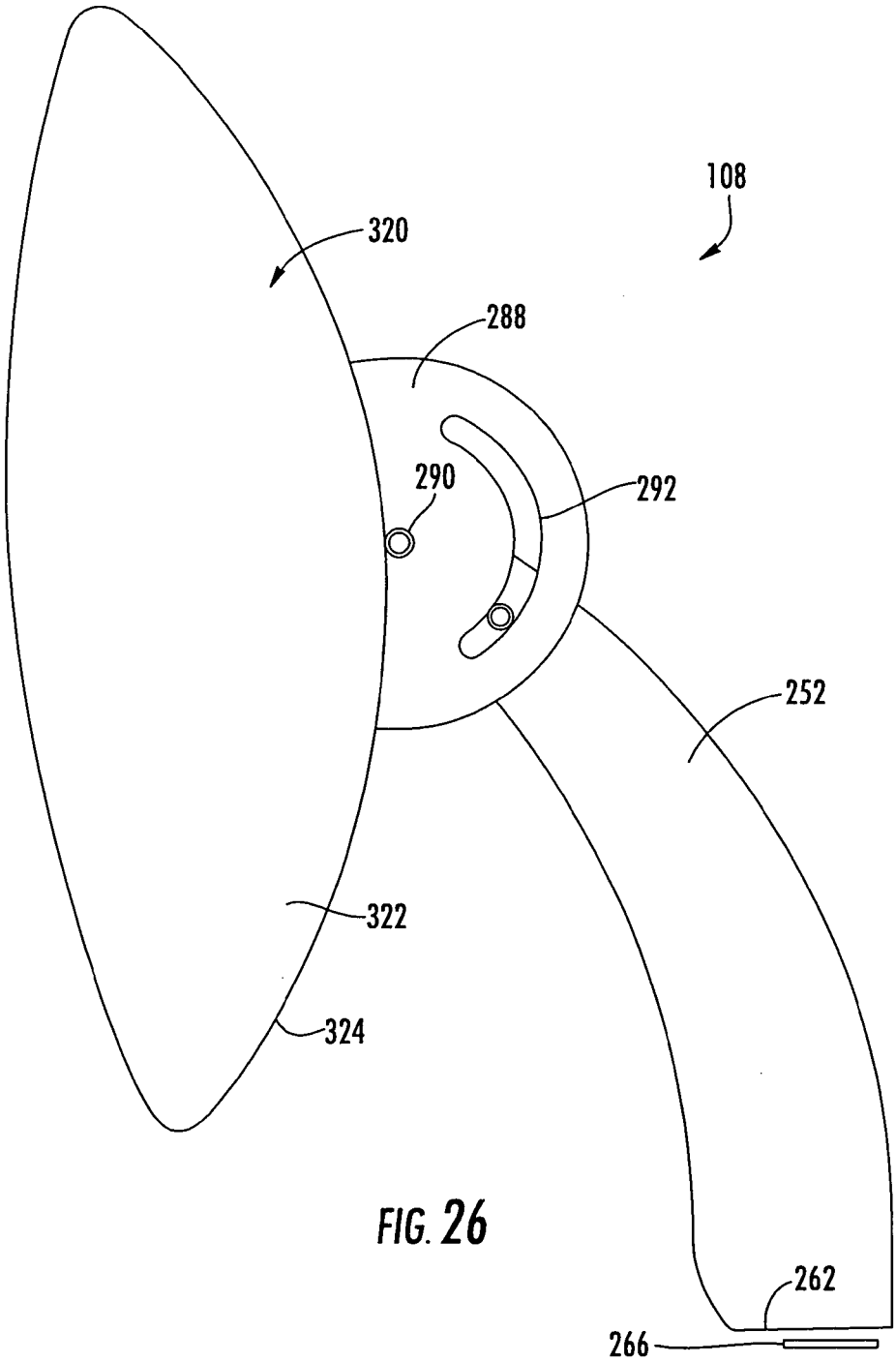
FIG. 26 is a side, elevational view of an illuminated sign and sign bracket.
Figure 27:
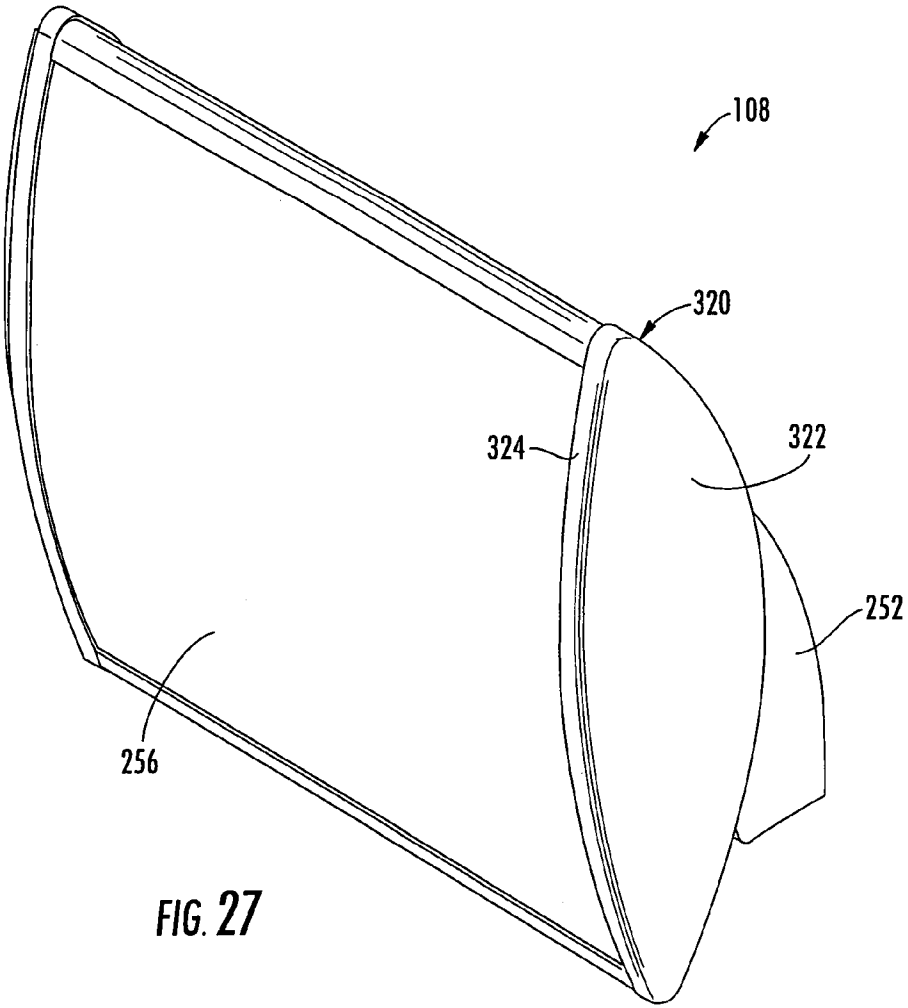
FIG. 27 is a perspective view of the illuminated sign and sign bracket of FIG. 26 illustrated with end covers attached.
Figure 28:
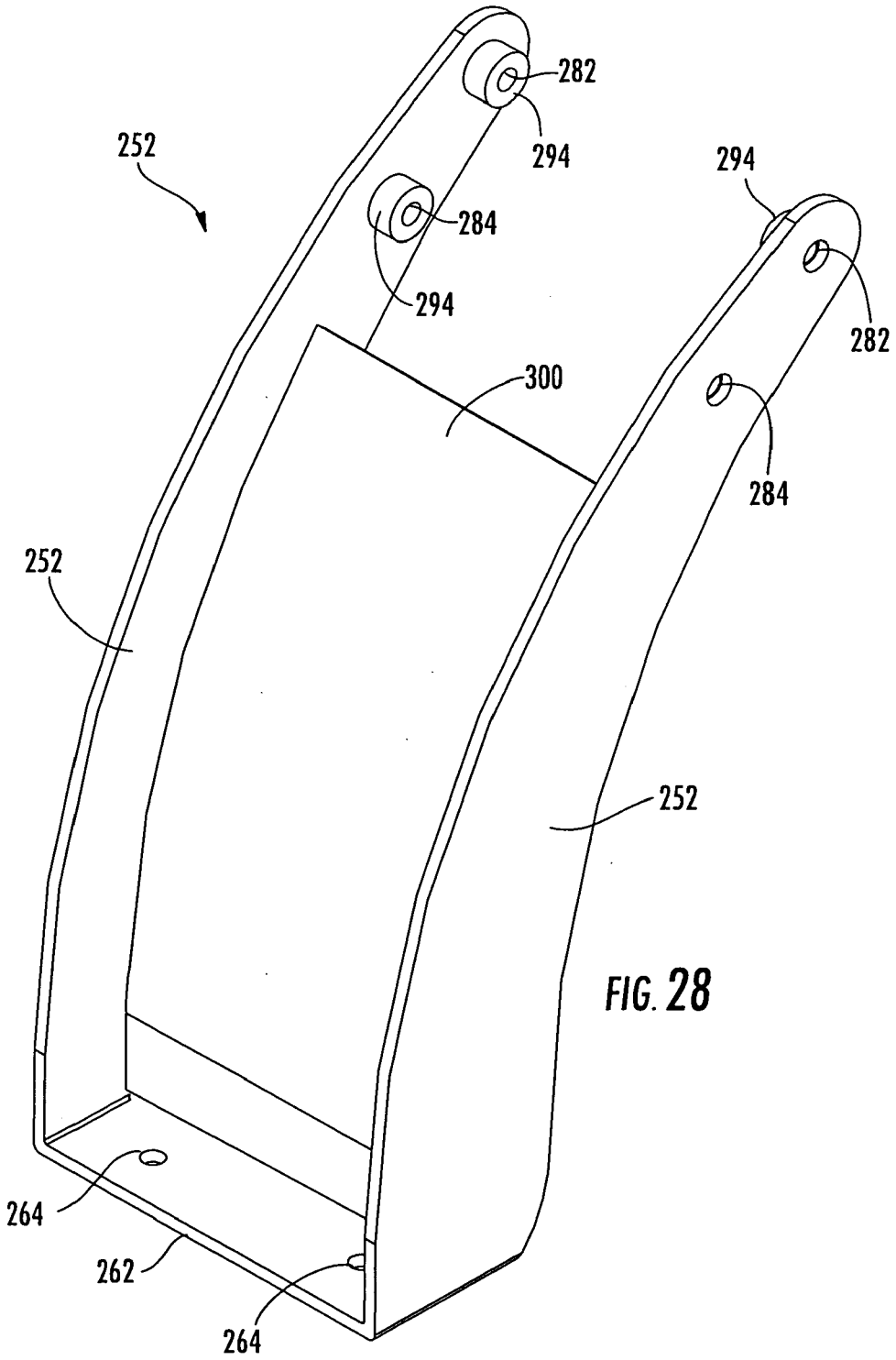
FIG. 28 is a perspective view of the sign bracket.

As illustrated in FIG. 1, display stand 100 includes a plurality of top signs 108. The construction of top signs 108 and their manner of attachment to back wall 118 will now be described. Each top sign 108 includes at least one sign bracket 252, a back wall 254, a graphic display panel 256, and a light panel 258 (FIGS. 26–35). Sign bracket 252 is mounted to the top of back wall 118. More specifically, sign bracket 252 includes a bottom wall 262 having a pair of apertures 264 defined therein (FIG. 28). Each aperture 264 is an unthreaded aperture. A screw is inserted through each aperture 264 into a tap plate 266 positioned underneath bottom wall 262 (FIG. 26). Tap plate 266 is positioned within a top channel 268 defined on the top of top wall extrusion 208 (FIG. 25). Top channel 268 is more specifically defined by a front wall 270 and a back wall 272. Both front wall 270 and back wall 272 include a lip 274. Lips 274 are positioned closer to each other than front wall 270 and back wall 272 are. Thus, the width of top channel 268 between front and back walls 270 and 272 is greater than the width of top channel 268 between lips 274.

Figure 78:
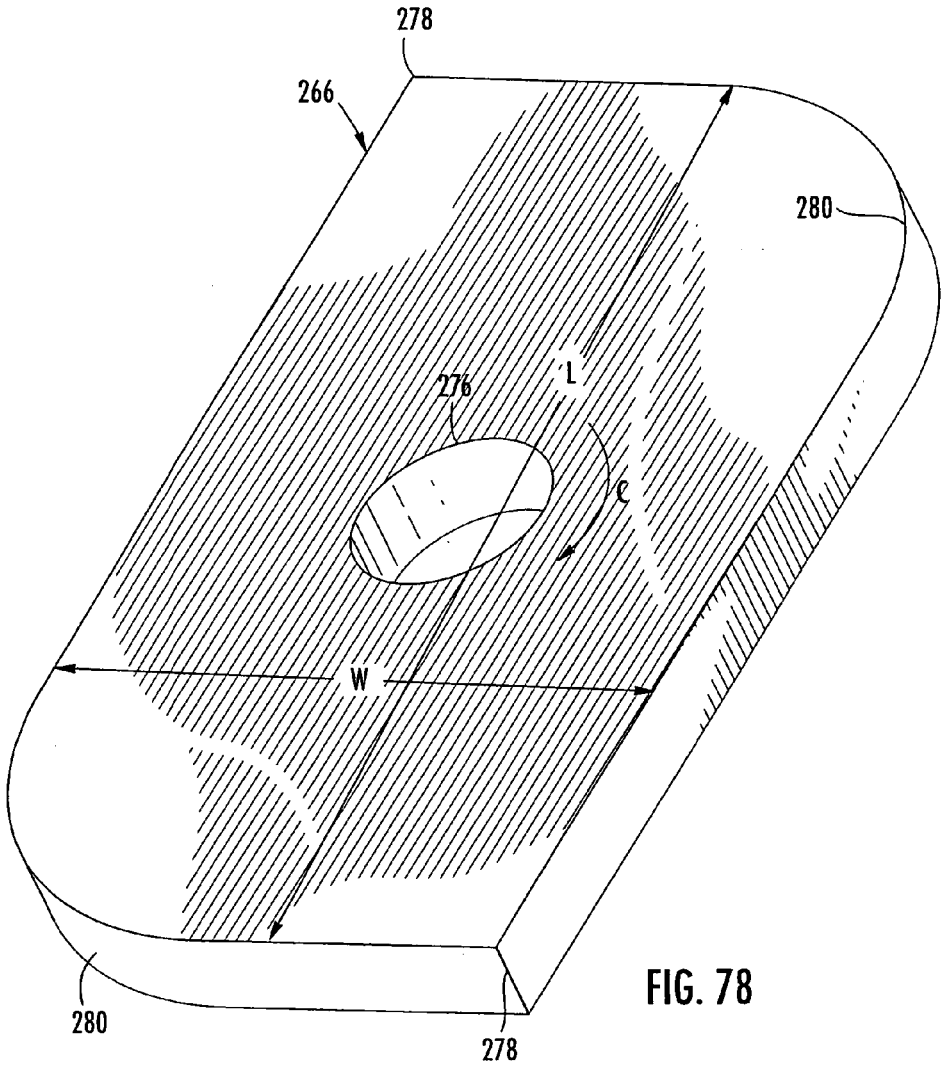
FIG. 78 is a perspective view of a tap plate.

Tap plate 266 preferably has a length that is greater than the distance between lips 274, but slightly less than the distance between front and back walls 270 and 272. The width of tap plate 266 may be less than the distance between lips 274 such that the plate may be dropped into channel 268 when its width dimension is transverse to the length of the channel. Thereafter, the plate is rotated so that its width dimension is aligned with the length of the channel. Alternatively, tap plate 266 can be inserted into top channel 268 from one of the ends of extrusion 208 and then slid to the appropriate side-to-side location along extrusion 208. In either situation, tap plate 266 cannot be removed from top channel 268 by simply lifting it vertically because its length is greater than the distance between adjacent lips 274. Tap plate 266 further includes a threaded aperture 276 defined in its center (FIG. 78). The screws that pass through apertures 264 in the bottom wall 262 of sign bracket 252 also pass through the threaded apertures 276 in tap plate 266. As the screws are tightened, tap plate 266 is moved closer and closer to bottom wall 262 of sign bracket 252. After sufficient rotation of the screws, tap plate 266 comes firmly into contact with lips 274 and tightly squeezes thereagainst. When the screws are fully tightened, lips 274 are sandwiched between the bottom of bottom wall 262 and the top of tap plate 266. This sandwiching secures sign bracket 252 to extrusion 208.

While tap plate 266 may have a rectangular shape, it may also be shaped like that illustrated in FIG. 78. Tap plate 266 in FIG. 75 includes two square corners 278 and two round corners 280. Tap plate 266 includes a width W and a length L. Length L is greater than width W. When a tap plate 266 is to be used to secure sign bracket 252 to extrusion 208, the length L of tap plate 266 should be approximately equal to the distance between front wall 270 and back wall 272. Further, the width W of tap plate 266 should be slightly less than the distance between the lips 274 on front and back walls 270 and 272. Thus, tap plate 266 can be inserted into top channel 268 by rotating it such that its length L is parallel to the longitudinal extent of top channel 268. Once in top channel 268, tap plate 266 is rotated such that its length L is perpendicular to the longitudinal extent of top channel 268. In this position, tap plate 266 cannot be vertically removed from top channel 268 because lips 274 prevent any upward movement of tap plate 266.

The rotation of tap plate 266 after it has been inserted into top channel 268 is permitted by round corners 280. Specifically, round corners 280 allow tap plate 266 to be rotated 90° in the direction C (FIG. 78). Once tap plate 266 has been rotated 90° in this direction, square corners 278 come into contact with front wall 270 and back wall 272. This contact prevents further rotation of tap plate 266. Thus, as the screw through threaded aperture 276 is continually tightened, tap plate 266 is no longer permitted to rotate. The continued rotation of this screw causes tap plate 266 to rise upwardly towards lips 274 until it is firmly in contact with lips 274 and sign bracket 252 is securely held in top channel 268. The attachment of sign bracket 252 can thus be easily carried out by first inserting screws through apertures 264 into a pair of tap plates 266. Tap plates 266 are then rotated until their length L dimension is parallel to the longitudinal extent of top channel 268. They are then inserted into top channel 268 and the screws are tightened. This tightening causes the tap plates 266 to rotate until the square corners 278 come into contact with front and back walls 270 and 272. Further tightening locks sign bracket 252 in top channel 268.

Figure 29:
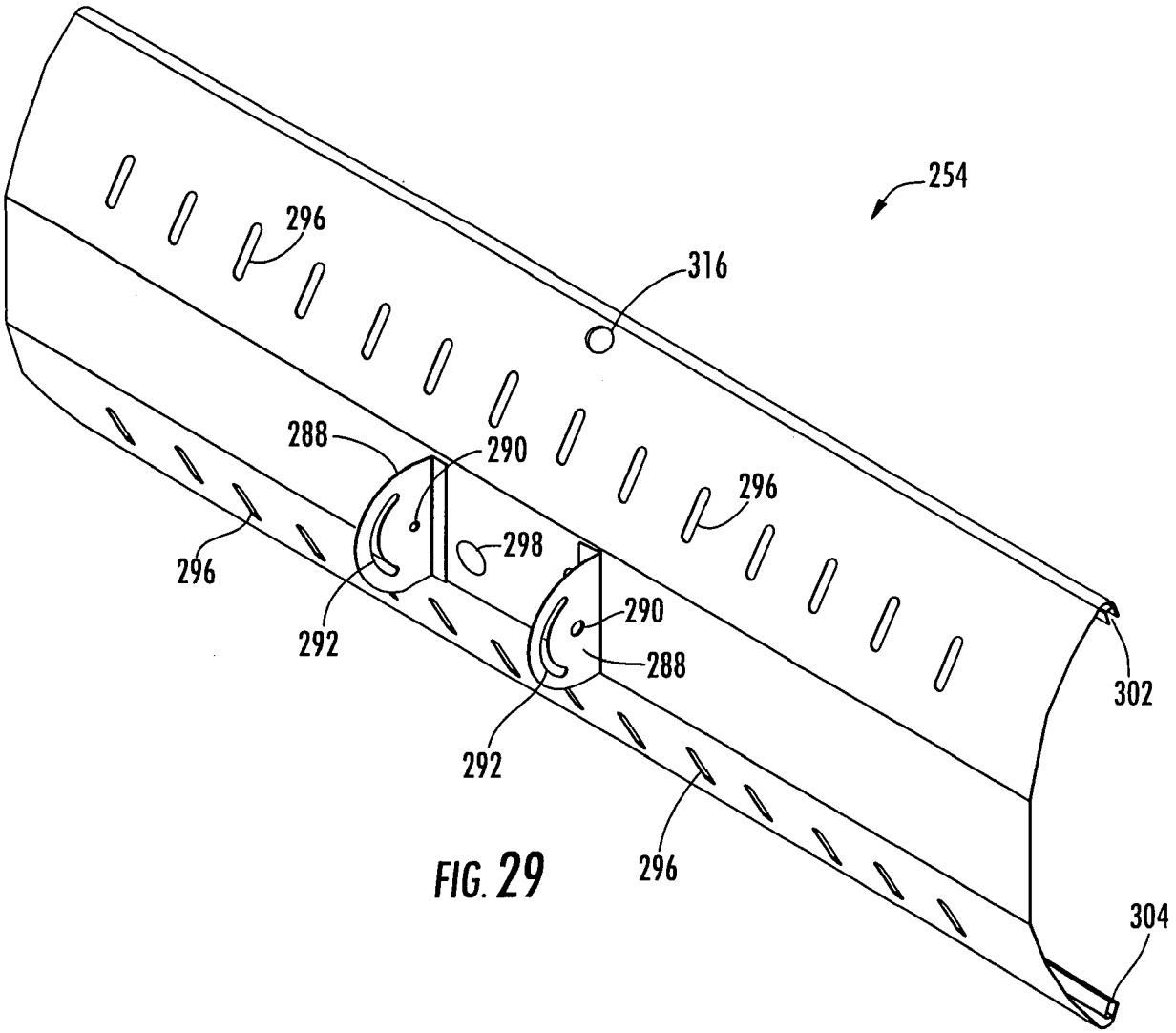
FIG. 29 is a perspective view of a back wall of the illuminated sign.

Sign bracket 252 further includes a pair of upper apertures 282 and a pair of lower apertures 284 (FIG. 28). Upper and lower apertures 282 and 284 are used to secure sign bracket 252 to back wall 254. Upper and lower apertures 282 and 284 are each defined in a pair of spaced apart arms 286. The distance between arms 286 is slightly less than the distance between a pair of flanges 288 defined on back wall 254 (FIG. 29). Flanges 288 thus engage the outside of each of the arms 286. Flanges 288 each include an aperture 290 and a track 292. When back wall 254 is attached to sign bracket 252, the aperture 290 in flanges 288 align with the upper apertures 282. Still further, the lower apertures 284 in sign bracket 252 align with track 292.

A weld nut or clinch nut 294 is affixed to each of the arms 286 adjacent each of the upper and lower apertures 282 and 284 (FIG. 28). These nuts 294 are internally threaded. A thumb screw (not shown), or the like, may be inserted through each of the apertures 290 into each of the upper apertures 282 and into the adjacent nut 294. Likewise, a thumb screw may be inserted through track 292 into lower aperture 284 and into the adjacent nut 294. Thus, four thumb screws, or the like, may be provided. By tightening these thumb screws, back wall 254 is held in place on sign bracket 252.

Track 292 allows the orientation of back wall 254 to pivot with respect to sign bracket 252. This allows the orientation of top sign 108 to be adjusted as desired. In order to adjust this orientation, the thumb screws that are inserted through tracks 292 and lower apertures 284 are loosened. If necessary, the thumb screws through apertures 290 and upper apertures 282 are also loosened. Upon sufficient loosening, back wall 254 will be able to pivot about a horizontal axis that passes through upper apertures 282 and apertures 290. Once back wall 254 has been pivoted to the desired position, the thumb screws that are inserted through tracks 292, lower apertures 284, and the adjacent nuts 294 are tightened. This tightening holds back wall 254 in the desired orientation with respect to sign bracket 252. The thumb screws through apertures 290 and upper apertures 282 may also be tightened for added resistance to unintentional rotation of back wall 254.

Back wall 254 includes a plurality of air vents 296 defined therein (FIG. 29). Air vents 296 allow air to pass through back wall 254 to thereby provide cooling to the lights that may be contained within top sign 108. Back wall 254 further includes a wire aperture 298 defined between flanges 288. Wire aperture 298 receives one or more wires that run into top sign 108 to provide power to the lights contained therein. Preferably, although not necessarily, the one or more wires exiting out of wire aperture 298 passed down bracket 252 between arms 286. A center panel 300 of bracket 252 conceals these wires from view. From the bottom of sign brackets 252, the one or more wires may be connected to a power outlet positioned on an electrical box attached to the back of back wall 118, as will be described in more detail herein.

Figure 30:
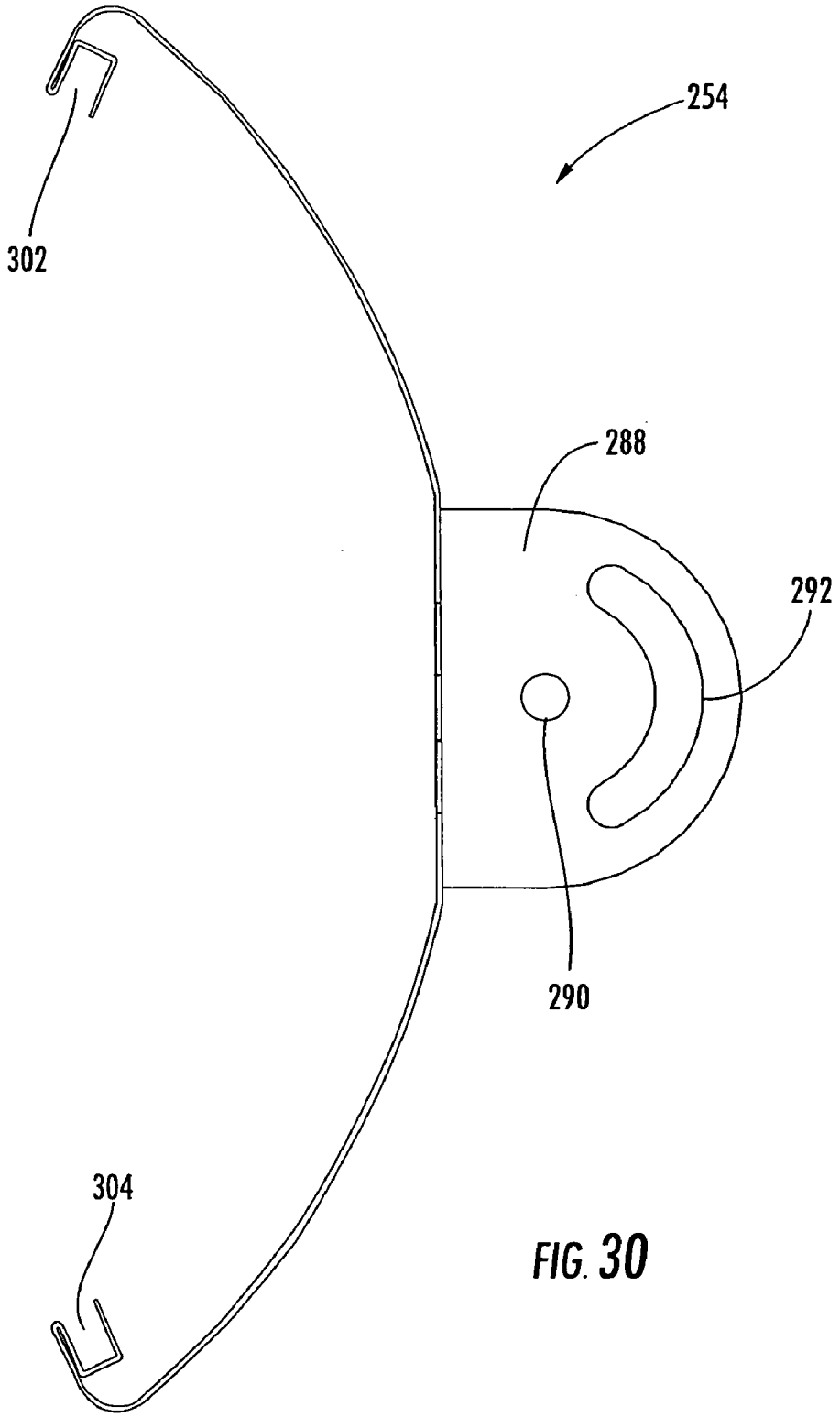
FIG. 30 is a side, elevational view of the back wall of FIG. 29.
Figure 31:
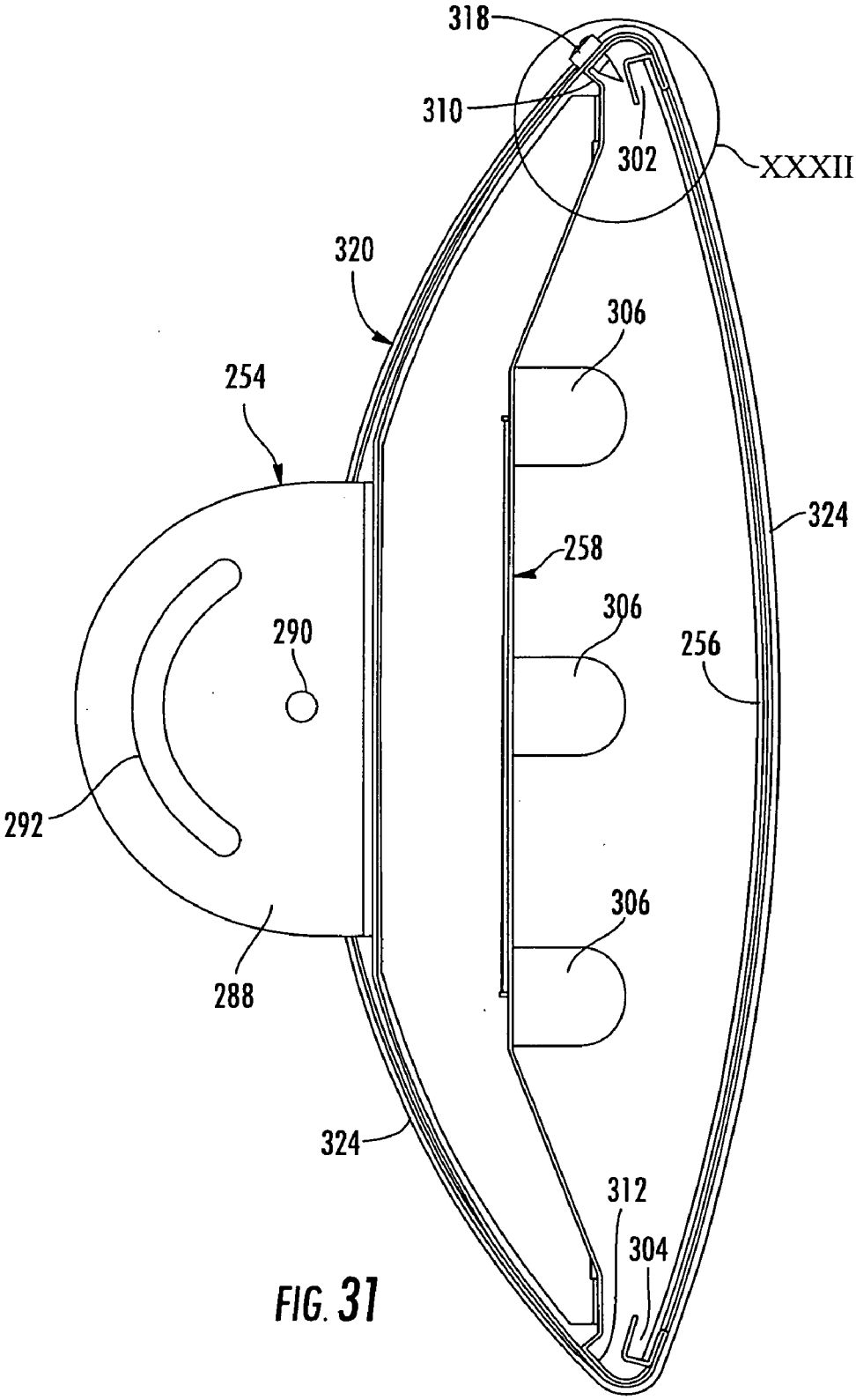
FIG. 31 is a side, elevational view of the illuminated sign shown with the end cover removed.
Figure 32:
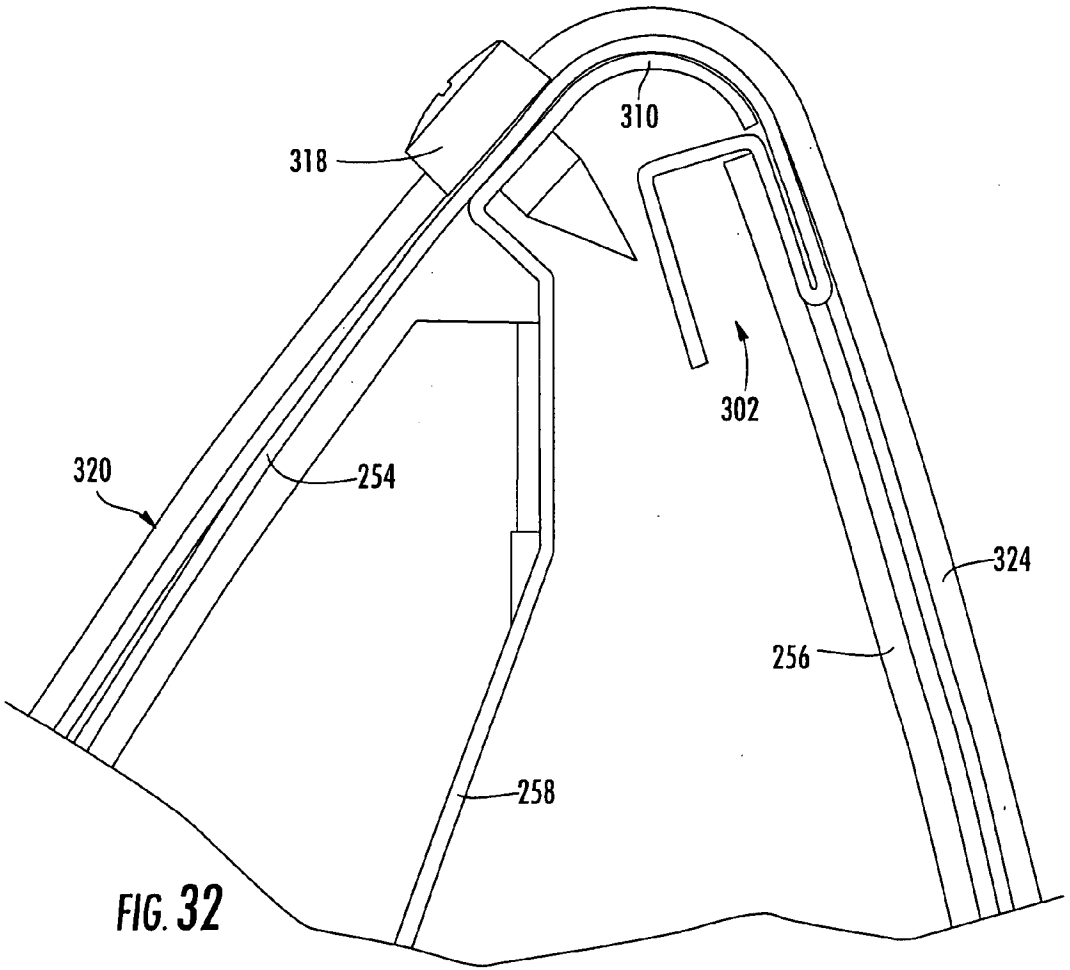
FIG. 32 is a side, partial, elevational view of the area labeled XXXII in FIG. 31.

Back wall 254 of top sign 108 further includes an upper channel 302 and a lower channel 304 (FIGS. 29 and 30). Upper and lower channels 302 and 304 are provided to hold graphic display panel 256. Graphic display panel 256 is a flexible panel that may include advertising, or any other desirable picture, words, symbols, or other indicia. Preferably, graphic display panel 256 is at least partially translucent to allow light from the light bulbs position therebehind on light panel 258 to illuminate it. If display stand 100 is being used to support and display cigarettes and tobacco products, graphic panel 256 may include advertising for the particular brand or brands of cigarette products being displayed. As mentioned above, graphic display panel 256 is preferably made from a flexible material. Graphic display panel 256 is inserted into upper and lower channels 302 and 304 by sufficiently flexing the panel 256 until it fits into these channels. After being positioned in these channels, the display panel 256 returns to its generally unflexed position. Because the distance between upper and lower channels 302 and 304 is less than the height of the unflexed graphic display panel 256, it bows outwardly, as illustrated in FIGS. 27 and 31–32. This bowing of the panel 256 creates sufficient pressure to maintain panel 256 in channels 302 and 304.

Figure 33:
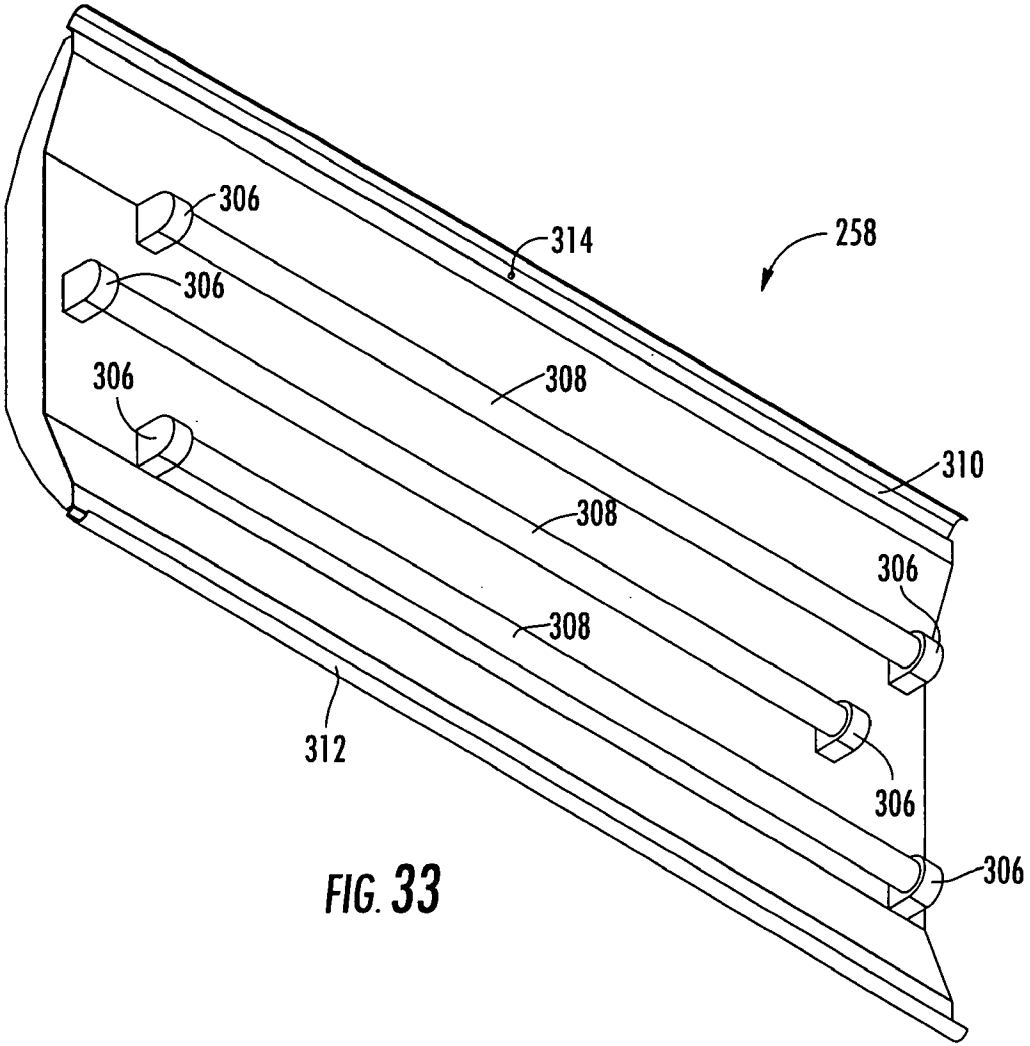
FIG. 33 is a perspective view of a light panel that fits within the illuminated sign of FIG. 26.
Figure 34:
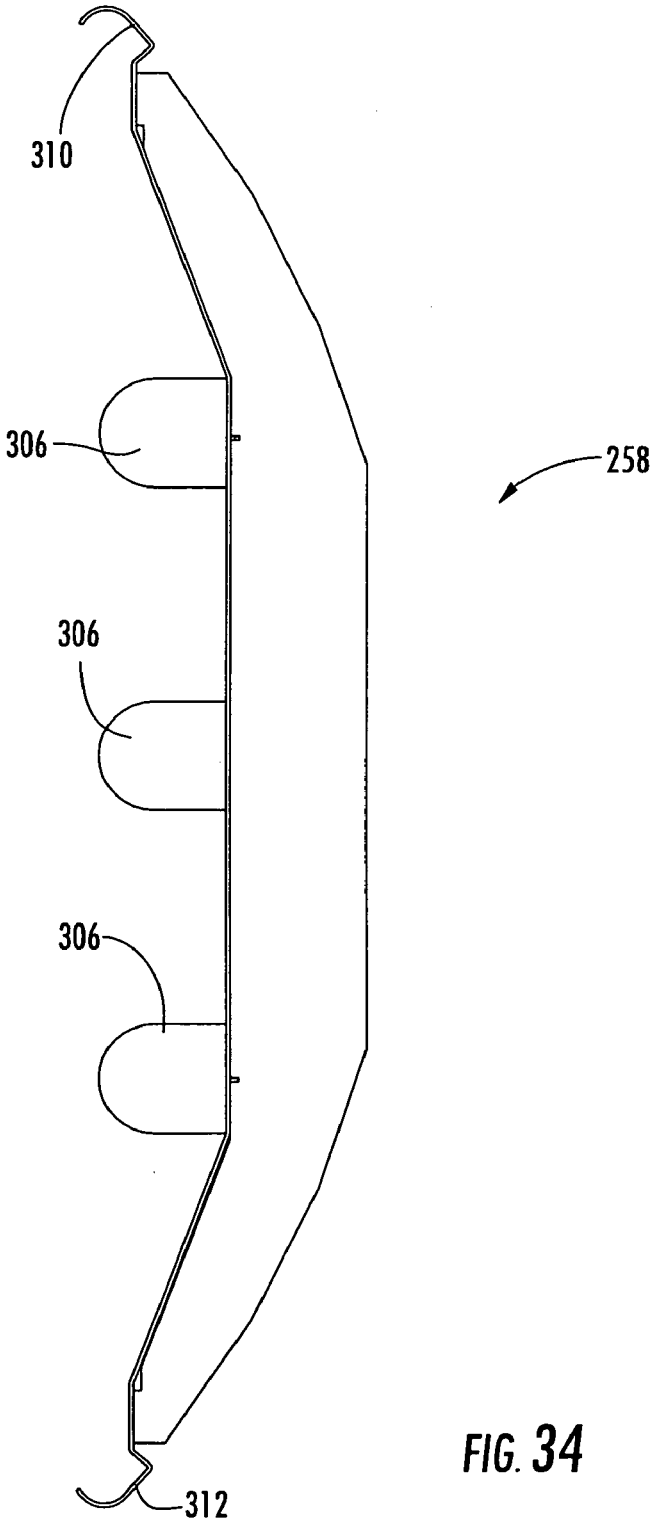
FIG. 34 is a side, elevational view of the light panel of FIG. 33.
Figure 35:
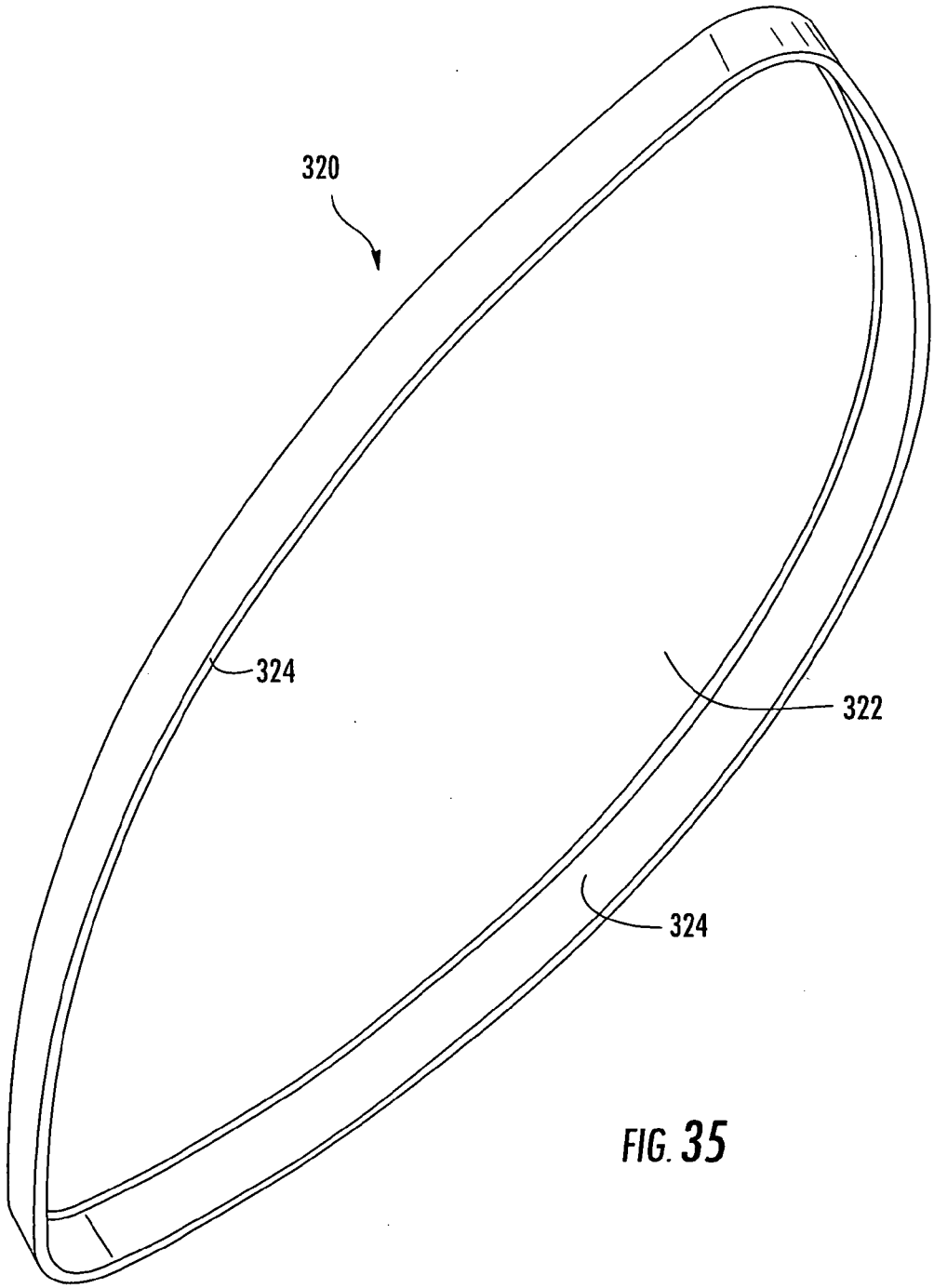
FIG. 35 is a perspective view of the end cover for the illuminated sign.

Light panel 258 includes a plurality of fixtures 306 for holding a plurality of fluorescent light bulbs 308 (FIGS. 33–34). As mentioned previously, light bulbs 308 illuminate the back side of graphic panel 256. Light panel 258 further includes an upper flange 310 and a lower flange 312. A screw hole 314 is defined in upper flange 310 generally midway between the two ends of upper flange 310. Screw hole 314 receives a screw 318 which is used to secure light panel 258 inside of top sign 108 (FIGS. 31–32). Screw 318 is inserted through a screw hole 316 defined in back wall 254 (FIG. 29) and into screw hole 314 defined in light panel 258. The screw hole 314 defined in light panel 258 is threaded, or the screw may be self tapping, such that tightening of the screw 318 causes upper flange 310 to be securely fastened to back wall 254. This is illustrated in more detail in FIG. 32.

Lower flange 312 of light panel 258 rests against the bottom of back wall 258 adjacent lower channel 304, as illustrated in more detail in FIG. 31. This helps hold light panel 258 inside of top sign 108. Ballasts, and any other electrical components that are necessary to operate fluorescent light bulbs 308, may be positioned behind light panel 258 and in front of back wall 254. In order to conceal light panel 258 from view, a cover 320 may be positioned on each end of top sign 108. Cover 320 is illustrated in more detail in FIG. 35. Cover 320 includes a flat body 322 that is surrounded by a peripheral wall 324. Cover 320 may be made out of a flexible material, such as any suitable plastic. Peripheral wall 324 fits over the end of top sign 108 and is suitably dimensioned to be frictionally retained thereon.

As illustrated in FIG. 1, display stand 100 may include one or more top signs 108. In the embodiment of FIG. 1, there are three top signs 108. The two top signs 108 depicted on the ends of display stand 100 each include a single sign bracket 252. The top sign 108 positioned in the middle of display stand 100 includes a plurality of sign brackets 252. More than one sign bracket 252 may be required for a given top sign 108, depending upon the length of the top sign 108. If a user wishes to display an exceptionally long graphic panel 256, he or she may mount two or more top signs 108 next to each other on display stand 100. The top signs 108 that are mounted next to each other have their covers 320 removed, except at the two outermost ends of the collection of top signs 108. A single graphic panel is then inserted into each of these top signs in the upper and lower channels 302 and 304 of the back walls 254. By stringing together a series of top signs 108 in this manner, graphic display panels 256 having any length that are integer multiples of the lengths of top signs 108 may be displayed. FIG. 1 illustrates a graphic display panel in the center of the display stand 100 that stretches across a pair of side-to-side top signs 108 that each have a pair of sign brackets 252. By selectively placing top signs 108 of different lengths on top of display stand 100, as well as combining a single graphic display panel 256 across multiple top signs 108, the user of display stand 100 has a great deal of freedom in configuring the look of material displayed via top signs 108 on display stand 100. Of course, if a user desires to not utilize top signs 108 at all on display stand 100, he or she is free to do so.

Figure 54:
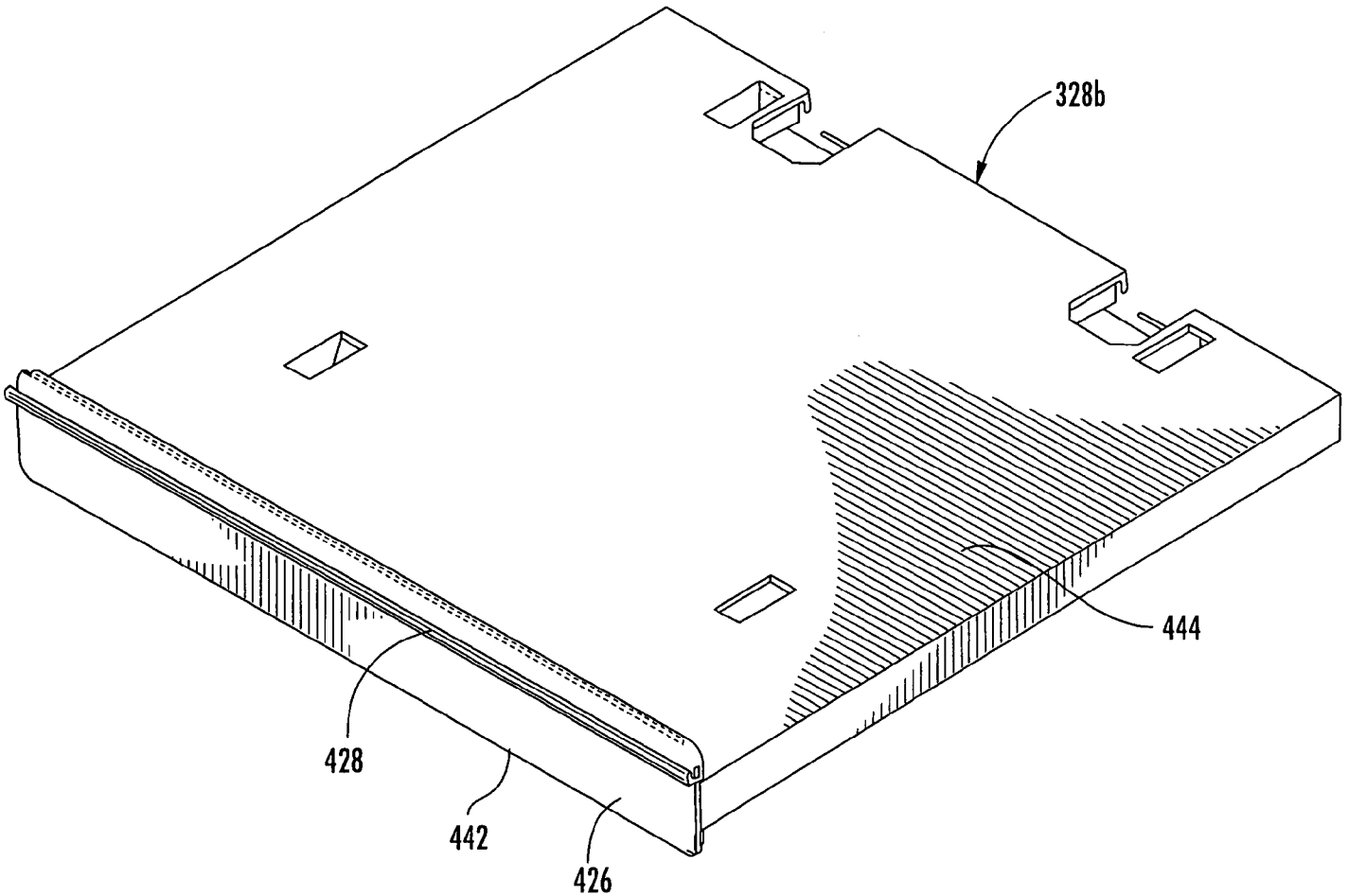
FIG. 54 is a perspective view of an undivided shelf tray.
Figure 55:
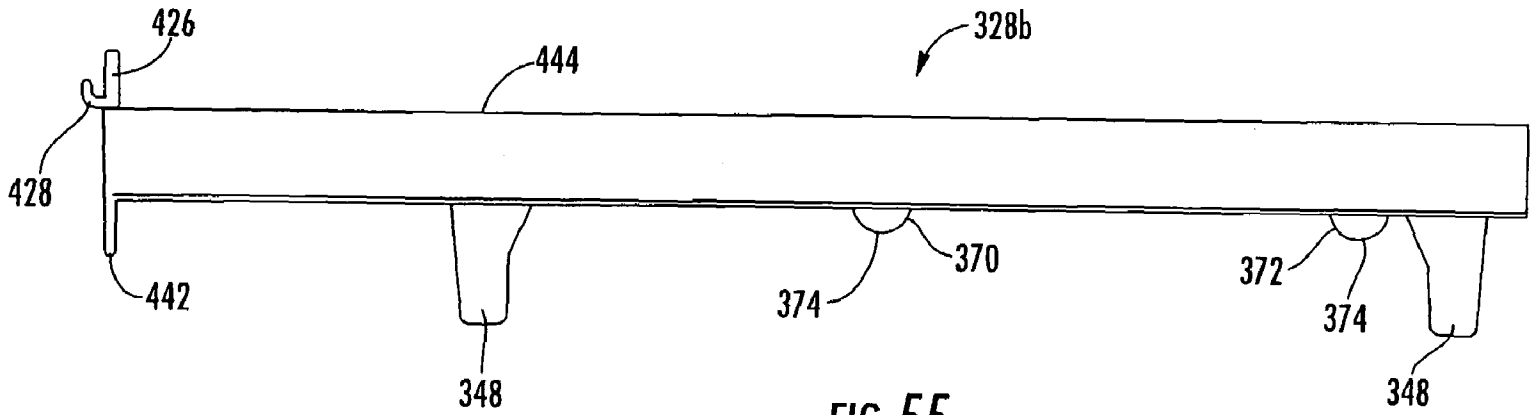
FIG. 55 is a side, elevational view of the shelf tray of FIG. 54.
Figure 56:
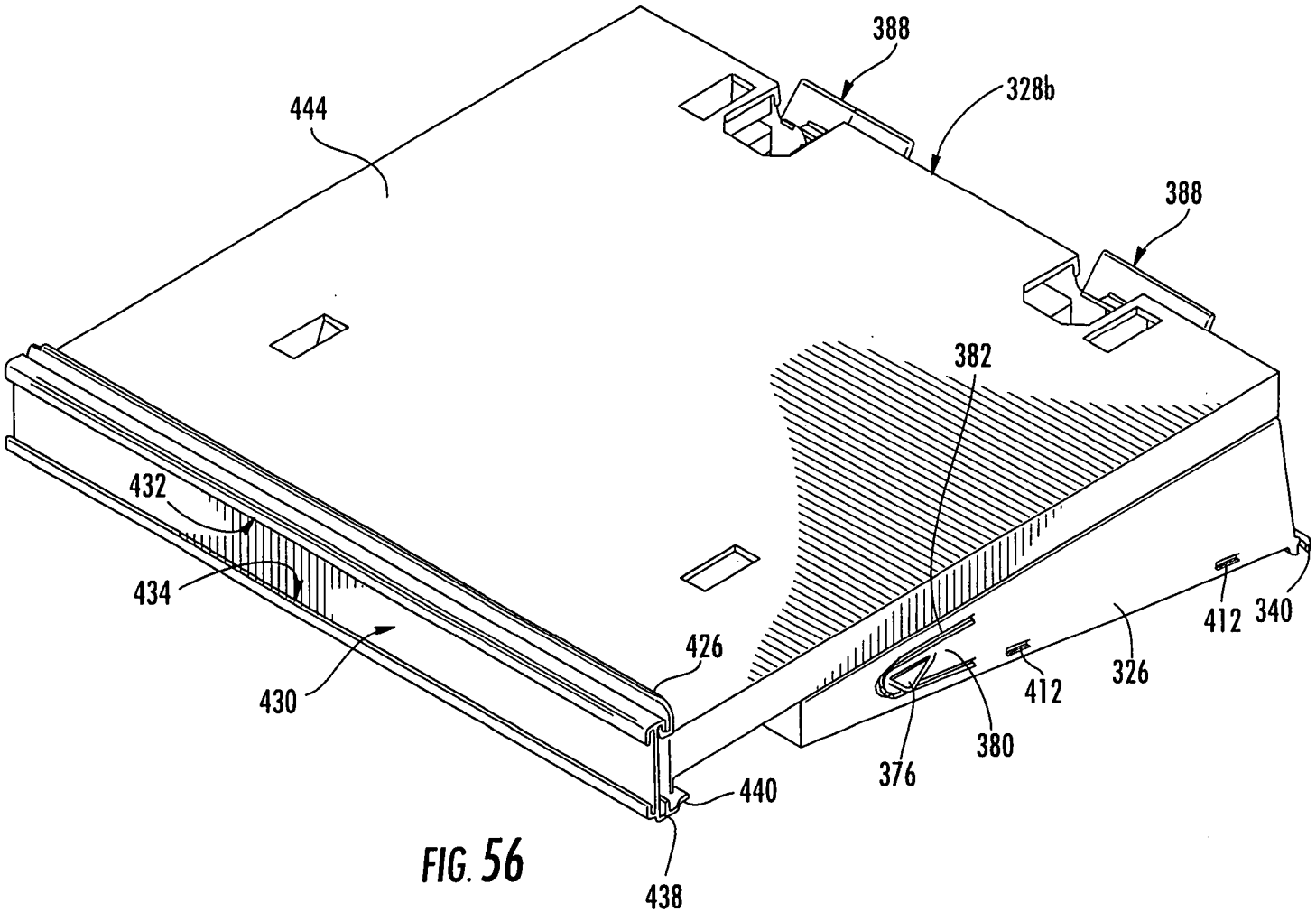
FIG. 56 is a perspective view of the undivided shelf tray shown attached to the shelf base.
Figure 57:
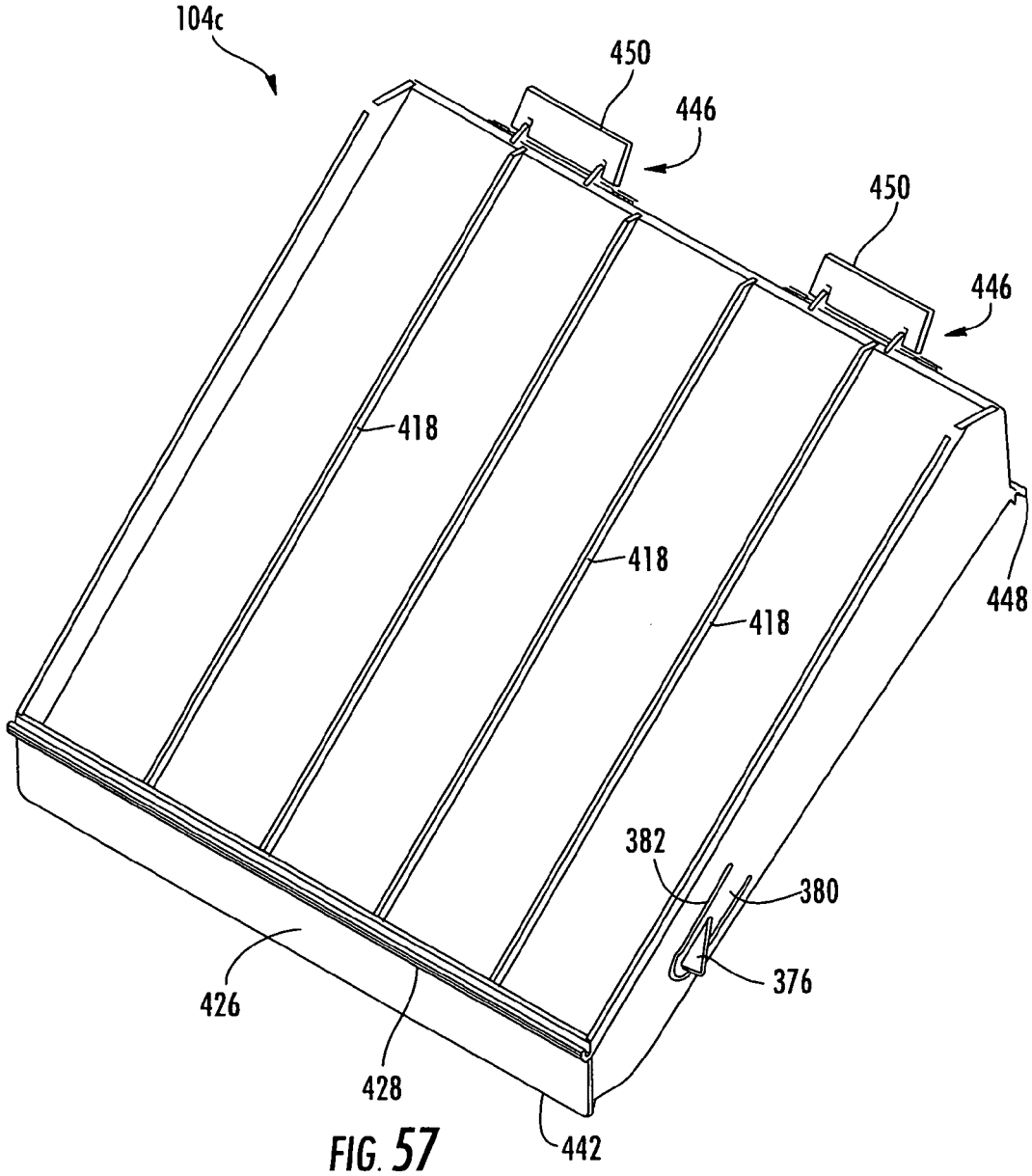
FIG. 57 is a perspective view of a waterfall shelf tray.
Figure 58:
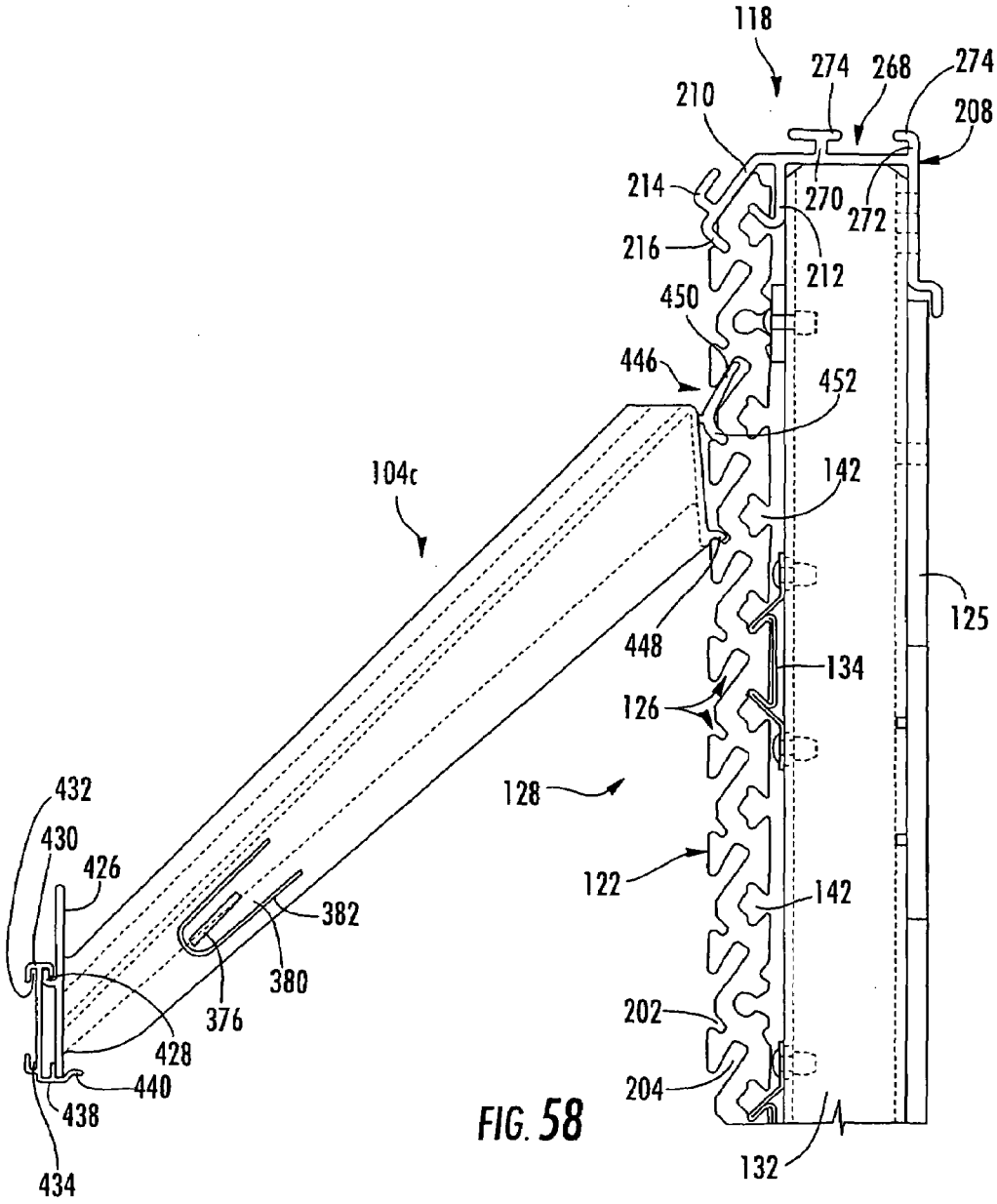
FIG. 58 is a side, partial, elevational view of the waterfall tray shown attached to the slot wall.

FIGS. 36–58 illustrate the various different types of shelves 104, as well as the different components that make up the shelves 104. The present invention contemplates the use of multiple different styles of shelves, as well as different dimensions for each different style of shelf. Three different styles of shelves are depicted in FIGS. 36–58. FIGS. 45–49 illustrate the components of a divided shelf 104*a*. FIGS. 54–56 illustrate the components of an undivided shelf 104*b*. FIGS. 57–58 illustrate a waterfall shelf 104*c*. As mentioned, each of these different styles of shelves can come in various different dimensions. The embodiment of display stand 100 depicted in FIG. 1 includes different size waterfall shelves 104*c* and different sized divided shelves 104*a*. As will be discussed in more detail below, the divided shelves 104*a* include dividers for separating products displayed on the shelves. If display stand 100 is used for displaying cigarette packs, these dividers are preferably spaced apart a distance generally equal to the width of the cigarette packs that are displayed thereon. The dividers thus divide the cigarette packs on the shelf into rows of cigarette packs. The undivided shelves 104*b* do not include dividers for separating products. If these are used to display cigarette products, they may advantageously be used to support cartons of cigarettes, although other uses can be made. The waterfall shelves 104*c* are angled downwardly to a greater extent than the other shelves and may be used to display either cigarette packs, cigarette cartons, or any other type of product that may be desirably displayed on stand 100. The construction and operation of these shelves will be described in more detail below.

Figure 36:
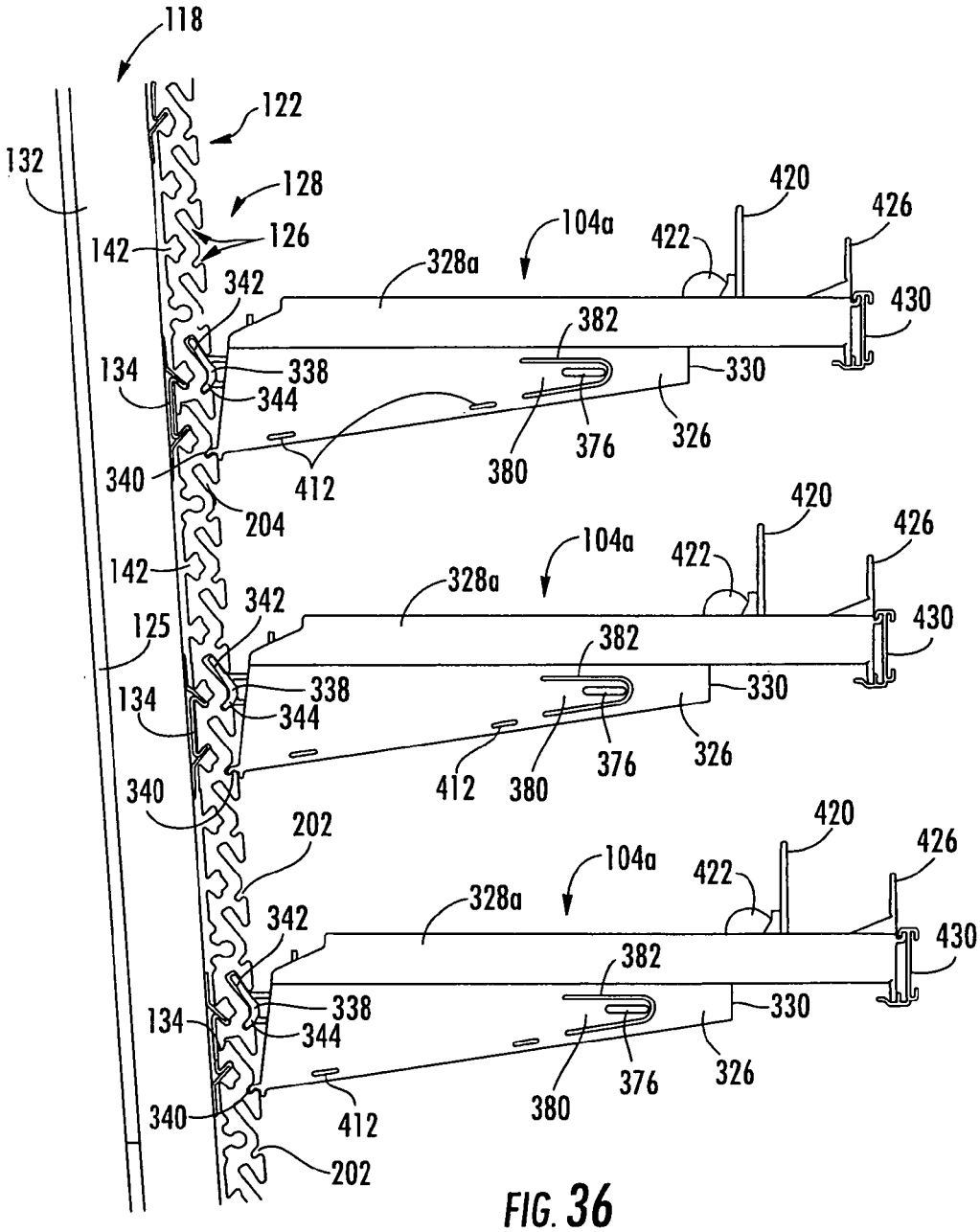
FIG. 36 is a partial, side, elevational view of a plurality of shelves shown attached to the slot wall.

FIG. 36 illustrates three divided shelves 104*a* mounted on slot wall 122. Each divided shelf 104*a* is made up of a shelf base 326 and a shelf tray 328. The shelf base 326 is mounted onto the slot wall 122 and the shelf tray 328 is mounted onto the shelf base 326. In the illustrated embodiment, shelf trays 328 are slidably mounted on shelf bases 326. This permits the shelf trays 328 to be extended forwardly on shelf bases 326. This facilitates access to the contents being supported on the shelves 104. After sliding one of the shelf trays 328 forward, the products on the shelf tray 328 can be more easily removed, or restocked. As will be discussed in more detail below, each shelf tray 328 is snap-fittingly attached to a shelf base 326. Shelf bases 326 are used to support both divided shelf trays 328*a* and undivided shelf trays 328*b*. The shelf bases 326 used to support undivided shelf trays 328*b* are the same as the shelf bases 326 used to support divided shelf trays 328*a*. Thus, a user of display stand 100 can interchange undivided shelf trays and divided shelf trays on a given shelf base 326. The manner in which these shelf trays can be interchanged will be described more below.

Figure 37:
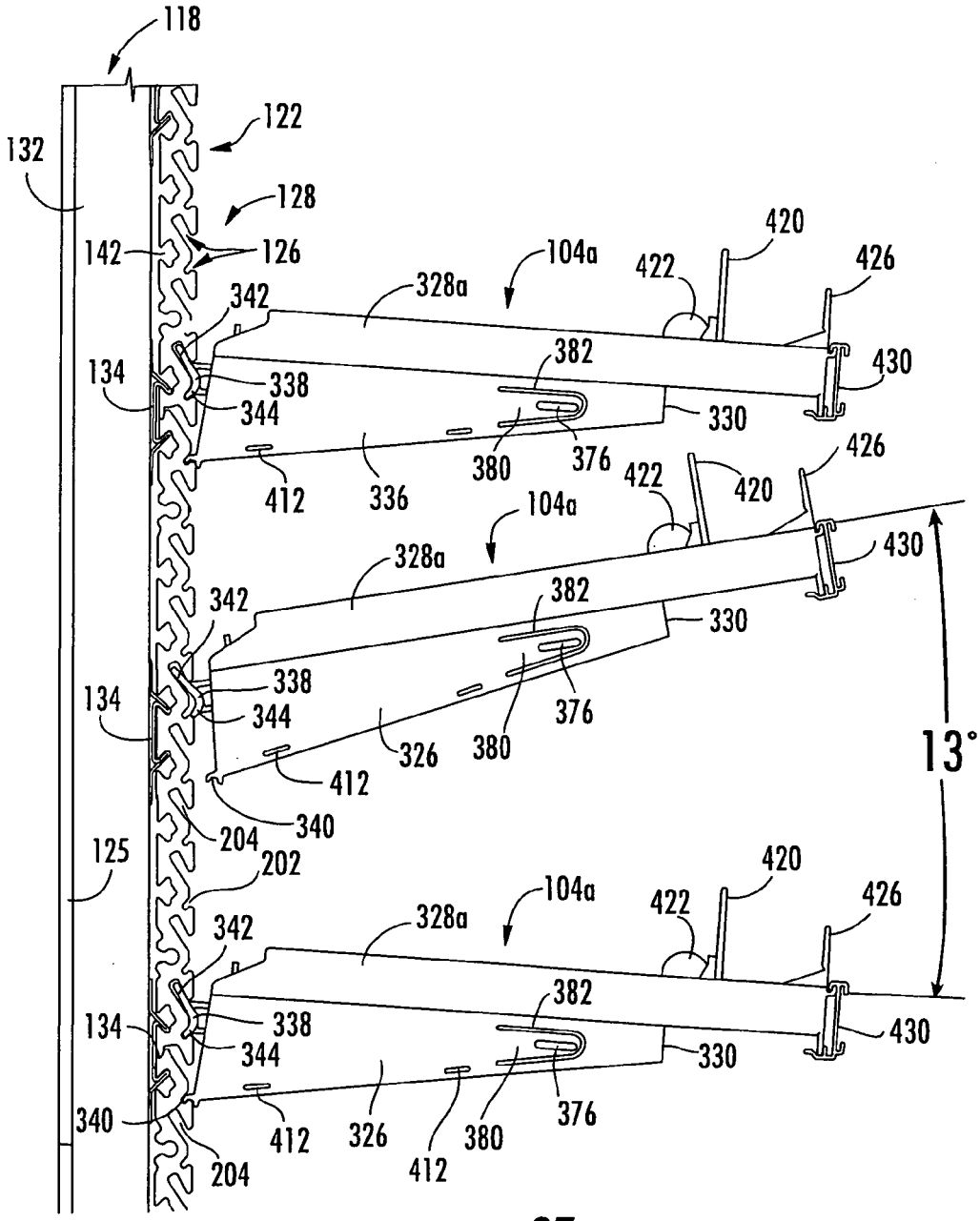
FIG. 37 is a partial, side, elevational view of the shelves of FIG. 36 illustrated with a middle shelf tipped upward to a slot wall removal position.
Figure 39:
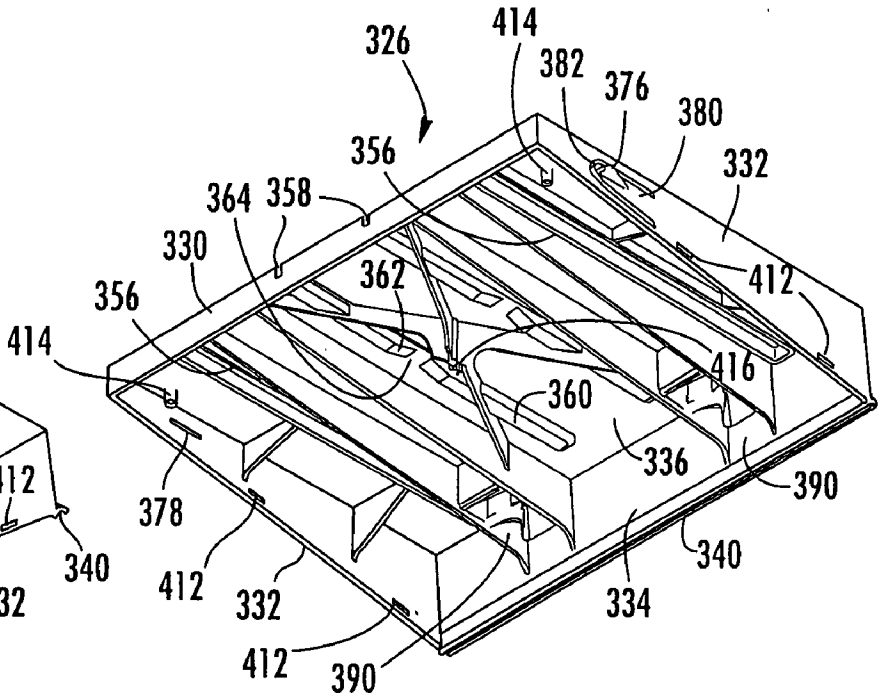
FIG. 39 is a perspective view of the under side of the shelf base.
Figure 38:
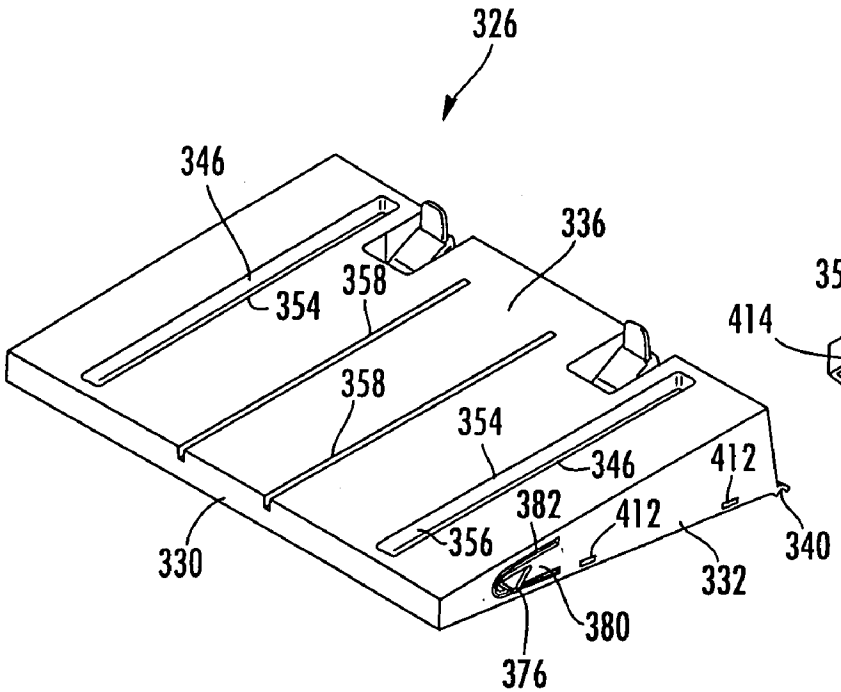
FIG. 38 is a perspective view of the top of a shelf base.
Figure 40:
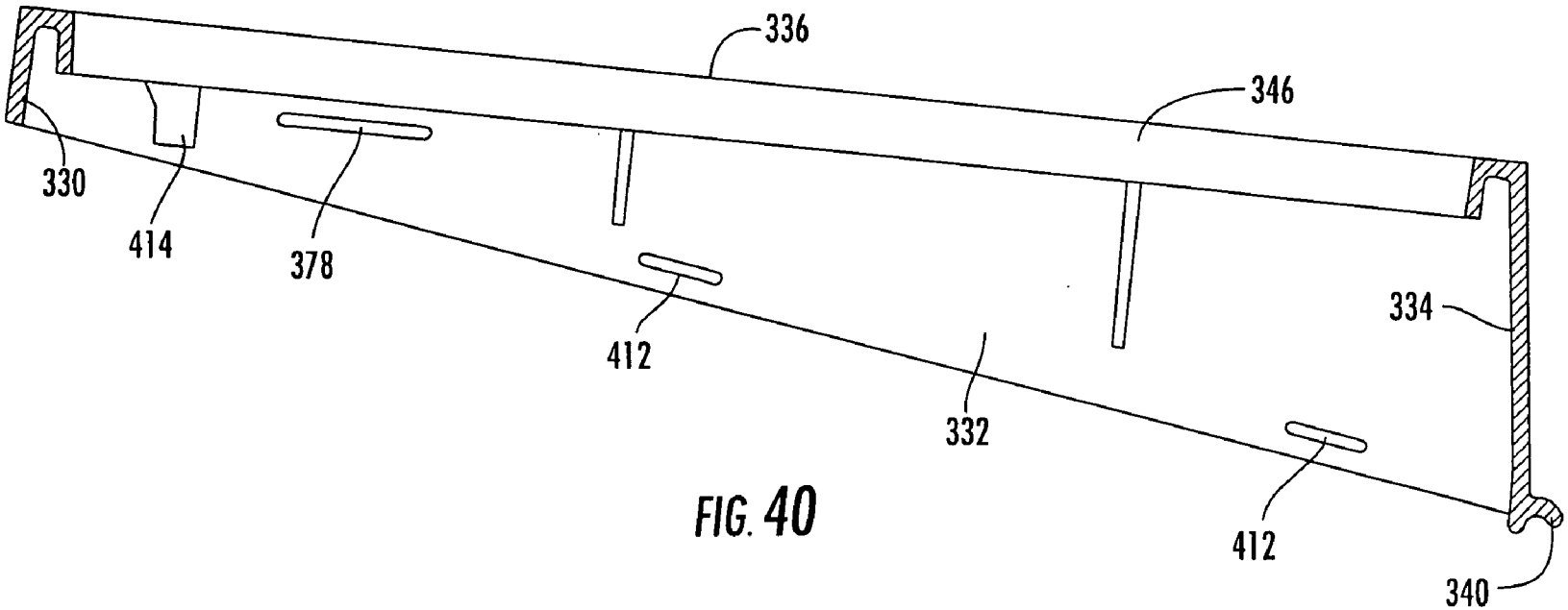
FIG. 40 is a sectional view of the shelf base taken along the line XL—XL in FIG. 42.

Shelf bases 326 are illustrated in FIGS. 36–43. Each shelf base 326 includes a front wall 330, a pair of side walls 332, and a rear wall 334 (FIGS. 38–39). Front wall 330, side walls 332, and rear wall 334 all extend downwardly from the periphery of a top wall 336. Shelf trays 328 are supported on the top wall 336. A lower insert 340 extends rearwardly from rear wall 334 of shelf base 326. Lower insert 340 is dimensioned to fit within one of the small slots 202 defined in the front face of slot wall 122. A shelf bracket 388, which helps support base 326 on slot wall 122, includes an upper insert 338 having an upper arm 342 and a lower arm 344. Upper arm 342 is dimensioned to fit within one of the large slots 204 defined in the front face of slot wall 122. Lower arm 344 is dimensioned to fit into the small slot 202 positioned immediately underneath the large slot 204 into which upper arm 342 is inserted. The insertion of upper arm 342 and lower arm 344 into slot wall 122, as well as the insertion of lower insert 340 into slot wall 122, secures the shelf base 326 on slot wall 122.

In order to remove a shelf base 326 (and any shelf tray positioned thereon), the shelf base 326 has its forward end lifted upwardly. This is illustrated in FIG. 37. Because of the shapes of small and large slots 202 and 204 in slot wall 122, as well as the shapes of inserts 338 and 340, the shelf base need only be lifted upwardly approximately 13° to allow it to be removed from slot wall 122. This allows a single shelf to be removed from slot wall 122 without having to remove an immediately adjacent shelf positioned thereabove. Thus, shelves may be vertically spaced together more closely than in the past. In prior display stands, the removal of a single shelf typically required a prior removal of all of the shelves positioned above it. This was due to the fact that the shelves had to be pivoted upwardly to a much greater extent. This upward pivoting could only be accomplished if the shelf immediately above the shelf being removed was also removed. Thus, unless the shelf that was desired to be removed happened to be at the very top of the display stand, the shelf could not be removed without removing a number of other shelves that were positioned above the shelf. The present invention, however, overcomes this problem by allowing shelves to be removed with a relatively small amount of upward rotation of the shelf, such as 13°. Other amounts of rotation are also contemplated by the present invention, such as any amounts that are 30° or less.

Figure 42:
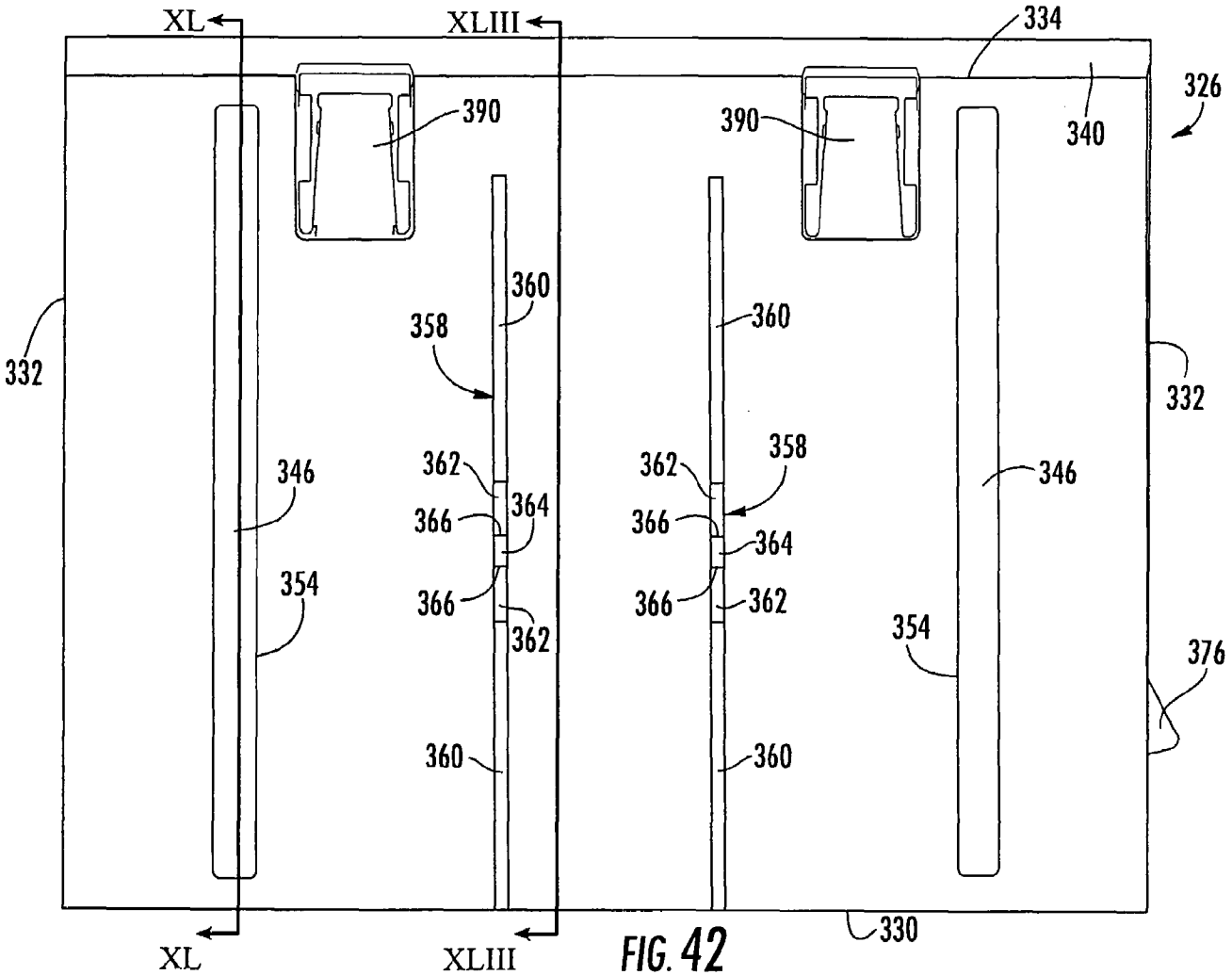
FIG. 42 is a plan view of the shelf base.

Each shelf base 326 includes a pair of elongated outer tracks 346 defined in top wall 336 (FIGS. 38–39 and 42). Outer tracks 336 are spaced apart from each other in a generally parallel orientation and positioned near each side wall 332. Tracks 346 provide the structure by which a shelf tray 328 may be slidingly attached to shelf base 326. More particularly, each shelf tray 328 includes a plurality of prongs 348 positioned on the underside of the shelf tray (e.g. FIGS. 46–47). A horizontal wall 350 is defined at the bottom end of each prong 348. A cam surface 352 is defined below each horizontal wall 350 and positioned adjacent the horizontal wall 350 (FIG. 47). In the shelf tray 328 of FIGS. 46 and 47, there are four prongs 348. Two of these prongs 348 fit into one of the outer tracks 346 and another two of the prongs 348 fit into the other of the outer tracks 346 defined in shelf base 326.

The distance D between the ends of horizontal walls 350 (FIG. 47) is preferably slightly less than the distance between outer tracks 346. Thus, when a shelf tray 328 is positioned on top of shelf base 326 and pushed downwardly, cam surfaces 352 engage inner edges 354 of tracks 346. As further downward pressure is applied on shelf tray 328, the contact of inner edges 354 against angled cam surfaces 352 causes prongs 348 on opposite sides of shelf tray 328 to flex outwardly from each other. This outward flexing continues until horizontal wall 350 has been pushed completely through tracks 346. Once completely through, each prong 348 snaps back to its unflexed condition. Removal of shelf tray 328 from shelf base 326 is thereafter prevented by horizontal wall 350 contacting the underside of inner side walls 356 that partially define tracks 346 (FIG. 39). In order to remove shelf tray 328 from shelf base 326, a user must reach under shelf base 326 and manually flex prongs 348 away from each other such that horizontal walls 350 can be flexed past inner side walls 356. Once they have been flexed past inner side walls 356, the entire shelf tray 328 can be lifted out of shelf base 326.

Shelf base 326 further includes a pair of inner tracks 358 defined in top wall 336 (FIGS. 38–39 and 42). Inner tracks 358 are oriented generally parallel to each other and are positioned further inwardly from side walls 332 than outer tracks 346. Inner tracks 358 are also narrower than outer tracks 346. Inner tracks 358 are used to maintain shelf tray 328 in either its retracted or extended position, as will be described herein. While shelf tray 328 is slidable inwardly and outwardly along shelf base 326, it is generally desirable to maintain shelf tray 328 in either of two different positions. These two different positions comprise the fully retracted position and the fully extended position. Shelf tray 328 and shelf base 326 are constructed such that shelf tray 328 tends to remain in either one of these conditions. In order to move shelf tray 328 from one of these positions to the other position, or an intermediate position, an additional force must be applied to shelf tray 328 to overcome a retention force that tends to retain the shelf tray 328 in either the extended or retracted position. The manner in which this retention force is created will now be described.

Figure 43:
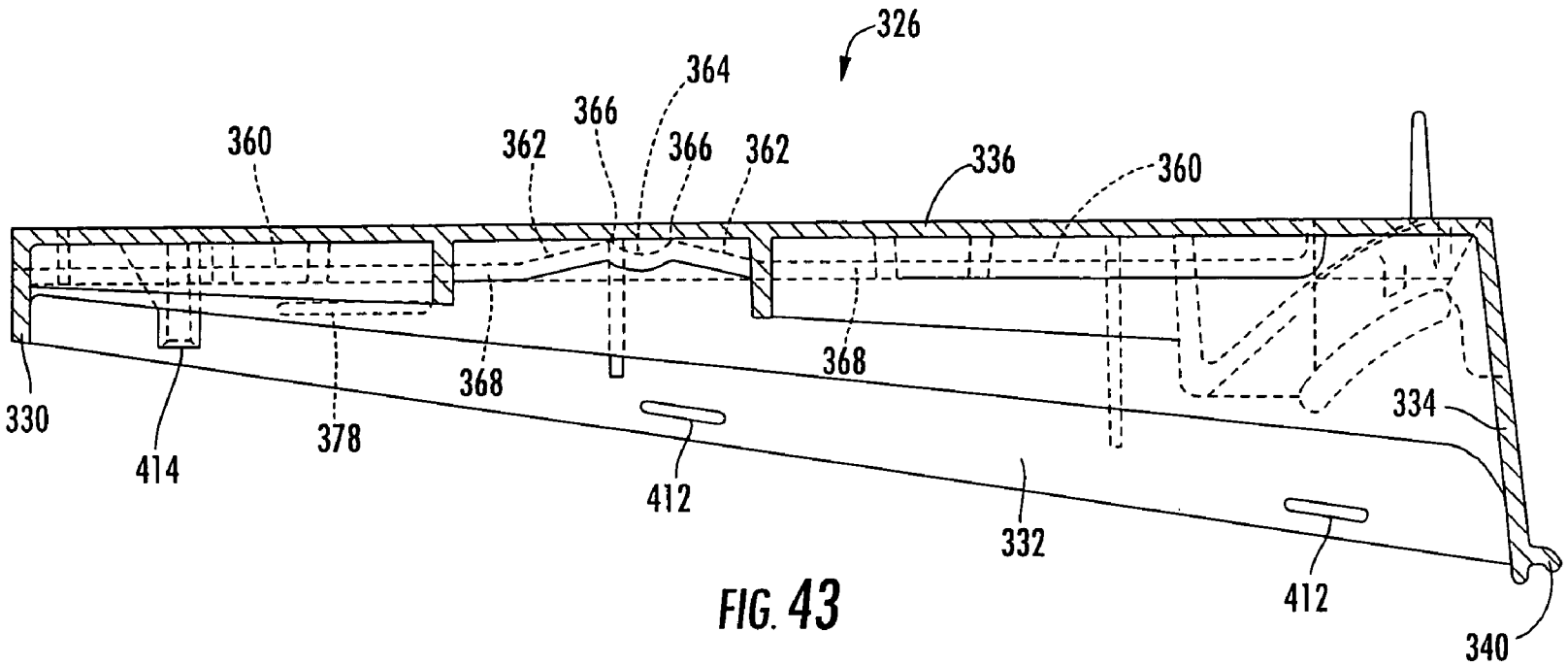
FIG. 43 is a sectional view of the shelf base taken along the line XLIII—XLIII in FIG. 42.

As can be seen in FIGS. 42 and 43, each inner track 358 is divided into a plurality of segments. These segments include flat sections 360, sloping sections 362, and a locking section 364. The depth of inner tracks 358 in these different sections varies. In flat section 360, the depth is the greatest and is constant throughout the entire length of sections 360. In sloping sections 362, the depth changes. At the junctions of sloping sections 362 with flat sections 360, the depth of sloping sections 362 is equal to the depth of flat sections 360. Moving inwardly from this junction towards locking section 364, the depth of sloping sections 362 decreases. A pair of locking edges 366 are defined at the junction of sloping sections 362 and locking section 364. The depth of inner tracks 358 at locking edges 366 is at its shallowest. In locking section 364, the depth of inner tracks 358 increases beyond that defined at locking edges 366. As can be seen more clearly in FIG. 43, a bottom wall 368 defines the depth of each section 360–364. Bottom wall 368 is curved in locking section 364 and angled in sloping sections 362. The depth of inner tracks 358 in locking section 364 is greatest in the center of locking section 364 due to the curvature of the bottom wall 368 therein.

Figure 46:
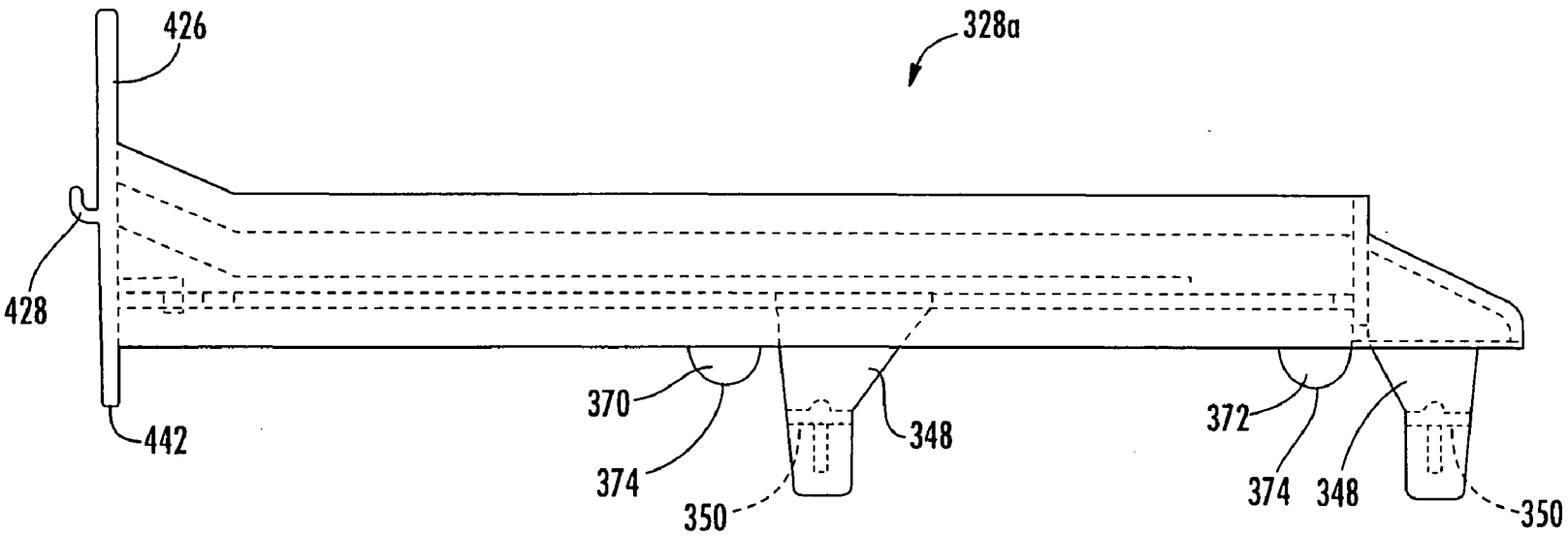
FIG. 46 is a side, elevational view of the divided shelf tray of FIG. 45.
Figure 47:
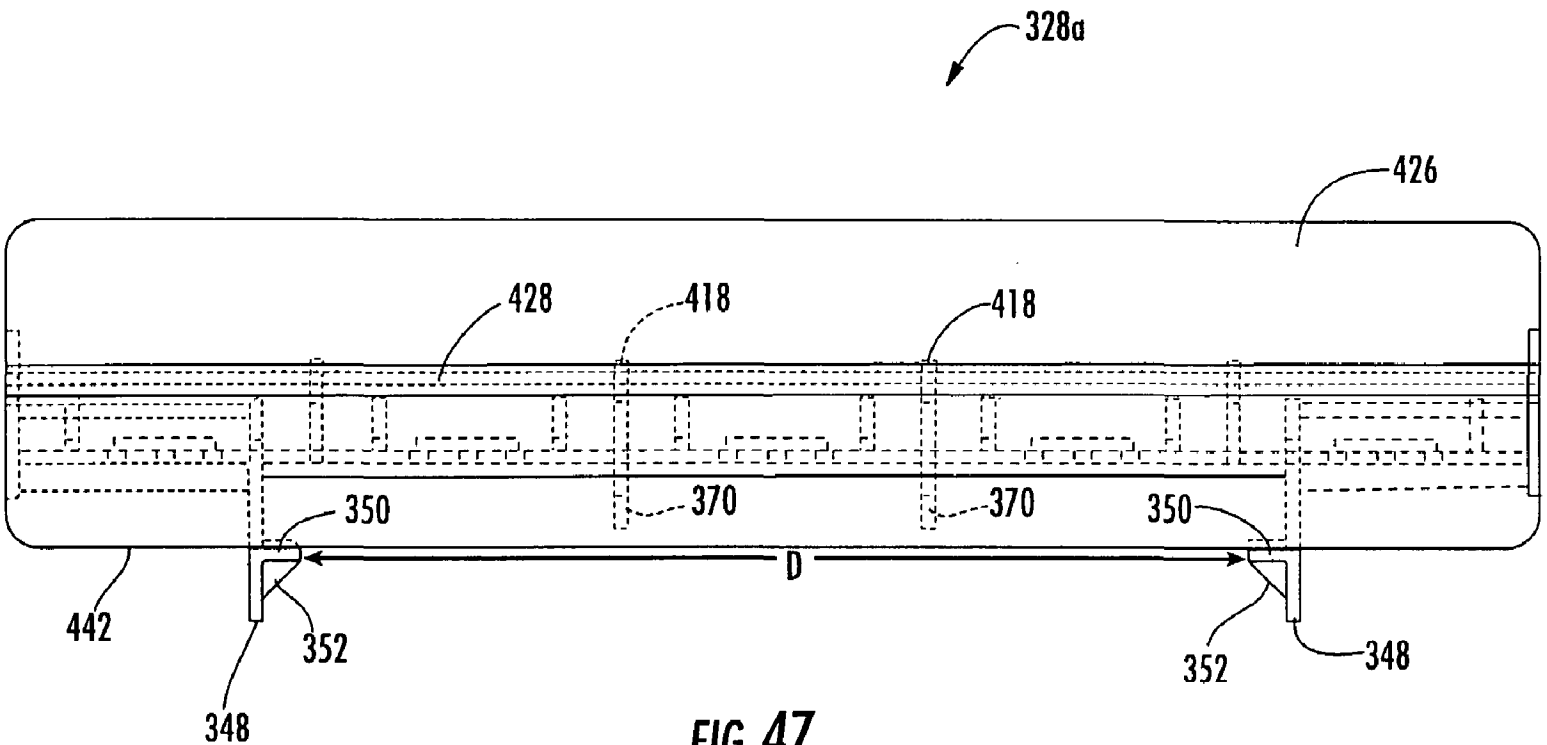
FIG. 47 is a front, elevational view of the shelf tray of FIG. 45.

Each inner track 358 receives a front rounded projection 370 and a rear rounded projection 372 defined on the bottom of shelf trays 328 (FIGS. 46–47). Front rounded projections 370 are defined towards the front of shelf tray 328 while rear rounded projections 372 are defined towards the rear of shelf tray 328. After a shelf tray 328 has been snapped onto a shelf base 326, a bottom edge 374 of projections 370 and 372 comes into contact with bottom wall 368 of each inner track 358. If the shelf tray 328 is in the fully retracted position, the front rounded projections 370 are positioned in locking sections 364 of inner tracks 358. The rear rounded projections 372 are positioned in the rearward flat sections 360 of tracks 358. In order to slide shelf tray 328 forwardly with respect to shelf base 326, the bottom edge 374 of front rounded projections 370 must move past locking edges 366. If sufficient forward force is exerted on shelf tray 328, the rounded nature of bottom edge 374 of front rounded projections 370 will cause the locking edges 366 on bottom wall 368 to flex downwardly, thereby allowing front rounded projections 370 to move out of locking section 364. Thus, in order for shelf tray 328 to be moved out of the fully retracted position, sufficient force must be applied to shelf tray 328 to flex locking edges 366. Locking edges 366 therefore resist movement of shelf tray 328 out of the fully retracted position.

Once shelf tray 328 has been moved forwardly out of locking sections 364 of inner tracks 358, shelf tray 328 can be slid forwardly with little resistance. As the shelf tray 328 nears the fully extended position, however, rear rounded projections 372 move into sloping sections 362 of inner tracks 358. As rear rounded projections 372 move into sloping sections 362, the bottom edges 374 of projections 372 come into contact with bottom wall 368 in sloping sections 362. This creates an increasing frictional resistance to moving shelf tray 328 to the fully extended position. However, if sufficient force is applied to shelf tray 328, rear rounded projections 372 will push against bottom wall 368 in sloping sections 362 with sufficient force to cause bottom wall 368 in sloping section 362 to flex downwardly. This downward flexing of bottom wall 368 in sloping section 362 will allow rear rounded projections 372 to move past locking edges 366. When rear rounded projections 372 have moved past locking edges 366, they are then in locking section 364. In order for rear rounded projections 372 to move out of locking sections 364, an additional rearward force must be exerted on shelf tray 328 in order to cause locking edges 366 to flex downwardly. Thus, locking edges 366 resist movement of shelf tray 328 out of the fully retracted position after it has been moved into the fully retracted position. Consequently, a user must exert additional force to move shelf tray 328 either into or out of either the fully extended or fully retracted positions. This ensures that, if the shelf tray 328 is moved to the fully retracted position, it will tend to remain there. Similarly, this ensures that if the shelf tray 328 is moved to the fully retracted position, it will stay there.

One of the side walls 332 in each shelf base 326 includes a connector 376 defined therein (FIGS. 38–39 and 48–49). Connector 376 functions to ensure that two or more adjacent shelf bases 326 that are hung on slot wall 122 will maintain their horizontal alignment with each other. Because each of the shelf bases 326 are made out of a flexible material, such as a suitable plastic, they may tend to bend downwardly as product is loaded onto their associated shelf trays. If one shelf tray has a heavier amount of product than the shelf tray on an adjacent shelf base, the adjacent shelf 104 may not bend downwardly to as great of an extent as the greater loaded shelf 104. In such a case, the two shelves will not have their front ends horizontally aligned even though they are both hung at the same horizontal level on slot wall 122. This creates an undesirable visual effect in that it highlights that the two adjacent shelves are not an integral structure, but rather are two separate structures. Connectors 376 prevent this horizontal misalignment between shelves 104 that are positioned at the same horizontal level on slot wall 122 and next to each other such that their side walls 332 are in contact.

The side wall 332 of each shelf base 326 that does not include connector 374 has a slot 378 defined in it for receiving a connector 376 from an adjacent shelf (FIG. 39). Thus, if two shelves 104 are to be connected together via connector 376 in order to maintain their horizontal alignment, connector 376 of one of the shelves inserts into the slot 378 of the other shelf. Slot 378 generally has a height that is equal to the thickness of connector 376. Thus, if an excessive amount of product is positioned on a shelf 104 that causes the shelf 104 to bend downwardly, the insertion of its connector 376 into the slot 378 on the adjacent shelf 104 will ensure that the adjacent shelf 104 bends downwardly an equal amount. The two adjacent shelves will therefore maintain their horizontal alignment. Because each shelf base 326 includes a connector 376 and a slot 378, it is possible to maintain an entire row of shelves 104 in horizontal alignment. Stated alternatively, as many shelves 104 as may be desired can be connected together via connectors 376 in slots 378 to ensure their horizontal alignment with each other.

Figure 48:
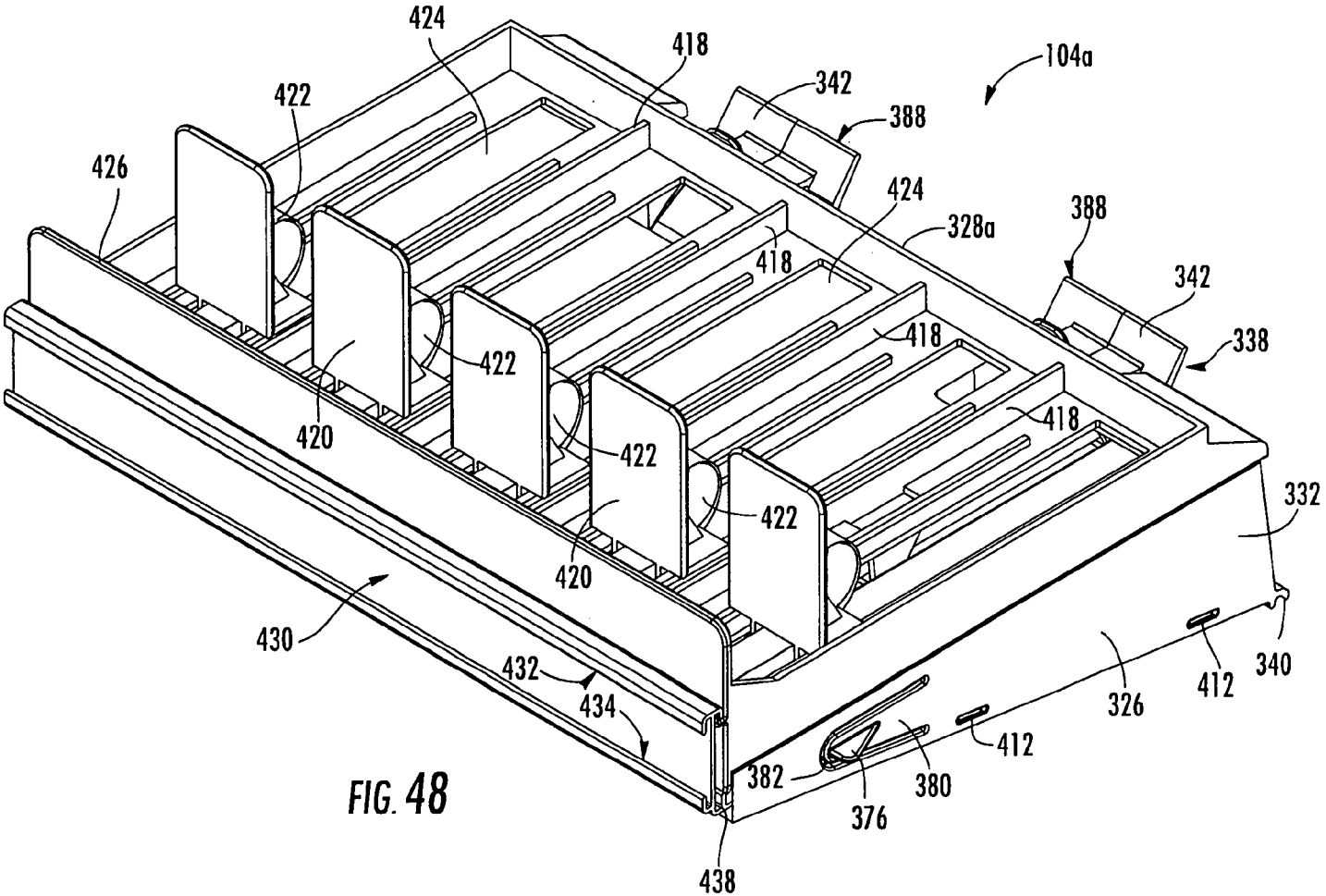
FIG. 48 is a perspective view of the divided shelf tray attached to the shelf base.

In certain situations, it is desirable to not have connector 376 sticking out from one of the side walls 332 of shelf base 326. Such situations may arise where the side wall 332 of shelf base 326 that has connector 376 on it is positioned next to a non-shelf structure, such as an end panel 102, a cabinet 106, a divider panel 114, or some other non-shelf structure. In order to allow shelf base 326 to be positioned right next to such a non-shelf structure, connector 376 is constructed such that it can flex inwardly into shelf base 326. Connector 376 is defined on a flexible tab 380 on side wall 332 (FIGS. 38–39 and 48). Flexible tab 380 is defined by an elongated, curved cut 382 in side wall 332. Flexible tab 380 can be pushed inwardly into shelf base 326 sufficiently far such that the outermost extent of connector 376 is flush with the plane defined by side wall 332. In other words, connector 376 can be pushed inwardly into shelf base 326 so that it does not stick out from side wall 332. Because it does not stick out from side wall 332, this side of the shelf base 326 can be positioned tightly against a non-shelving structure.

Figure 41:
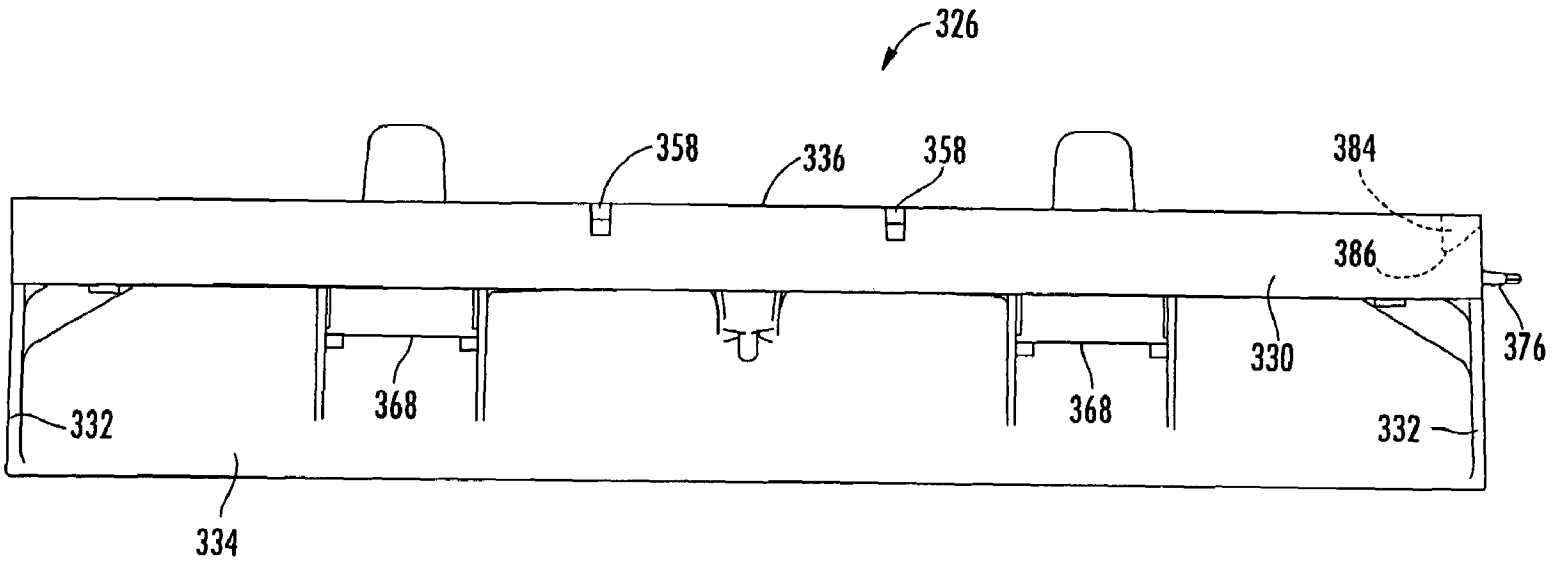
FIG. 41 is a front, elevational view of the shelf base.

In order to maintain connector 376 in the retracted position, a locking tab 384 is provided on shelf base 326 (FIG. 41). Locking tab 384 includes a lower surface 386 that is positioned slightly lower than the upper surface of flexible tab 380. Thus, in order to push flexible tab 380 inwardly, flexible tab 380 must flex downwardly to some extent and/or the lower surface 386 of locking tab 384 must flex upwardly a small amount. Once flexible tab 380 has been pushed past locking tab 384, it does not easily return to its unflexed position because locking tab prevents it from so returning. This is because locking tab 384 has an angled surface that engages flexible tab 380 when flexible tab 380 is being pushed inwardly, but has a generally vertical surface which engages flexible tab 380 when flexible tab 380 is pushed outwardly. Thus, flexible tab 380 cannot be easily pushed outward past locking tab 384. Flexible tab 380 therefore remains retracted into shelf base 326 after it has been pushed past locking tab 384. Only if a user manually flexes tab 380 and/or locking tab 384 can flexible tab 380 be returned to its un-flexed state in which connector 376 projects outwardly from side wall 332.

Figure 52:
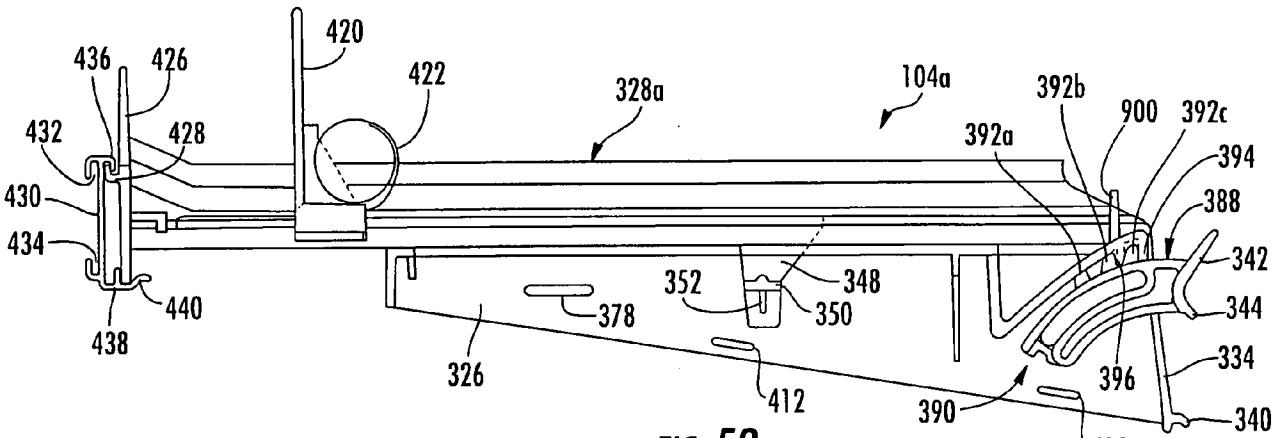
FIG. 52 is a sectional view of the shelf base, shelf tray, and bracket taken along the line LII—LII in FIG. 49 illustrating the shelf in a first orientation.
Figure 53:
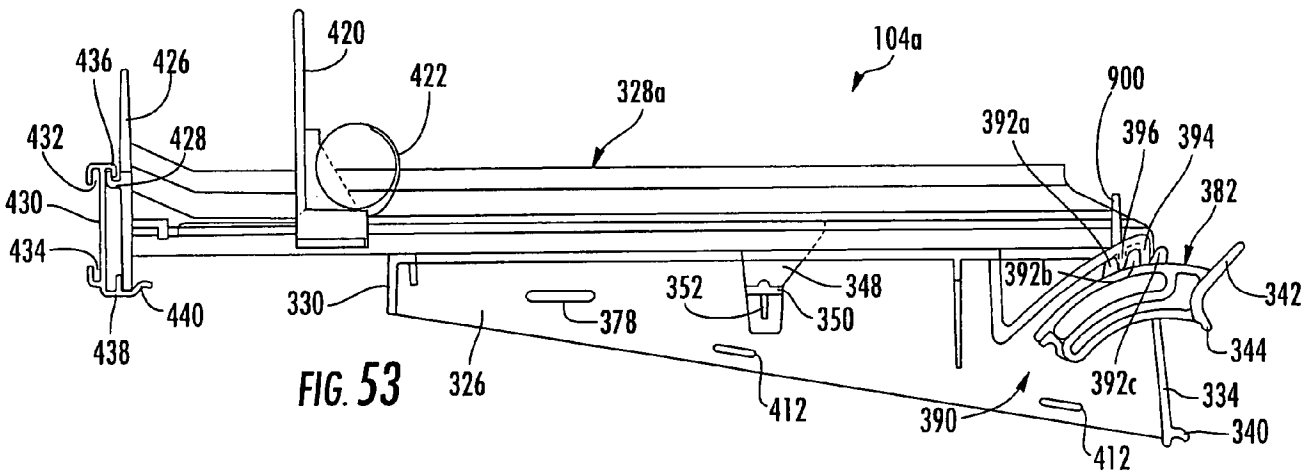
FIG. 53 is a side, elevational view of the shelf base, shelf tray, and shelf bracket, similar to FIG. 52 but illustrating the shelf bracket in a second orientation.

As was previously mentioned above, each shelf base 326 is supported on slot wall 122 by a pair of shelf brackets 388 (FIGS. 48–53). Each shelf bracket 388 includes the upper insert 338 that includes upper arm 342 and lower arm 344. As was mentioned previously, upper arm 342 fits into a large slot 204 in slot wall 122 and lower arm 344 fits into a small slot 202 in slot wall 122. Shelf brackets 388 are attached to shelf base 326 in recessed areas 390 (FIGS. 39 and 52–53). Shelf brackets 388 allow the attached shelf base 326 to be supported on slot wall 122 in two different orientations. In a first orientation, shelf base 326 is supported on slot wall 122 in a generally horizontal orientation. In this orientation, both shelf base 326 and the supported shelf tray 328 are positioned horizontally. In a second orientation, shelf brackets 388 can support shelf base 326 such that the front of shelf base 326 angles downwardly approximately 10°. When shelf base 326 is supported in this manner, the supported shelf tray 328 has a slight downward slant to it, which allows the customer to view more of the product positioned on the shelf tray 328. Shelf brackets 388 allow the user to easily switch between supporting shelf bases 326 in the horizontal orientation and the downwardly slanted orientation, or vice versa.

Each shelf bracket 388 includes three teeth 392*a, b*, and *c*. Teeth 392 are used to support shelf base 326 in either the horizontal or downwardly slanted orientations. This is illustrated more clearly in FIGS. 52 and 53. Each shelf base 326 includes a rear flange 394 and a front flange 396 that extend downwardly in recessed area 390. Front and rear flanges 396 and 394 are dimensioned to fit between teeth 392. In FIG. 52, shelf bracket 388 is attached to shelf base 326 in the manner that supports shelf bracket 388 in the horizontal orientation. Rear flange 394 is positioned behind tooth 392*c* and front flange 396 is positioned between teeth 392*b* and 392*c*. The interaction of teeth 392 with front and rear flanges 396 and 394 securely holds shelf base 326 on shelf brackets 388.

If it is desired to support the shelf base 326 in the downwardly slanted orientation, shelf base 326 is lifted by grasping one or both of tabs 900 and then repositioned to the configuration shown in FIG. 53. In this configuration, rear flange 394 is positioned between teeth 392*b* and 392*c*. Front flange 396 is positioned between teeth 392*a* and 392*b*. This causes shelf base 326 to slope downwardly when supported on slot wall 122. Again, the interaction of flanges 394 and 396 with teeth 392 securely maintained shelf base 326 on shelf bracket 388 in this orientation. In order to change a shelf base 326 from one orientation to the other, the shelf base 326 is merely lifted vertically upward until the flanges 394 and 396 separate from the spaces between teeth 392. Thereafter, the shelf base 326 is rotated to the desired orientation and flanges 394 and 396 are moved downwardly into the appropriate interlocking arrangement with teeth 392.

Figure 44:
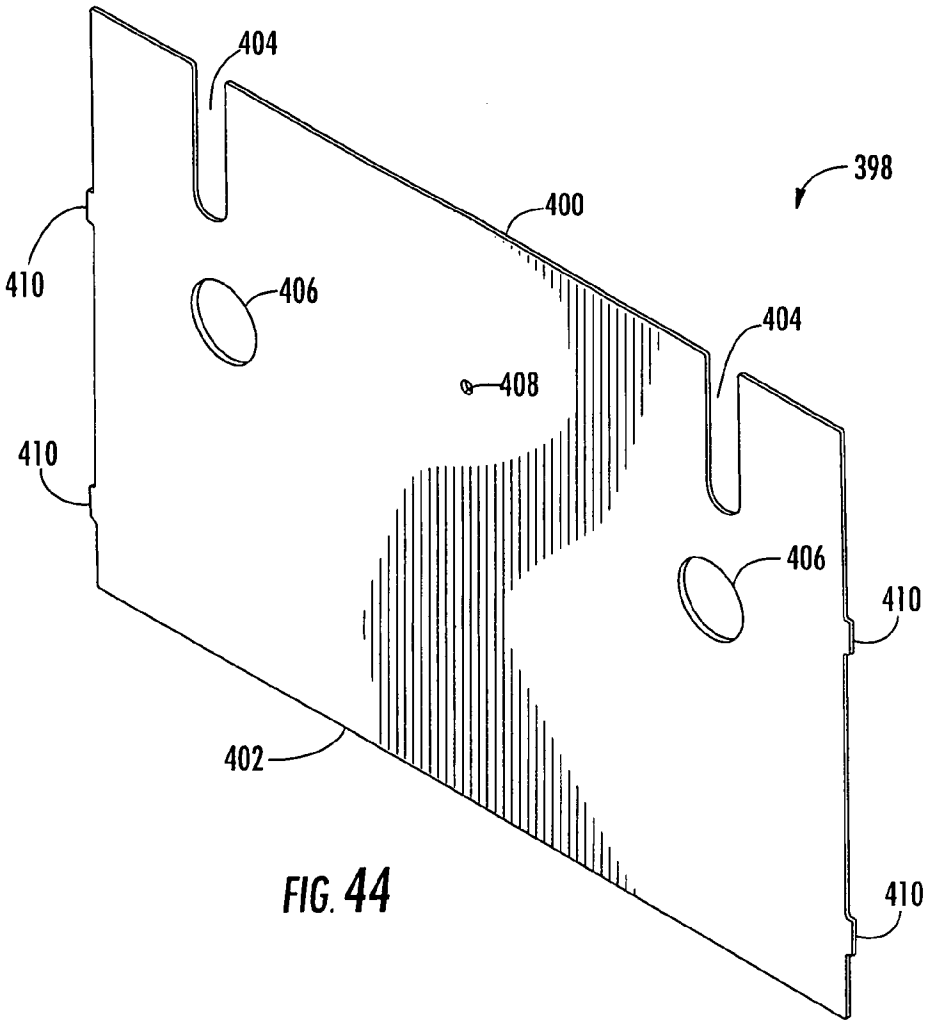
FIG. 44 is a perspective view of a cover for the shelf base.
Figure 45:
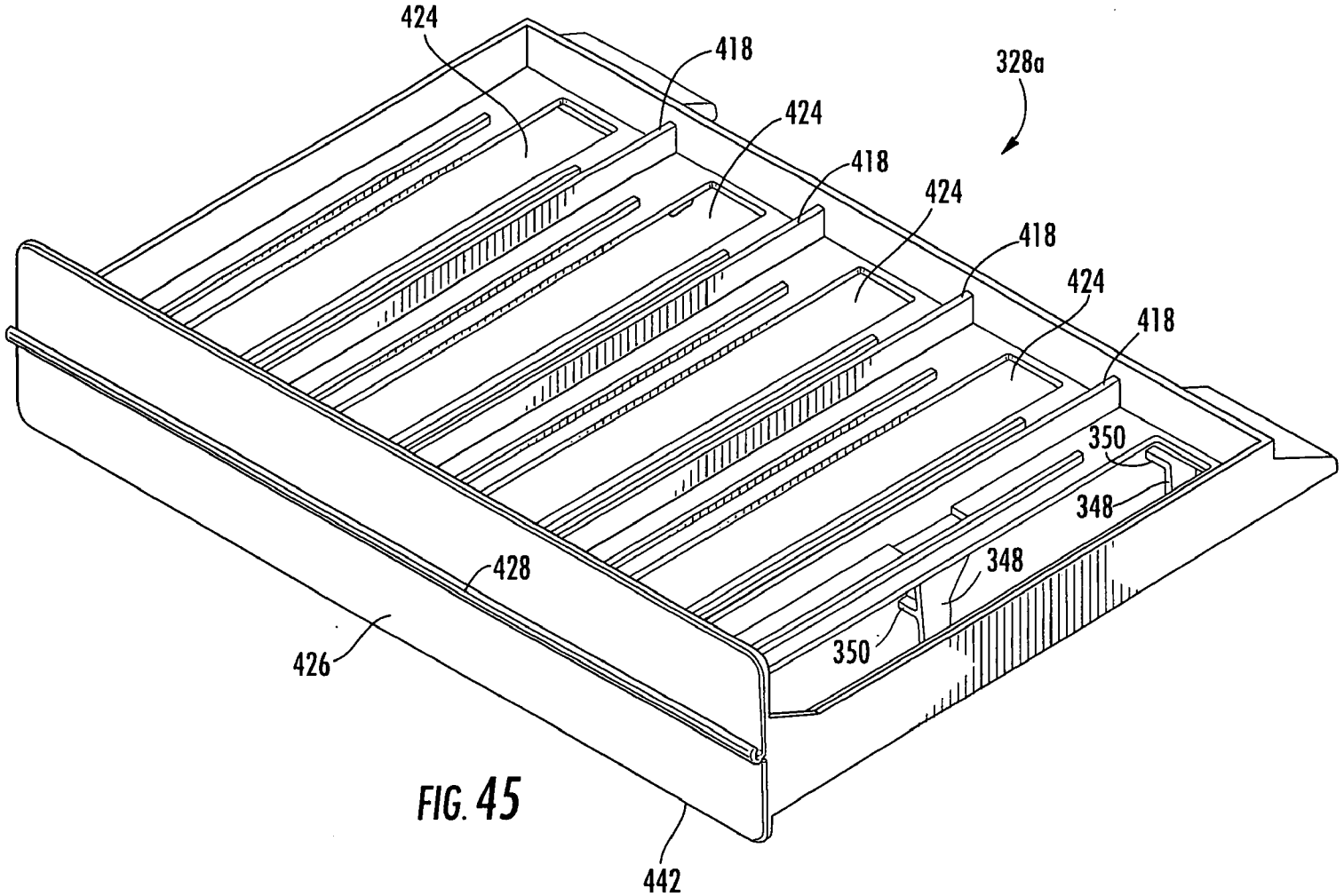
FIG. 45 is perspective view of a divided shelf tray.

In order to conceal the underside of shelf base 326 from view, a shelf bottom panel 398 may be provided (FIG. 44). Bottom panel 398 includes a front end 400, a back end 402, a pair of slots 404, two large apertures 406, one small aperture 408, and four side tabs 410. Side tabs 410 are used to secure bottom panel 398 to shelf base 326. Each side tab 410 may be inserted into one of the four side slots 412 defined in side walls 332 of shelf base 326 (FIGS. 38–40 and 43). Bottom panel 398 is preferably made from a flexible material, such as plastic, and can be suitably flexed to allow itself to be pushed up under shelf base 326. In this flexed position, the side tabs 410 are aligned with side slots 412. By allowing bottom panel 398 to return to its unflexed position while so aligned, side tabs 410 will be inserted into side slots 412. Thereafter, bottom panel 398 will be maintained on shelf base 326. Its removal can only be affected by flexing bottom panel 398 sufficiently to allow side tabs 410 to exit out of side slots 412.

When bottom panel 398 is attached to shelf base 326, it preferably does not conceal the entire bottom portion of shelf base 326. In other words, the distance from front end 400 to back end 402 of bottom panel 398 is preferably less than the distance from front wall 330 to rear wall 334 of shelf base 326. When bottom panel 398 is attached to shelf base 326, the back end 402 of panel 398 contacts rear wall 334 of shelf base 326. The front end 400 of bottom panel 398, however, terminates a short distance away from front wall 330 of shelf base 326. This leaves space for access to a pair of side screw bosses 314 defined on the bottom side of shelf base 326 (FIGS. 39 and 43). Side screw bosses 414 may be used to support one or more shelf lights, as will be described in more detail below. The termination of bottom panel 398 prior to screw bosses 414 thus leave sufficient clearance for accessing the screw bosses if needed. Similarly, slots 404 leave clearance for the sliding movement of shelf tray 328 in outer tracks 346 of shelf base 326. Small aperture 408 provides a hole for a center projection 416 defined on the underside of shelf base 326 to be inserted into. Projection 416 and small aperture 408 are dimensioned to create a frictional fit with each other that helps keep panel 398 flat when attached to shelf base 326. Large apertures 406 function to create finger holes by which panel 398 may be grasped for removing it from base 326. Large apertures 406 may also be utilized to remove a shelf tray 328 from base 326 without first removing panel 398.

Figure 49:
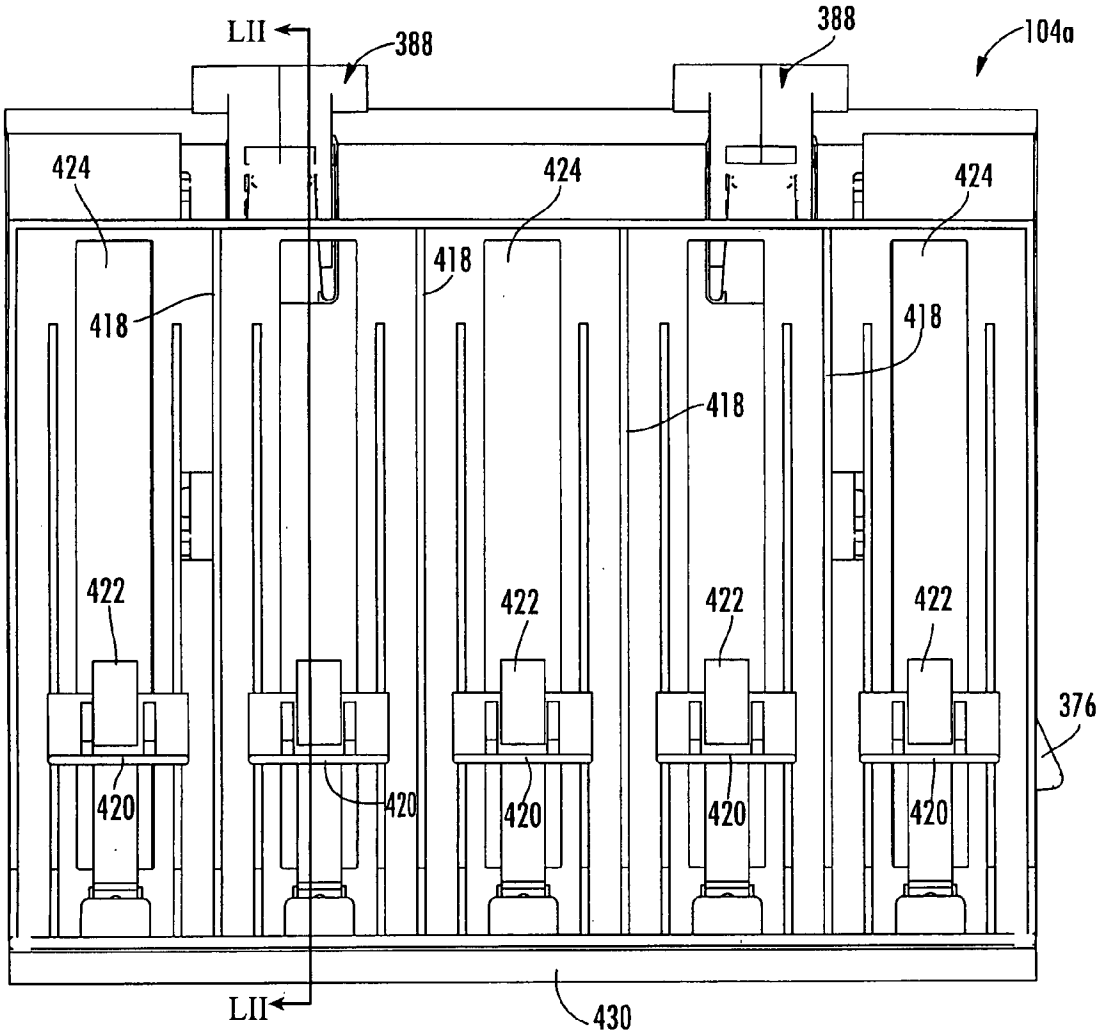
FIG. 49 is a plan view of the divided shelf tray and shelf base of FIG. 48.
Figure 50:
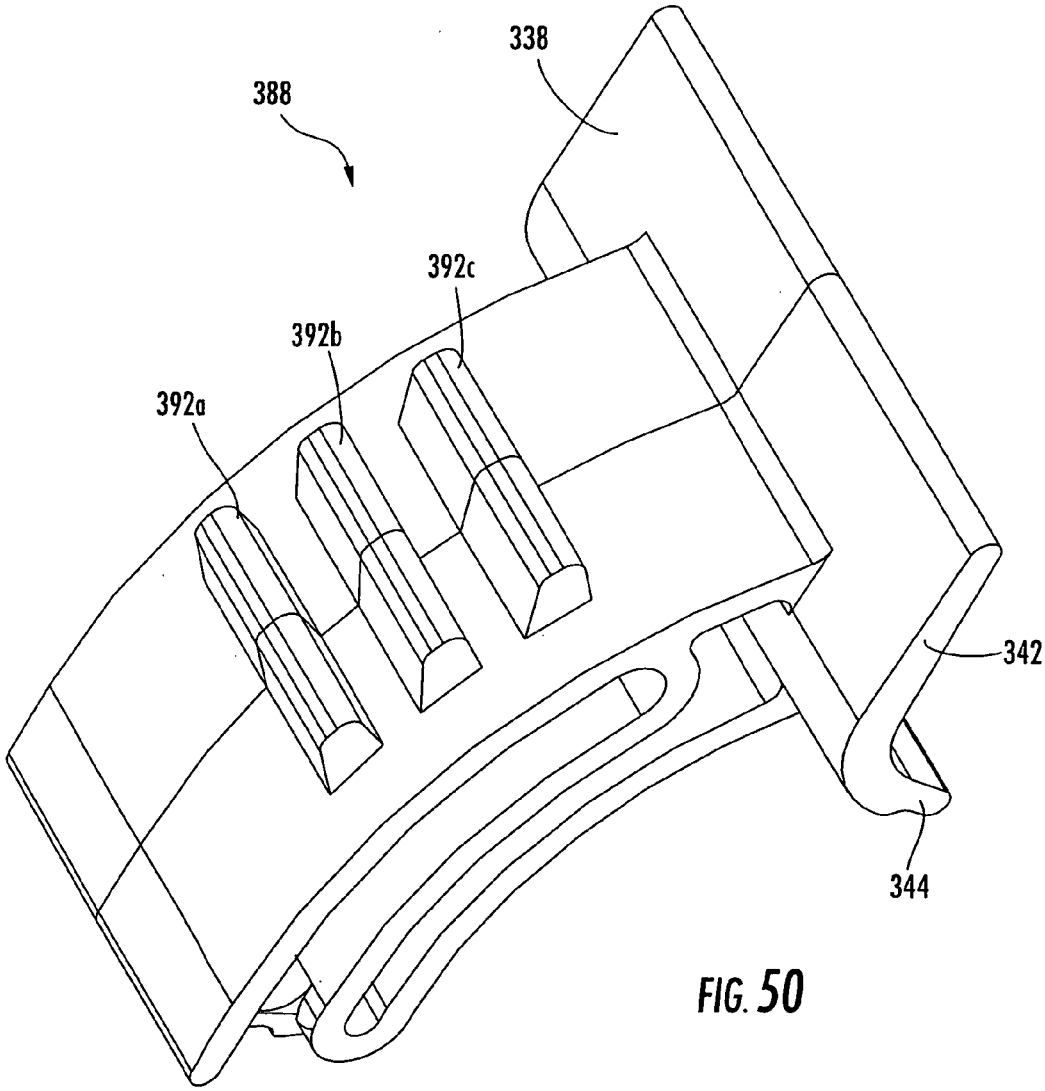
FIG. 50 is a perspective view of a shelf bracket.
Figure 51:
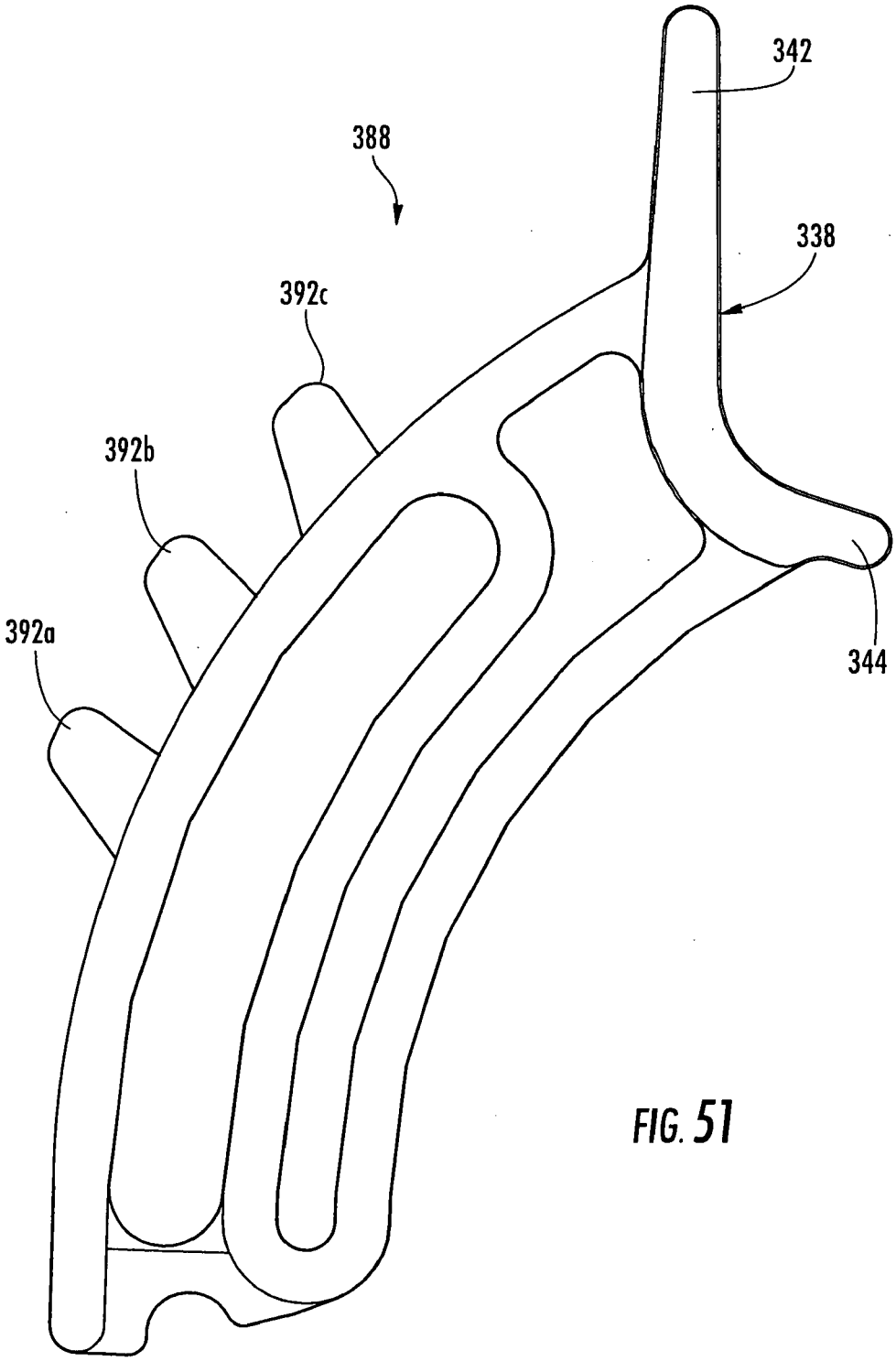
FIG. 51 is a side, elevational view of the shelf bracket of FIG. 50.

FIGS. 48 and 49 illustrate a divided shelf 104*a* attached to shelf base 326. The divided shelf tray 328*a* is illustrated in more detail in FIGS. 36–37 and 45–47. Each divided shelf tray 328 includes a plurality of elongated, parallel shelf dividers 418. Dividers 418 extend forwardly and rearwardly in shelf tray 328*a*. Each divider 418 may be spaced apart from an adjacent divider a distance equal to the width of a typical pack of cigarettes, if display stand 100 is being used to display cigarettes. If display stand 100 is being used to display different types of products, dividers 418 would preferably be constructed such that they were spaced apart a distance equal to the standard width of the products being displayed.

A paddle may be positioned within each space defined between dividers 418 (FIGS. 48–49). Each paddle 420 is coupled to a coiled spring 422. Paddles 420 and springs 422 are optional features that may or may not be included with divided shelf tray 328*a*. Paddles 420 and coiled springs 422 are slidable within a track 424 defined in the spaces between dividers 418. Paddles 420 and coiled springs 422 serve to ensure that products positioned on shelf tray 328*a* are pushed forwardly to the front end of divided shelf tray 328*a*. Thus, if cigarette packs are stored on shelf tray 328*a*, they would be positioned in front of paddle 420, and paddle 420 and coiled spring 422 would ensure that they would always be pushed up against a front wall 426 of shelf tray 328*a* regardless of any removal of products thereafter by customers. The detailed construction of paddles 420, coiled springs 422 and tracks 424 is described more fully in U.S. Pat. No. 6,193,085 issued to Nook et al., entitled DISPENSING RACK, the disclosure of which is hereby incorporated herein by reference.

Front wall 426 of shelf tray 328*a* further includes an upturned hook 428 defined on the front side of front wall 426. Hook 428 may be used to secure a sign holder 430 to the front end of tray 328*a* (FIGS. 36–37 and 52–53). As illustrated more clearly in FIGS. 52 and 53, sign holder 430 includes an upper front channel 432 and a lower front channel 434. Upper and lower front channels 342 and 434 may receive a sign on which advertising, or other information, may be printed. The sign may be made out of any suitable material, such as paper, cardboard, or other materials. The sign may either be slid into upper and lower channels 432 and 434 from a side of sign holder 430, or, if the sign material is flexible, it can be flexed into channels 432 and 434 from the front of sign holder 430.

Sign holder 430 includes a rear downward hook 436 defined behind upper front channel 432. Rear hook 436 hooks onto hook 428 on front wall 426. Sign holder 430 further includes a bottom wall 438 having a rear tab 440. Bottom wall 448 is spaced sufficiently far from rear hook 436 such that it is level with a bottom edge 442 of front wall 426. Rear tab 440, however, curves upwardly such that it must be flexed downwardly before it can be moved past bottom edge 442 of front wall 426. In order to attach sign holder 430, which is made out of a flexible material such as plastic, rear hook 436 is first attached onto hook 428. A user then grasps rear tab 440 and forces it to flex downwardly such that it can be moved past bottom edge 442 of front wall 426. Thereafter, the user releases rear tab 440 and it returns upward to its unflexed position. In this unflexed position, which is illustrated in FIGS. 52 and 53, rear tab 440 prevents sign holder 430 from being removed from front wall 426. If a user desires to remove a sign holder 430, he or she simply pushes rear tab downwardly sufficiently far to allow it to move past bottom edge 442. Rear hook 436 is then unhooked from hook 428.

Undivided shelf tray 328*b* is depicted in more detail in FIGS. 54–56. Undivided shelf tray 328*b* may be attached to shelf base 326 in the same manner previously described above with respect to divided shelf tray 328*a*. Undivided shelf tray 328*b* may therefore slide forwardly or rearwardly on shelf base 326. Undivided shelf tray 328*b* differs primarily from divided shelf tray 328*a* in that it includes a flat wall 444 on which products may be supported. There are no dividers 418 which interrupt or divide flat wall 444. If display stand 100 is used to display cigarettes, undivided shelf tray 328*b* is advantageously suited to supporting cartons of cigarettes. However, cigarette packs, or any other types of products may be displayed on undivided shelf tray 328*b*.

Undivided shelf tray 328*b* includes a number of the same structures that are present in divided shelf tray 328*a*. These include four prongs 348 which are constructed in the same manner as the prongs 348 on divided shelf tray 328*a*. Undivided shelf tray 328*b* also includes a pair of front rounded projections 370 and rear rounded projections 372, which are the same as the projections 370 and 372 on divided shelf tray 328*a*, and operate in the same manner. Still further, a front wall 426 having a hook 428 is provided on the front of undivided shelf tray 328*b*. Front wall 426 and hook 428 of undivided shelf tray 328*b* may have a sign holder 430 (FIG. 56) attached thereto in the same manner that has been described previously.

A waterfall shelf 104*c* is depicted in more detail in FIGS. 57–58. Waterfall shelf 104*c*, unlike shelves 104*a* and 104*b*, is not supported on a shelf base 326. Rather, waterfall shelf 104*c* is attached directly to slot wall 122. Waterfall shelf 104*c* is attached to slot wall 122 by way of an upper insert 446 and a lower insert 448. Upper insert 446 includes an upper arm 450 and a lower arm 452. Lower insert 448 fits into one of the smaller slots 202 defined in slot wall 122 in the same way that lower insert 340 on shelf base 326 fits into one of the small slots 202. Similarly, upper arm 450 fits into one of the large slots 204 in slot wall 122 in the same manner that one of the upper arms 342 on shelf bracket 388 fits into a large slot 204. Still further, lower arm 452 fits into one of the small slots 202 in slot wall 122 in the same manner that the lower arms 344 on shelf brackets 388 fit into small slots 202.

Waterfall shelf 104*c* may or may not include a plurality of dividers 418. In the embodiment illustrated in FIG. 57, there are four dividers 418. These dividers 418 function in the same manner as the dividers 418 in divided shelf tray 328*a*. Waterfall shelf 104*c* further includes a front wall 426 having a hook 428. Front wall 426 and hook 428 may be used to support a sign holder 430 in the manner that has been previously described. Waterfall shelf 104*c* also includes a connector 376 mounted on a flexible tab 380. Connector 376 may be used to ensure that two or more waterfall shelves 104*c* that are positioned in a side-to-side manner maintain their horizontal alignment, in the same manner that connector 376 does for maintaining the alignment of shelf bases 326. While not illustrated in FIGS. 57 and 58, each waterfall shelf 104*c* includes a slot 378 on its side wall opposite connector 376 for receiving the connector 376 from an adjacent shelf.

Figure 59:
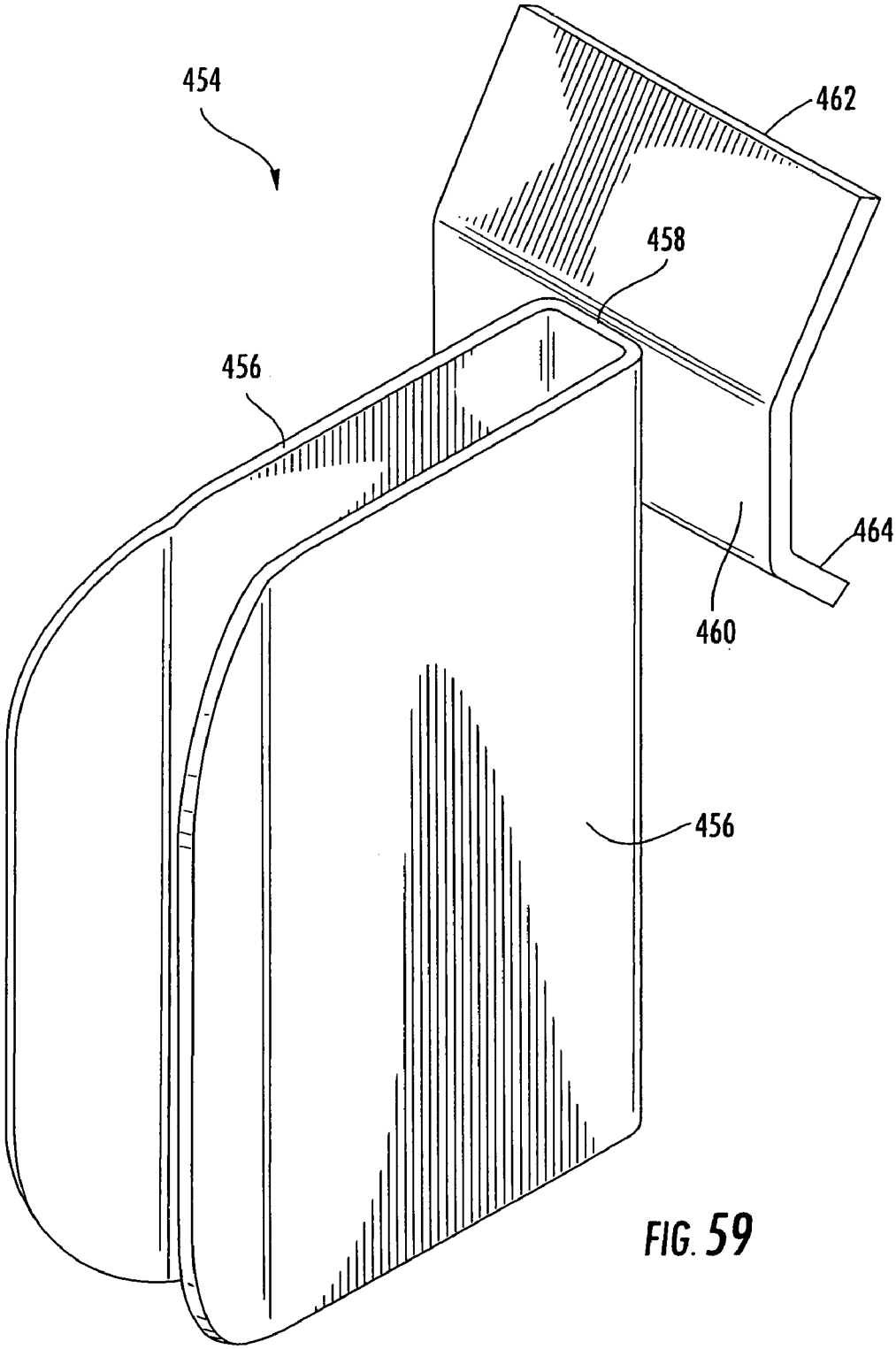
FIG. 59 is a perspective view of a divider panel bracket.
Figure 60:
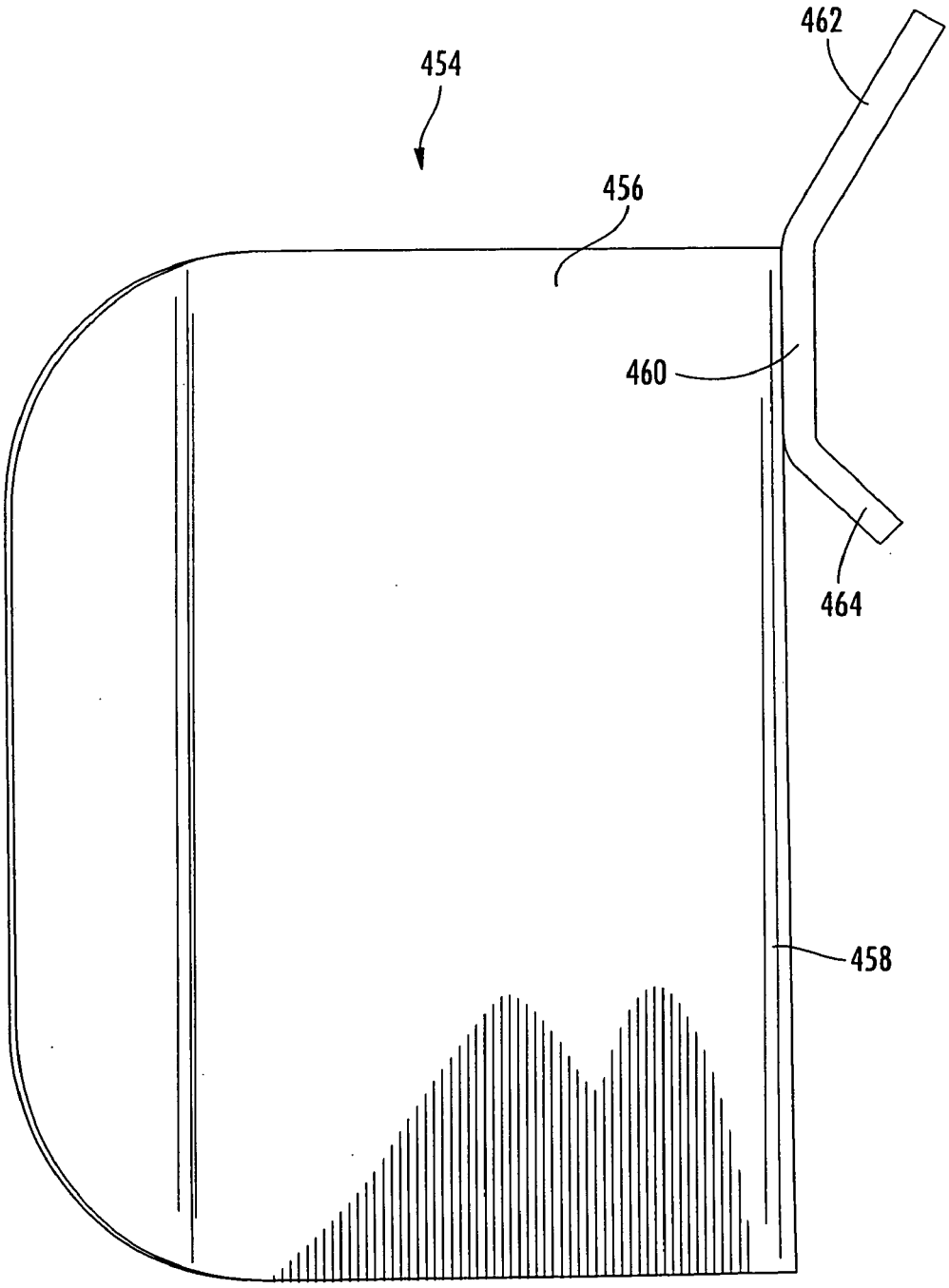
FIG. 60 is a side, elevational view of the divider bracket of FIG. 59.

In the embodiment of display stand 100 depicted in FIG. 1, there are a pair of divider panels 114 mounted on back wall 118. Divider panels 114 are specifically mounted onto slot wall 122. They therefore may be positioned at any side-to-side location on slot wall 122. Divider panels 114 are mounted on slot wall 122 by way of a plurality of divider panel brackets 454, which are illustrated in more detail in FIGS. 59–61. Each divider panel bracket 454 includes a pair of side walls 456 which are spaced apart from each other a distance that is slightly greater than the thickness of divider panels 114. Divider panel 114 can thus be inserted between side walls 456. A back wall 458 connects side walls 456 together. Back wall 458 has an attachment plate 460 secured thereto. Attachment plate 460 includes an upper flange 462 and a lower flange 464. Upper flange 462 is dimensioned to be inserted into one of the large slots 204 defined in slot wall 122. Lower flange 464 is dimensioned to be inserted into one of the small slots 202 defined in slot wall 122. Brackets 454 can thus be hung on slot wall 122.

Figure 61:
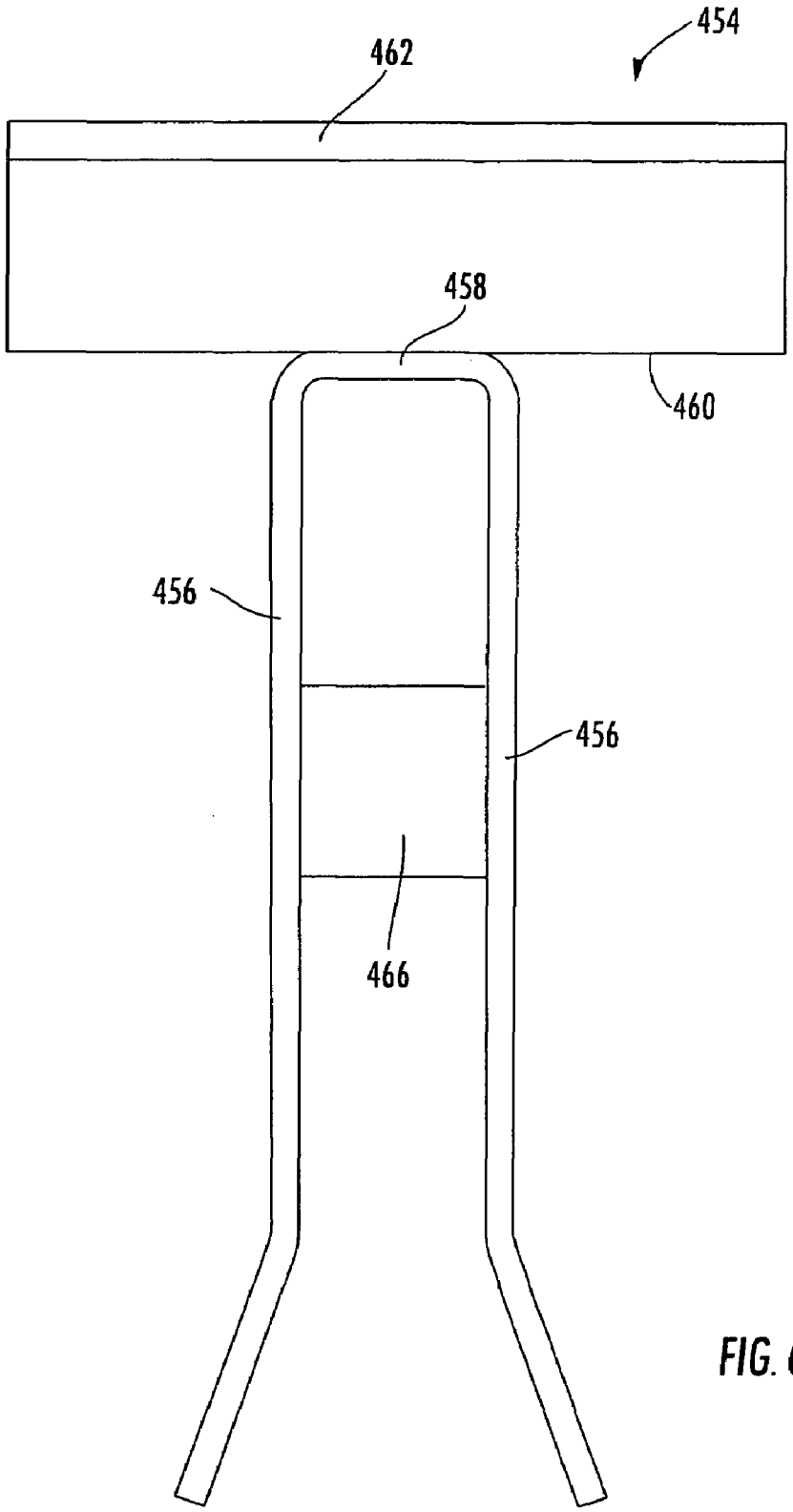
FIG. 61 is a plan view of the divider panel bracket of FIG. 59.
Figure 62:
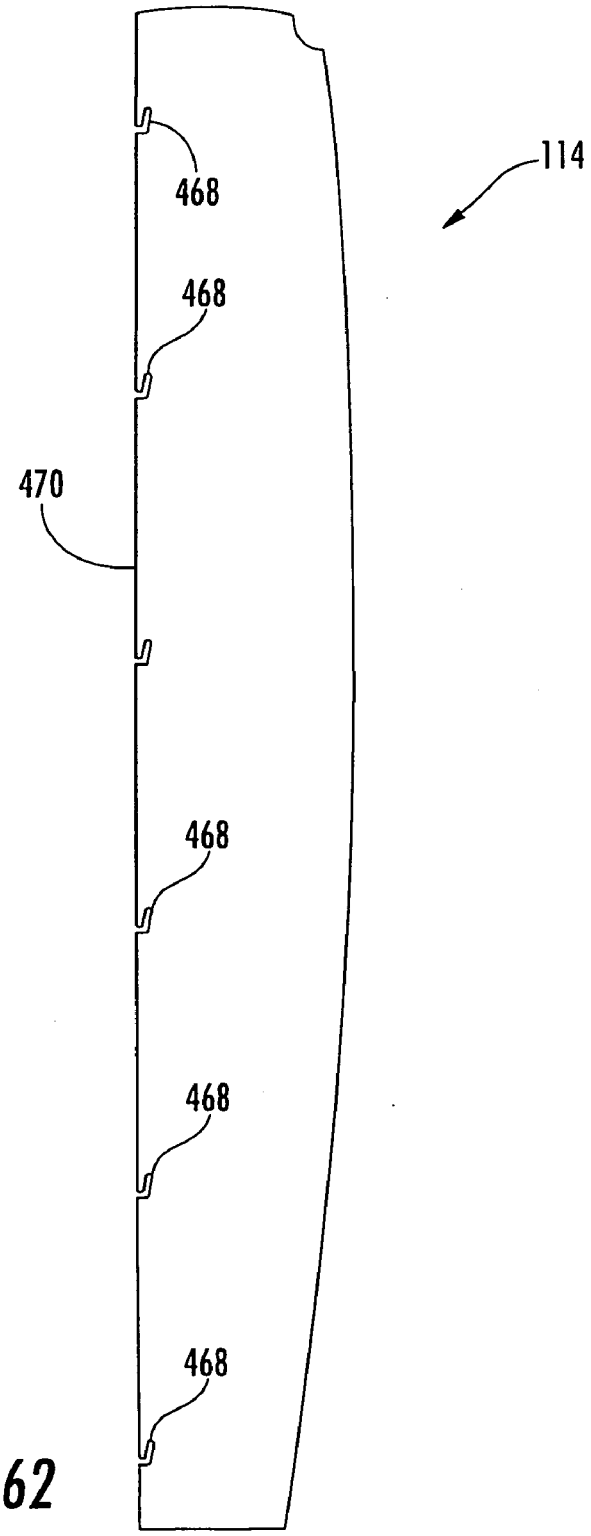
FIG. 62 is a side, elevational view of a divider panel.

In order to support a divider panel 114 on slot wall 122, a plurality of divider panel brackets 454 are attached to slot wall 122 in vertical alignment at the desired location for supporting divider panel 114. Each divider panel bracket 454 includes a pin 466 that extends between side walls 456 (FIG. 61). Pin 466 fits into one of the slots 468 defined along the back edge 470 of divider panel 114 (FIG. 62). As shown in FIG. 62, divider panel 114 includes 6 such slots 468. Divider panel 114 may include more or less than this number, depending upon the height of display stand 100. In order to support divider panel 114 on brackets 454, at least two brackets 454 are attached to slot wall 122. Then, divider panel 114 is inserted between the side walls 456 of each bracket 454. The insertion of divider panels 114 between side walls 456 is carried out such that the pins 466 in each bracket 454 will fit into one of the slots 468 in divider panel 114. As can be seen more clearly in FIG. 62, each slot 468 includes a horizontal section and a vertical section. Divider panel 114 is pushed into brackets 454 between side walls 456 sufficiently far such that pins 466 travel all the way to the end of the horizontal section of slots 468. Thereafter, panel 114 is pushed downwardly such that pins 466 will move upwardly into the vertical section of slots 468. Thereafter, the force of gravity will ensure that pins 466 remain in the vertical part of slots 468. This ensures that panel 114 is securely mounted to brackets 454, which are in turn securely mounted to slot wall 122. In order to remove panel 114 from brackets 454, it is lifted upward sufficiently far that pins 466 are moved to the bottom of the vertical sections of slots 468. When in this position, divider panel 114 can be pulled forwardly and the pins 466 will exit out of the horizontal portion of slots 468. The divider panel brackets 454 can then be removed from slot wall 122 if desired.

Figure 63:
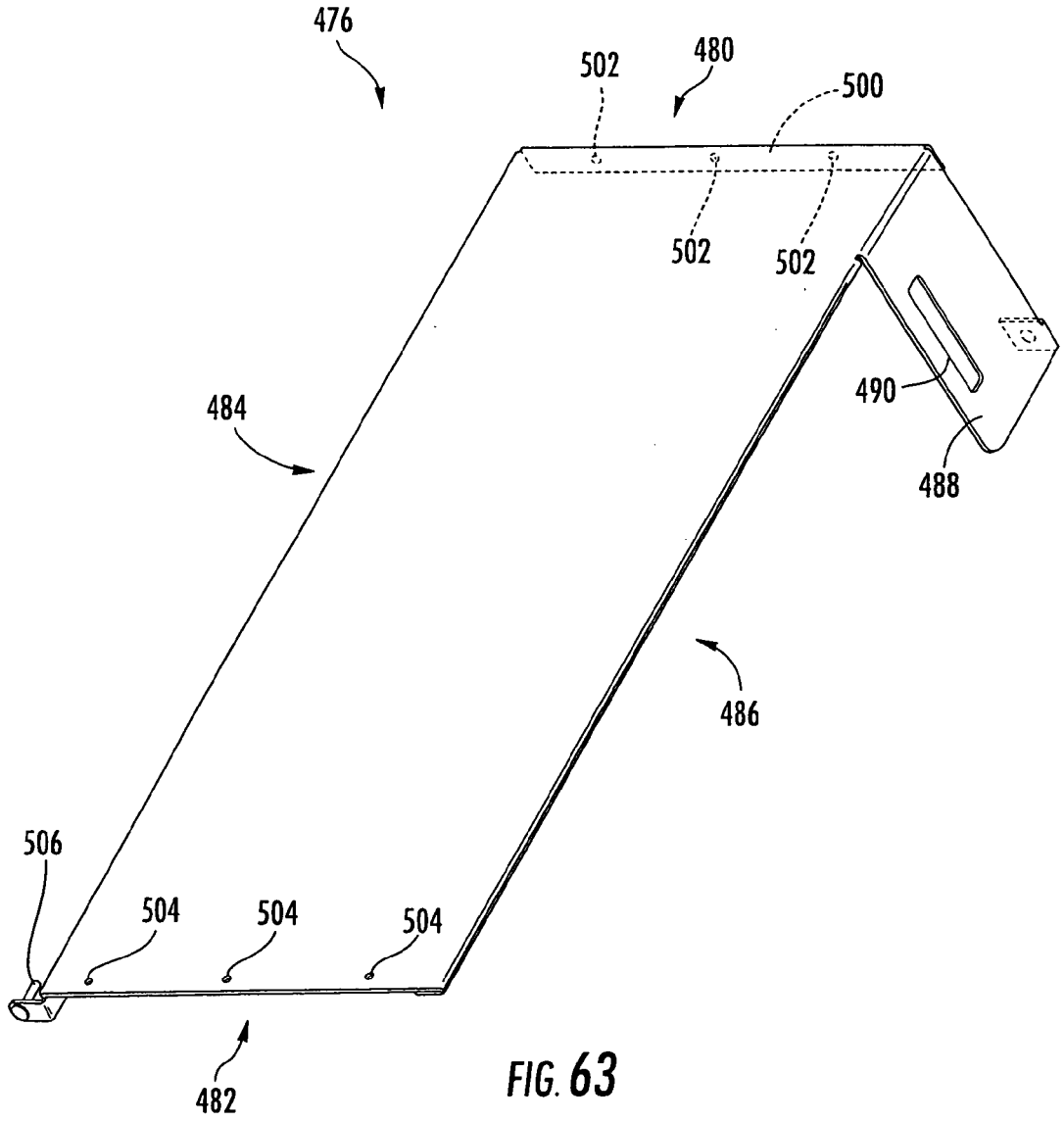
FIG. 63 is a perspective view of a cabinet side wall.
Figure 64:
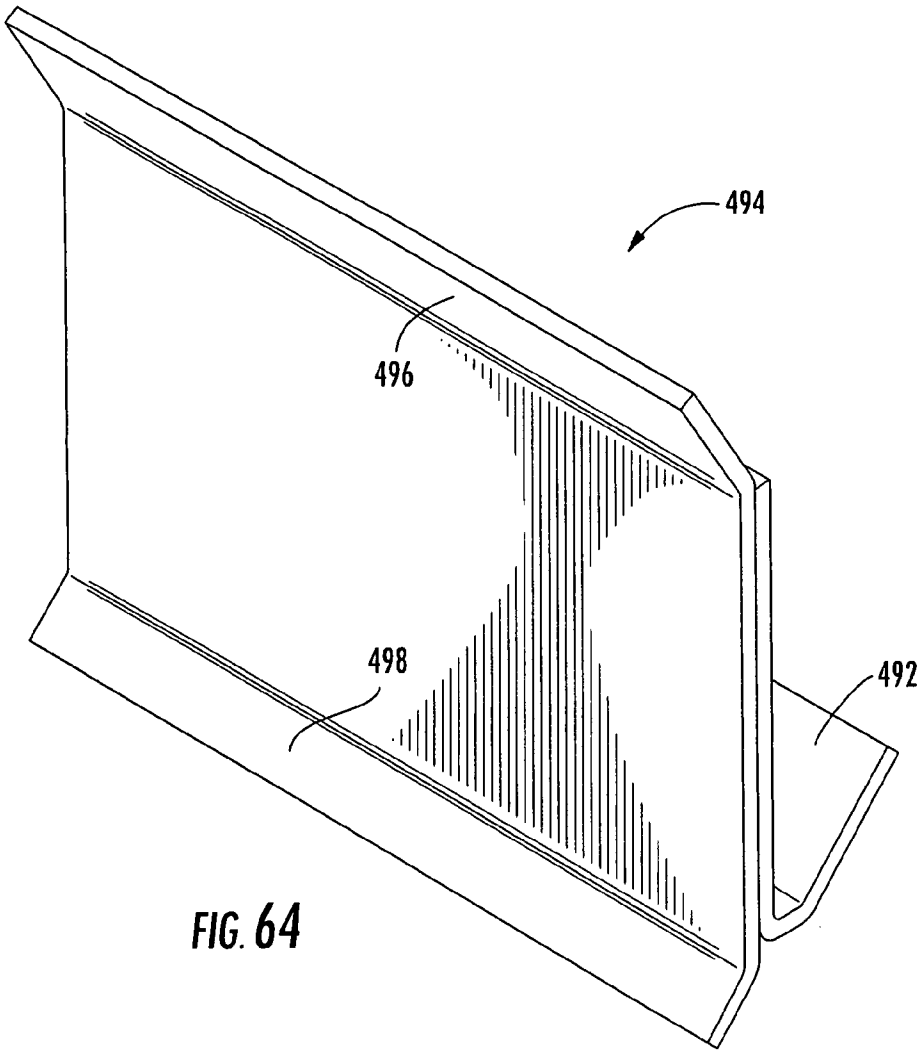
FIG. 64 is a perspective view of a cabinet bracket.
Figure 65:
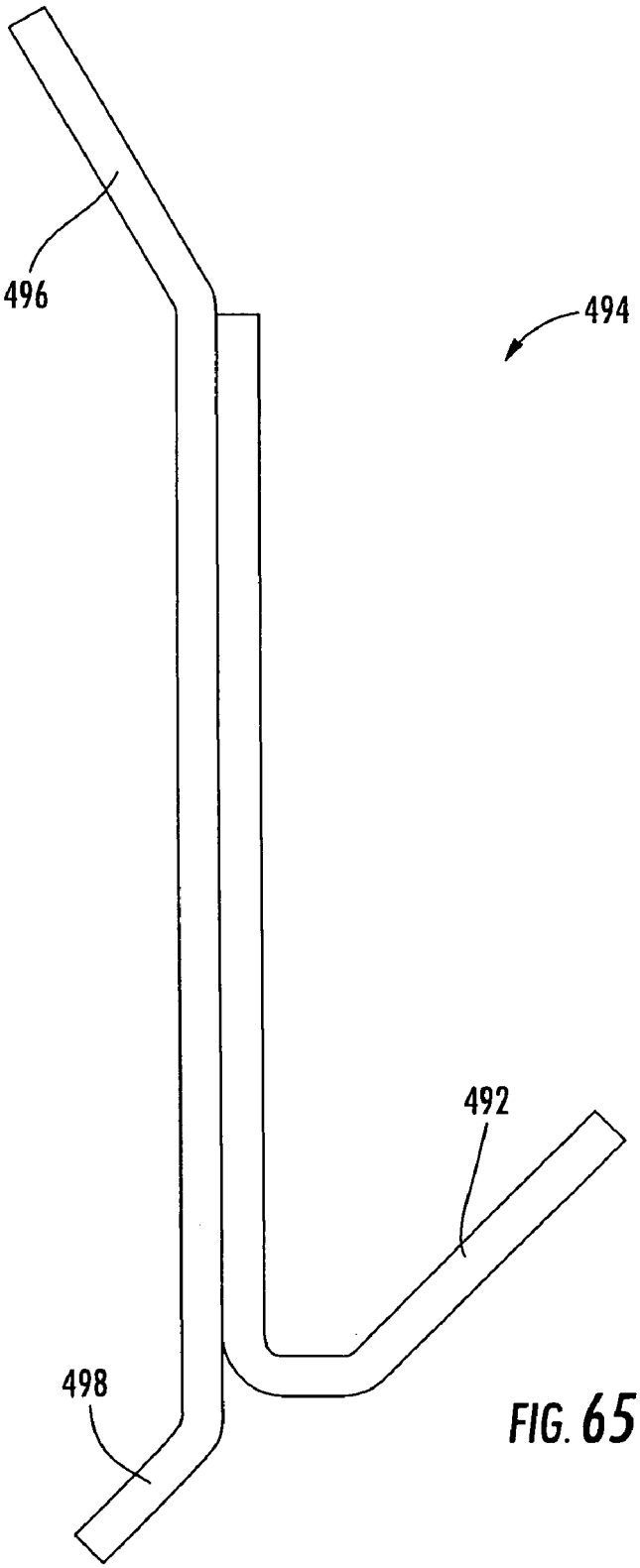
FIG. 65 is a side, elevational view of the cabinet bracket.

As was mentioned previously, the embodiment of display stand 100 depicted in FIG. 1 includes one cabinet 106. Cabinet 106 is mounted to slot wall 122. Thus, the position of cabinet 106 in a given display stand 100 can be changed. Alternatively, additional cabinets 106 may be mounted to slot wall 122, or no cabinets at all may be mounted in a given configuration of display stand 100. Cabinet 106 includes a top wall 472, a bottom wall 474, a pair of side walls 476, and two doors 478 (FIG. 1). Cabinet 106 is mounted to slot wall 122 by way of the side walls 476. The detailed construction of side wall 476 is illustrated in FIG. 63. Side wall 476 includes a top end 480, a bottom end 482, a front end 484, and a back end 486. An attachment plate 488 extends outwardly from the back end 486 at generally a right angle to the main body of side wall 476. Attachment plate 488 extends outwardly from back end 486 adjacent the top end 480 of side wall 476. Attachment plate 488 includes a horizontal slot 490 defined therein. Horizontal slot 490 receives a hook 492 from a cabinet bracket 494, which is used to support side walls 476, and thus cabinet 106, on slot wall 122. Cabinet bracket 494 is illustrated in more detail in FIGS. 64 and 65.

Each cabinet bracket 494 includes an upper flange 496 and a lower flange 498. Upper flange 496 is shaped and dimensioned to be received within one of the large slots 204 defined in slot wall 122. Lower flange 498 is dimensioned and shaped to be received in one of the small slots 202 defined in slot wall 122. Thus, cabinet bracket 494 can be attached to slot wall 122 by inserting upper flange 496 into a selected large slot 204 and then inserting lower flange 498 into the aligned small slot 202. Cabinet bracket 494 is attached to slot wall 122 at any desired location for supporting cabinet 106. As mentioned, hook 492 of bracket 494 fits into horizontal slot 490 in attachment plate 488 of side wall 476. Each side wall 476 thus hangs on a hook 492 on a bracket 494. The force of gravity and the weight of cabinet 106 maintains side walls 476 on hooks 492 of brackets 494. In order to remove side walls 476 from brackets 494, the side walls 476 would have to be lifted sufficiently far to allow horizontal slots 490 to become unhooked from hooks 492.

A top flange 500 is defined along the top end 480 of side wall 476 (FIG. 63). Top flange 500 includes a plurality of fastener apertures 502. Top flange 500 is oriented generally at right angles with respect to the main body of side wall 476. Top flange 500 provides a support for one end of the top wall 472 of cabinet 106. In order to secure top wall 472 to side wall 476, fasteners are inserted through fastener apertures 502 and into top wall 472. These fasteners may be screws, rivets, or any other suitable fastener for securing side wall 476 to top wall 472. A plurality of lower fastener apertures 504 are also defined in side wall 476 near the bottom end 482. Lower fastener apertures 504 are used to secure bottom wall 474 to side walls 476. Screws, or other suitable fasteners, are inserted through lower fastener apertures 504 and into one end of bottom wall 474. Bottom wall 474, top wall 472, and doors 478 may be affixed to the two side walls 476 prior to mounting cabinet 106 on cabinet brackets 494. In order to ensure that cabinet brackets 494 and attachment plates 488 do not interfere with the attachment of surrounding items, side walls 476 may be constructed such that their attachment plates 488 face inwardly towards each other. Thus, each side wall 476 would be a mirror image of the other side wall and access to the attachment plates 488 when cabinet 106 was mounted on slot wall 122 could only be achieved by opening doors 478.

A pivot pin 506 is attached to each side wall 476 adjacent the lower front corner of side wall 476 where bottom end 482 and front end 484 meet (FIG. 63). Pivot pin 506 provides a pivot axis about which one of the doors 478 may pivot between an open and closed position. Another pivot pin (not shown) is provided on the bottom of top wall 472 in vertical alignment with pivot pin 506. These two pivot pins insert into corresponding cylindrical recesses defined in the door 478 and thereby allow the door 478 to pivot between an open and closed position. If desired, doors 478 may include a lock which only allows them to be opened when the lock has been unlocked. Items may thus be securely stored in cabinet 106.

Figure 66:
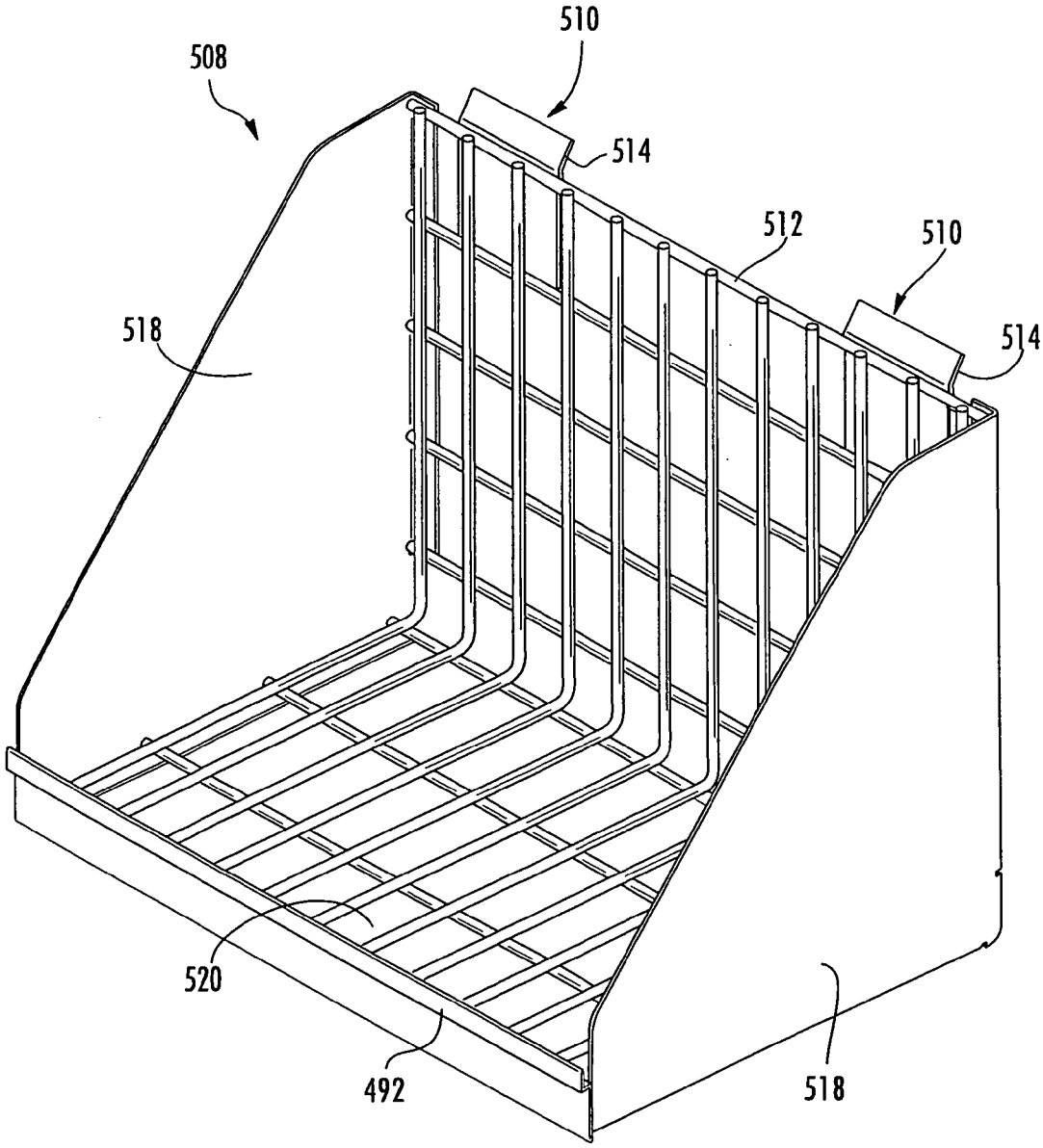
FIG. 66 is a perspective view of a basket.
Figure 67:
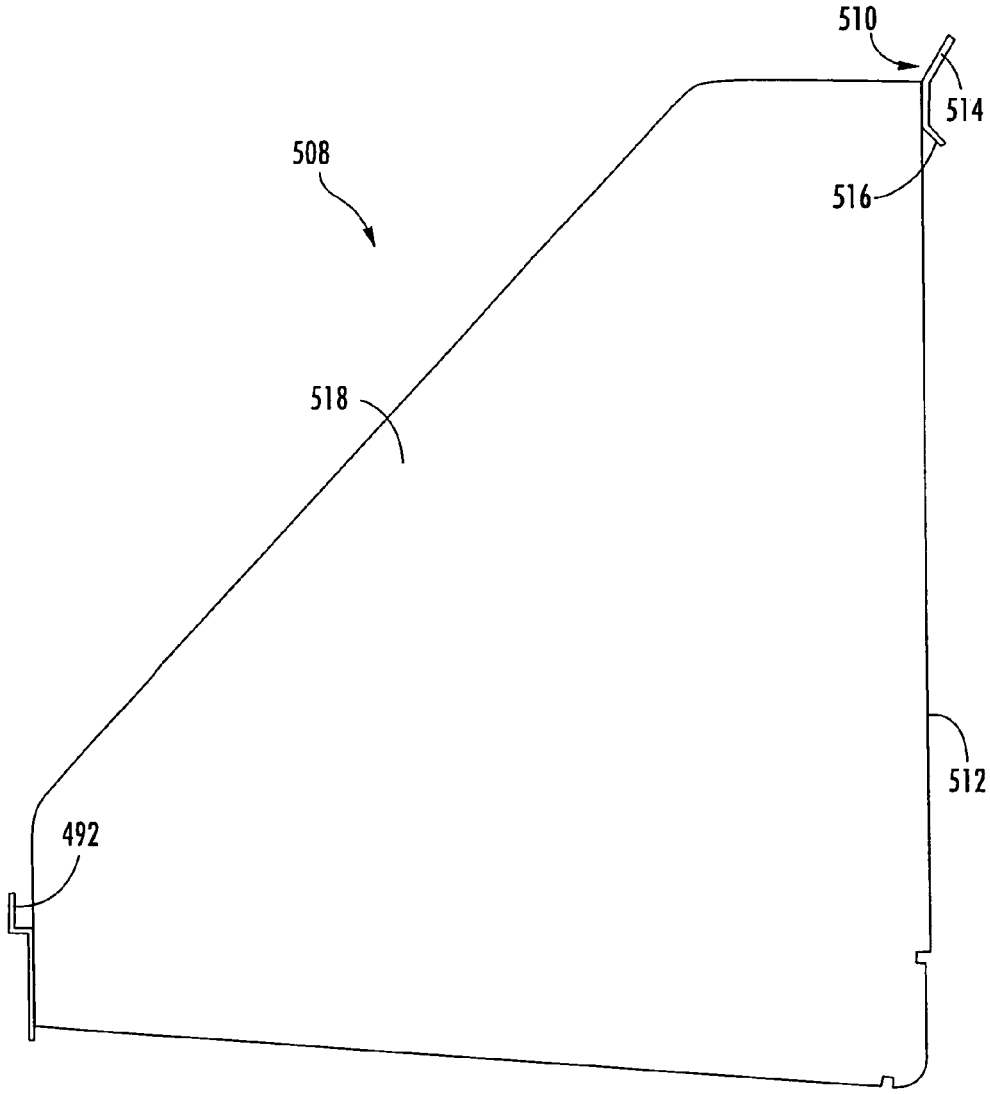
FIG. 67 is a side, elevational view of the basket of FIG. 66.

While not illustrated in the embodiment of display stand 100 depicted in FIG. 1, in some instances it may be desirable to include a basket 508 in display stand 100 (FIG. 66–67). Basket 508 includes a pair of attachment brackets 510 positioned along a back wall 512 of basket 508. Attachment brackets 510 each include an upper flange 514 and a lower flanges 16. Upper flanges 514 are shaped and dimensioned to be inserted into large slots 204 on slot wall 122. Lower flanges 516 are shaped and dimensioned to be inserted into small slots 202 on slot wall 122. Flanges 514 and 516 on attachment brackets 510 thereby enable basket 508 to be hung on slot wall 122. Basket 508 further includes a pair of side walls 518 and a bottom wall 520. Bottom wall 520 provides a structure on which items for display in stand 100 may be positioned and supported. Basket 508 may be used to support items on display stand 100 that may be too large to be supported on shelves 104, or which are otherwise more desirably positioned in basket 508 than on any of the shelves 104. The front wall on basket 508 may include a hook 492 which can be used to optionally mount a sign holder 430 in the manner previously described.

Figure 68:
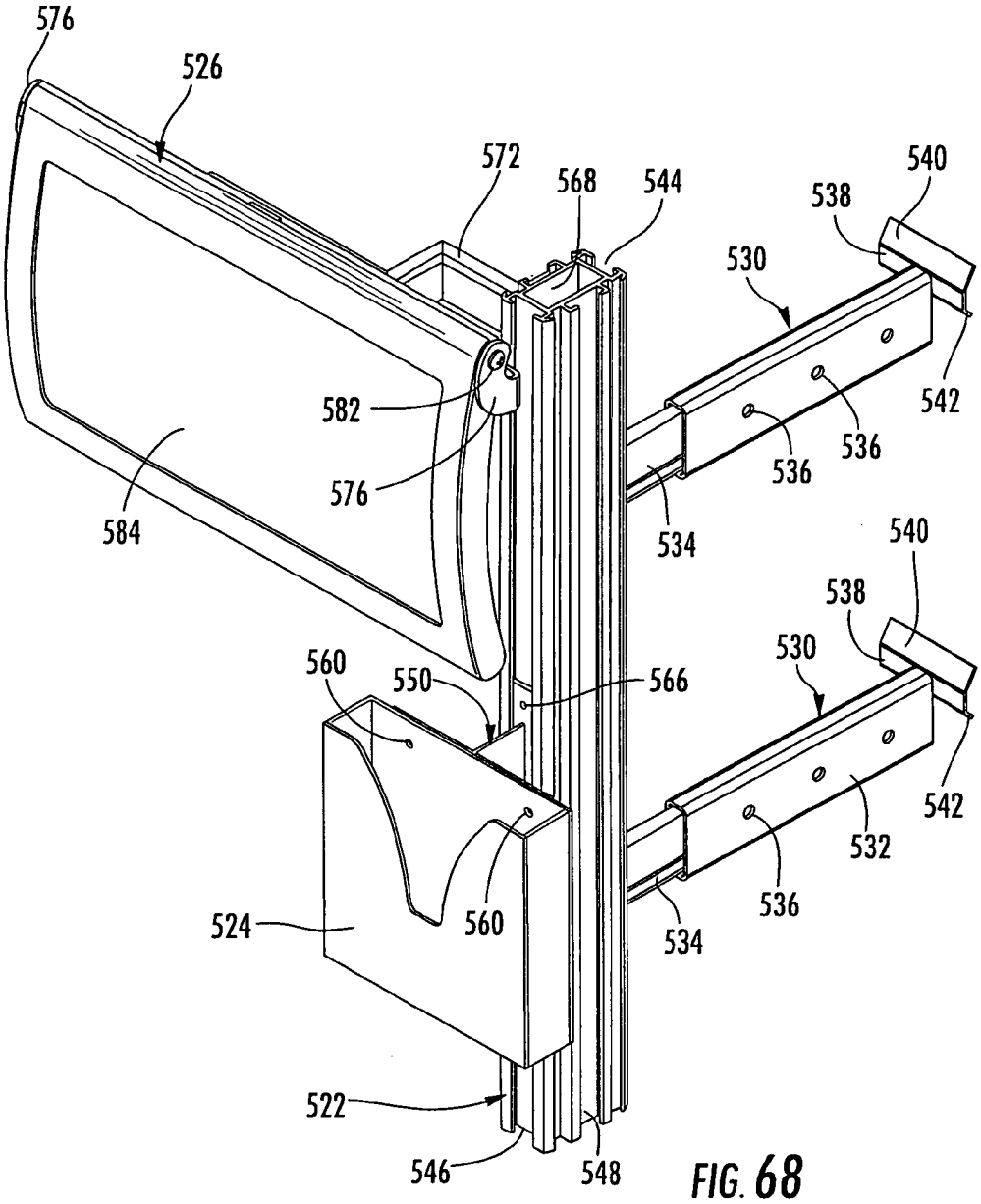
FIG. 68 is a perspective view of a utility pole supporting a literature holder and a light box.

In addition to basket 508, a utility pole 522 may optionally be mounted to slot wall 122 (FIGS. 68–71). Utility pole 522 allows a variety of different items to be selectively attached thereto. These items may include a literature holder 524, a light box 526, and/or a gravity fed product dispenser 112 (FIGS. 68 and 72). As illustrated in FIG. 68, utility pole 522 can support multiple ones of these items. Thus, a variety of different items and configurations of items may be utilized in conjunction with utility pole 522. Multiple utility poles 522 can be mounted onto a given display stand 100, if desired.

Figure 70:
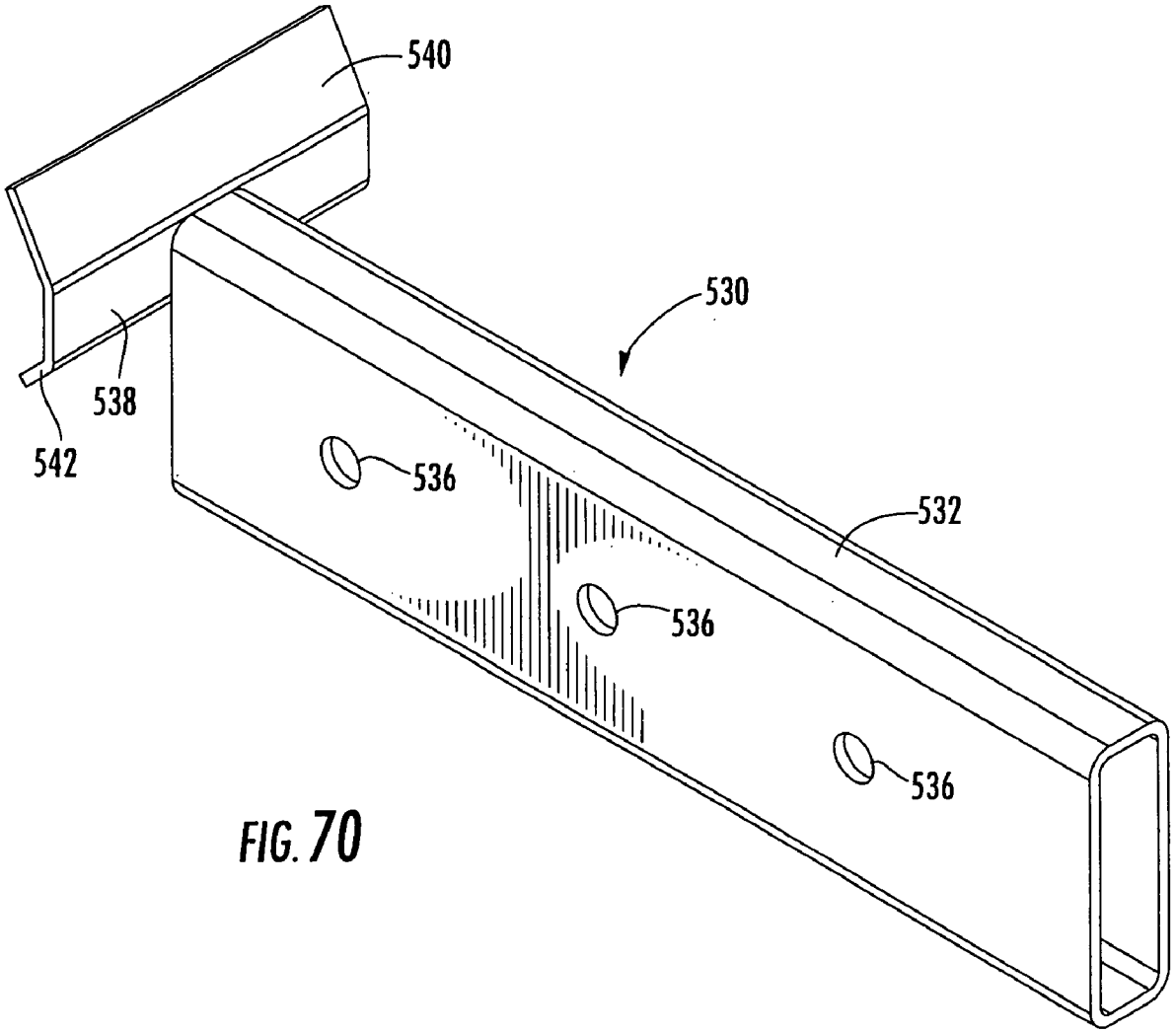
FIG. 70 is a perspective view of a utility pole bracket.

Utility pole 522 is supported on slot wall 122 by way of one or more utility pole brackets 530. Each utility pole bracket includes an outer sleeve 532 and an inner bar 534 that fits within outer sleeve 532. Inner bar 534 can be slid within outer sleeve 532, thus allowing the length of utility pole brackets 530 to be adjusted. Outer sleeve 532 includes a plurality of locking holes 536 (FIGS. 68 and 70). Locking holes 536 are adapted to receive a flexible plug defined on inner bar 534. Once the flexible plug is received in one of holes 536, sleeve 532 is locked into a given position with respect to bar 534. To extend bar 534 with respect to sleeve 532, the flexible plug is merely pushed inwardly such that it does not extend into any of the holes 536. Sleeve 532 is then slid to a new position on bar 536 until the plug snaps back into one of the holes 536. This allows the length of brackets 530 to be changed. Alternatively, holes 536 could be threaded and adapted to receive a thumb screw, or other threaded fastener. When one or more thumb screws are inserted into locking holes 536, the thumb screws come into contact with inner bar 534. By appropriately tightening the thumb screws, inner bar 534 can be locked into a given position inside of outer sleeve 532. Thus, the length of utility pole bracket 530 could be chosen and then locked at that length by way of the thumb screws in locking holes 536.

Each utility pole bracket 530 further includes an attachment plate 538 that has an upper flange 540 and a lower flange 542. Upper flange 540 is shaped and dimensioned to be inserted into one of the large slots 204 on the front of slot wall 122. Lower flange 542 is shaped and dimensioned to be received within one of the small slots 202 defined on the front of slot wall 122. Upper and lower flanges 540 and 542 thereby allow utility pole bracket 530 to be releasably mounted to slot wall 122. As noted above, the number of utility pole brackets 530 that may desirably be used to support a utility pole 522 will depend upon the length of utility pole 522. For relatively short utility poles 522, only a single utility pole bracket 530 may be necessary. For relatively long utility poles 522, more than two utility pole brackets 530 may be desirably used to support utility pole 522. Utility pole 522 may be constructed in different lengths to allow users of display stand 100 to have more options in configuring the look of display stand 100.

Figure 69:
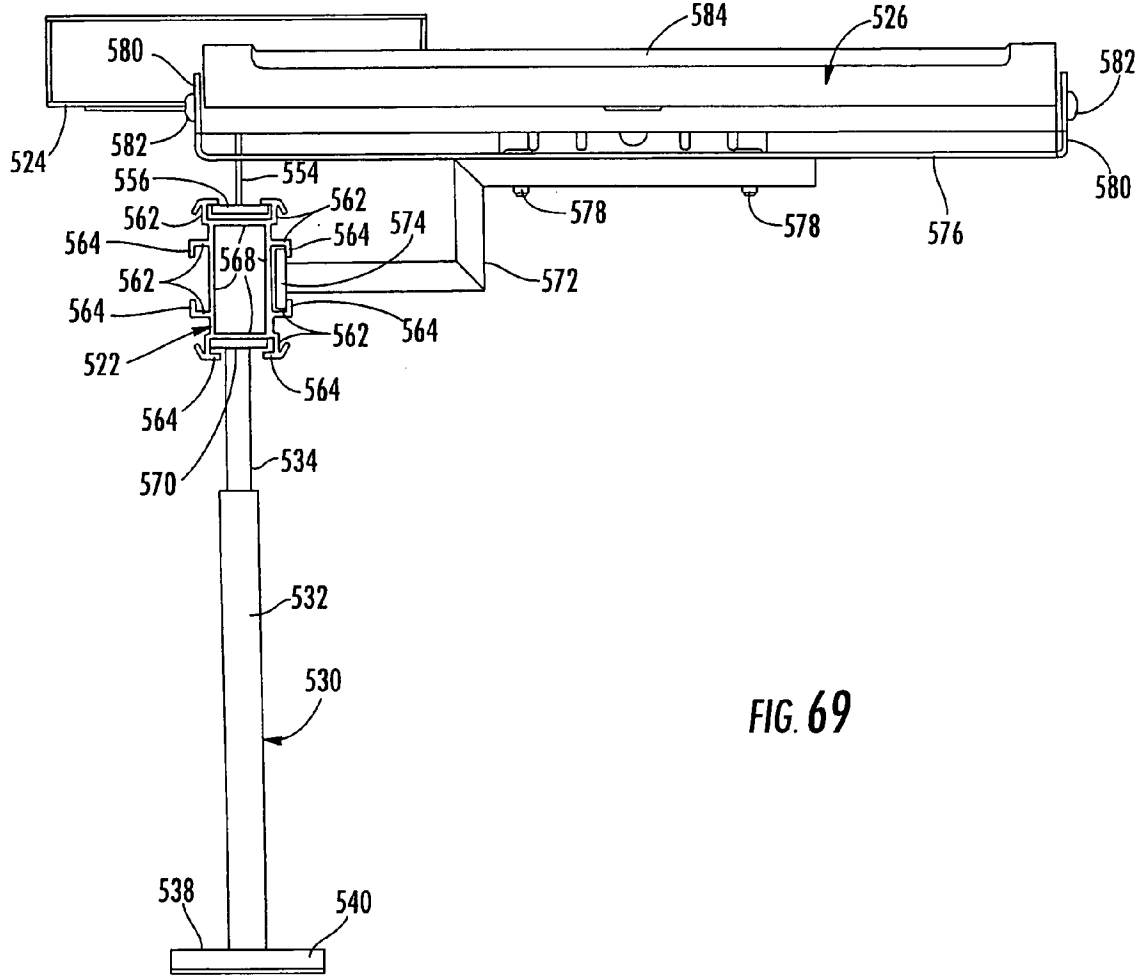
FIG. 69 is a plan view of the utility pole, literature holder, and light box of FIG. 68.
Figure 74:
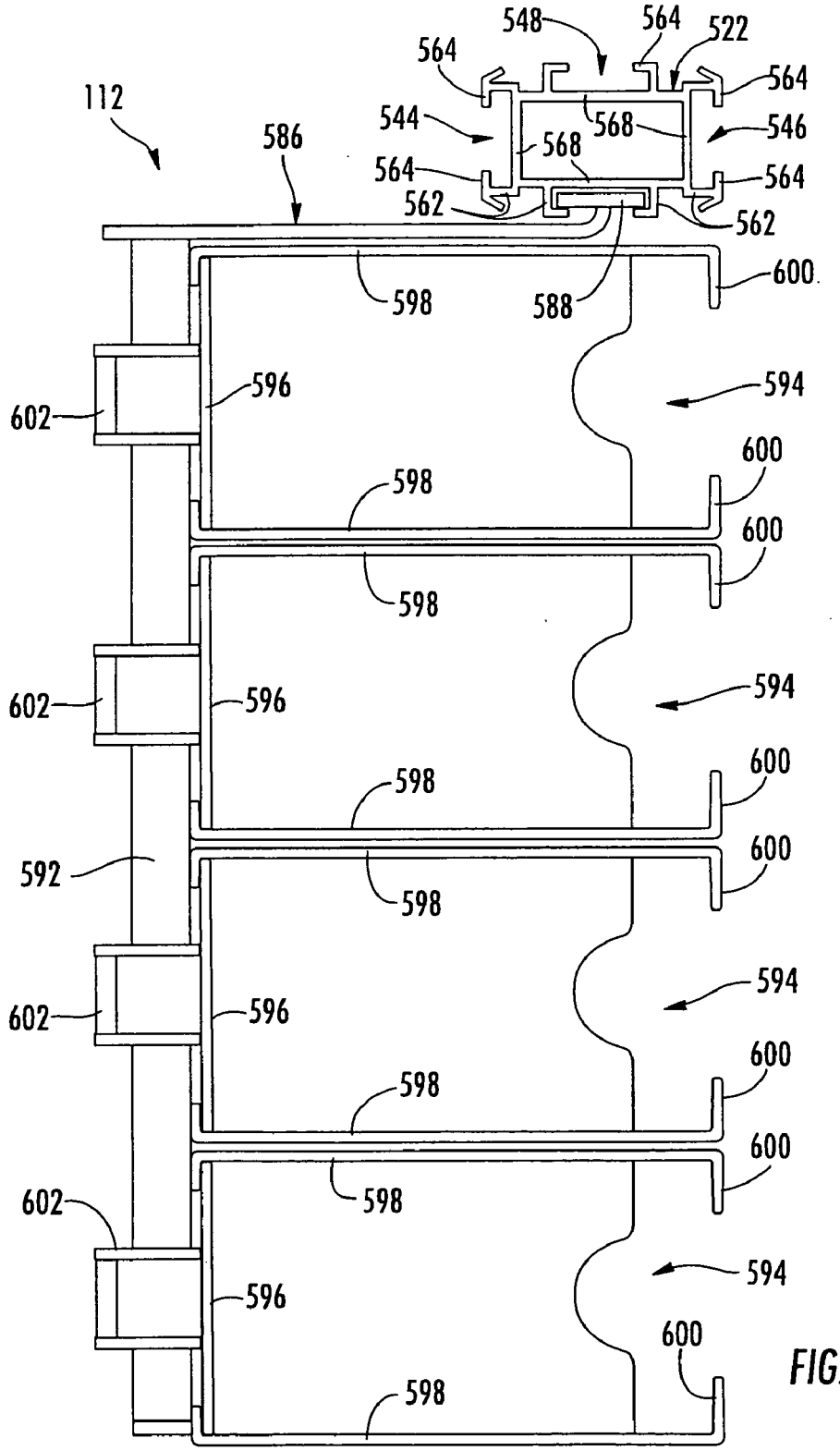
FIG. 74 is a plan view of the dispenser and utility pole of FIG. 72.

Utility pole 522 includes a rear channel 544, a front channel 546, and a pair of side channels 548 (FIGS. 68–69 and 74). Each of these four channels are used to mount items to utility pole 522. For example, utility pole brackets 530 are attached to utility pole 522 via rear channel 544. The light box 526 depicted in FIG. 68 is attached to utility pole 522 via one of the side channels 548. The literature holder 524 in FIG. 68 is attached to the front channel 546 of utility pole 522. Regardless of which channel an item is attached to on utility pole 522, the method of attaching the item is generally the same. In general, a plate is inserted into one of the channels on utility pole 522. The plate includes one or more threaded screw holes. Because the plate has a width wider than the narrower portion of these channels, the tightening of screws in these threaded screw apertures eventually causes the plate to grip the underside of the channel walls. This secures the item to utility pole 522. A more detailed description of this method of attachment is described below with respect to literature holder 524.

Figure 71:
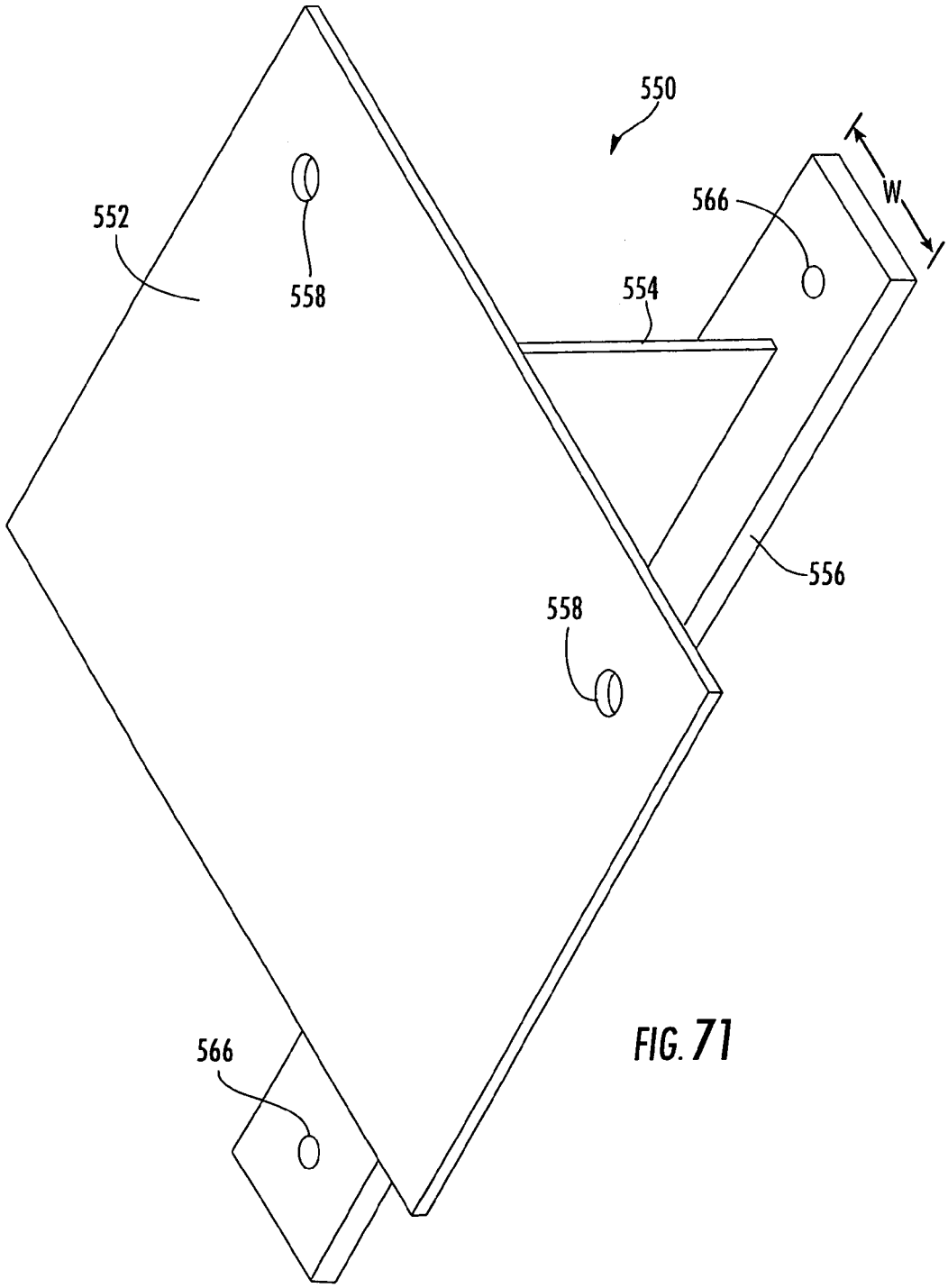
FIG. 71 is a perspective view of a literature holder bracket.
Figure 72:
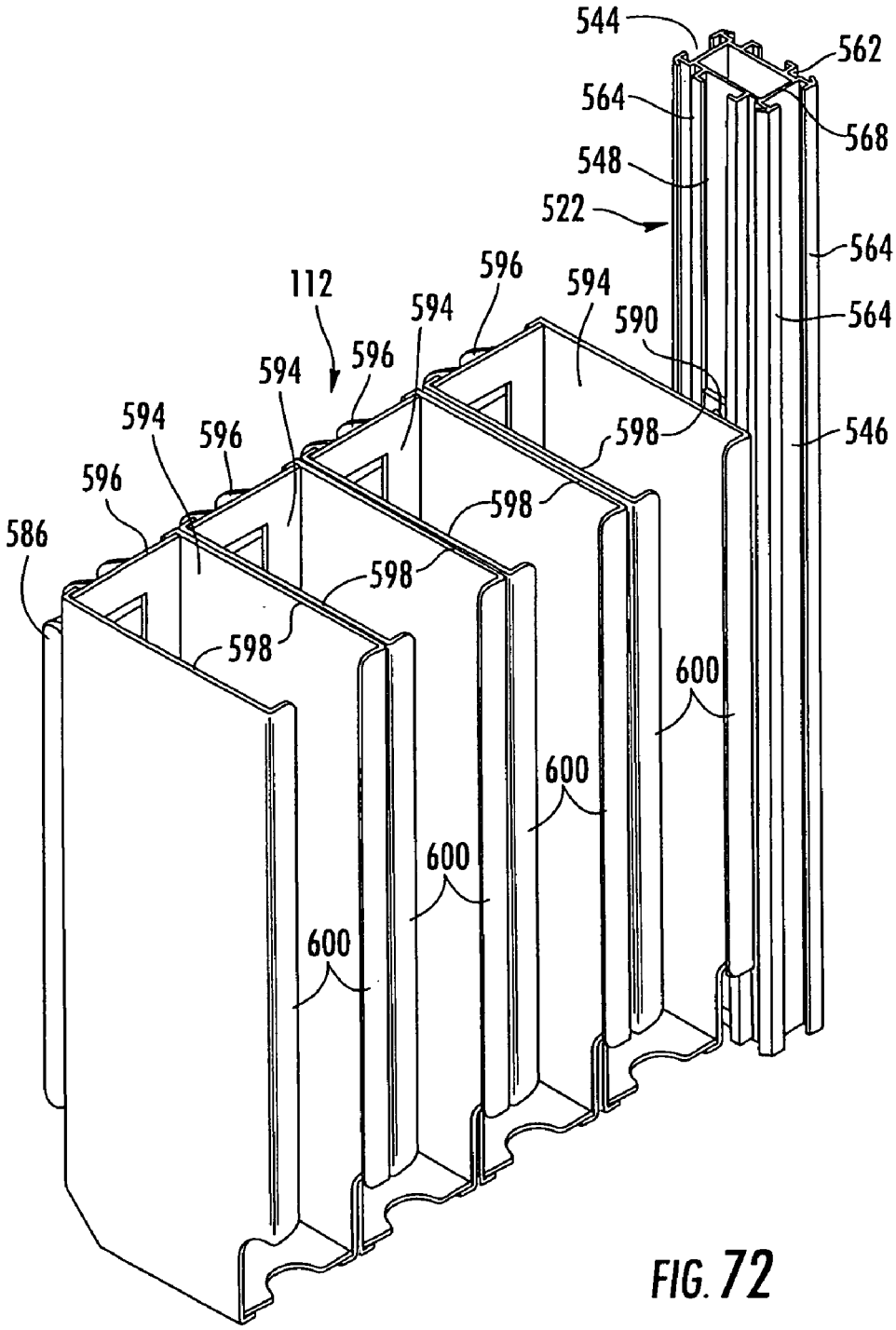
FIG. 72 is a front, perspective view of a gravity fed product dispenser shown attached to the utility pole.

Literature holder 524 is attached to utility pole 522 via a literature holder bracket 550 (FIG. 71). Literature holder bracket 550 includes a front plate 552, a center wall 554, and an elongated attachment plate 556. Front plate 552 includes two attachment holes 558 which are used to secure bracket 550 to literature holder 524. Attachment holes 558 align with a pair of attachment holes 560 defined in the back wall of literature holder 524 (FIG. 68). Screw, rivets, or other fasters can be inserted through each of the attachment holes 558 and 560 to thereby secure literature holder bracket 550 to literature holder 524.

Each channel 544–548 in utility pole 522 is defined by a pair of side walls 562 and horizontal end walls 564 (FIGS. 69 and 74). The distance between side walls 562 is greater than the distance between the innermost ends of horizontal end walls 564. The attachment plate 556 on literature holder bracket 550 has a width W (FIG. 71) that is smaller than the distance between side walls 562, yet larger than the distance between horizontal end walls 564. In order to insert attachment plate 556 into one of the channels 544–548, the attachment plate 556 is slid into the desired channel from either the top end or the bottom end of utility pole 522. Because attachment plate 556 has a width W that is greater than the distance between horizontal end walls 564, it cannot be removed from the channel other than by sliding it out of the top end or the bottom end of utility pole 522.

In order to secure attachment plate 556 at a given location in the selected channel, screws are inserted through a pair of screw holes 566 defined in attachment plate 556 (FIG. 71). Screw holes 566 are threaded holes that extend completely through attachment plate 556. When a screw is inserted into screw hole 556 and rotated, eventually the end of the screw shaft will come into contact with an inner wall 568 on utility pole 522 that defines the bottom of the utility pole channel. As the screw is further tightened, the screw will push attachment plate 556 away from inner wall 568. Eventually, the rotation of the screw will cause attachment plate 556 to come into contact with horizontal end walls 564. By sufficiently tightening the screws and screw holes 566, the frictional contact between attachment plate 556 and horizontal end walls 564 can be increased such that attachment plate 556 no longer can slide in the utility pole channel. In this manner, literature holder bracket 550 can be secured at a desired height on utility pole 522. As mentioned, literature holder bracket 550 can be secured in any of the channels 544–548 of utility pole 522.

Inner bar 534 of utility pole bracket 530 includes an attachment plate 570 that is the same as attachment plate 556 in literature holder bracket 550 (FIG. 69). Specifically, attachment plate 570 includes at least two screw holes into which screws may be inserted. The tightening of these screws forces the attachment plate 570 against the horizontal end walls 564 in the utility pole channel in which attachment plate 570 has been inserted. Tightening of the screws maintains the attachment plate 570 at the desired height along the utility pole 522.

Light box 526 is attached to utility pole 522 in the same manner. Specifically, light box 526 also includes a bracket 572 having an attachment plate 574 attached thereto (FIG. 69). Attachment plate 574 includes a plurality of threaded screw holes which are adapted to receive screws that can be tightened to secure bracket 572 to utility pole 522. Bracket 572 is attached at its other end to a light box support 576. Light box support 576 may be secured to bracket 572 by way of a plurality of screws 578, or other fasteners. Light box support 576 includes two ends 580 having apertures through which a pair of pivot screws 582 are inserted. Pivot screws 582 define a pivot axis about which light box 526 may be pivoted. Light box 526 includes a front panel 584 on which advertising, or other printed material may be displayed. The front panel 584 is preferably made from a material that is at least partially translucent. One or more cold cathode, fluorescent, or other types of lights may be contained within light box 526 to illuminate the advertising, or other printed material, displayed on front panel 584. Light box 526 could alternatively be mounted directly to slot wall 122, rather than utility pole 522, by the use of appropriate brackets. Such brackets would attach to support 576 at one end, and have an upper and lower flange at the other end that could be inserted into slots 202 and 204 in slot wall 122.

Figure 75:
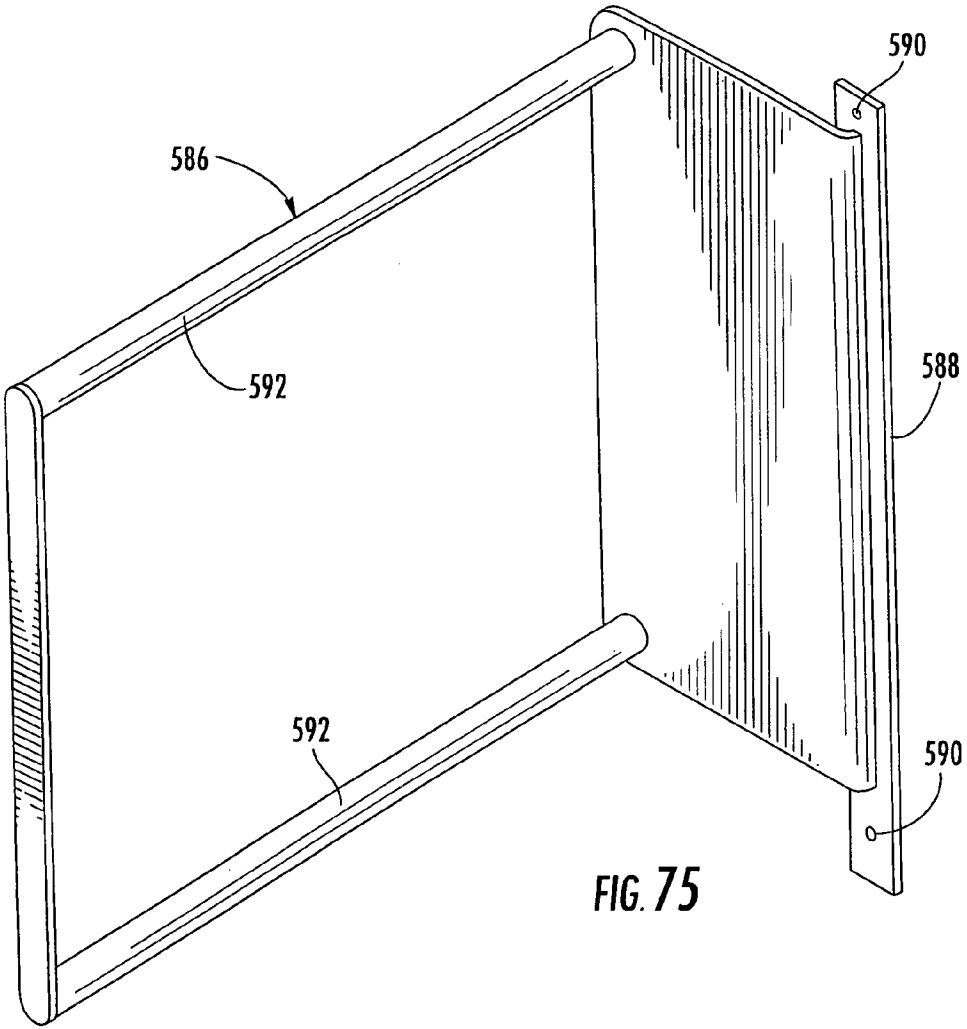
FIG. 75 is a perspective view of the bracket for the gravity fed product dispenser.

As mentioned above, a gravity fed product dispenser 112 may also be attached to utility pole 522. Gravity fed product dispenser 112 is illustrated in more detail in FIGS. 72–74. Gravity fed dispenser 112 is attached to utility pole 522 by way of a dispenser bracket 586 (FIGS. 74–75). Dispenser bracket 586 includes an attachment plate 588 having a pair of screw holes 590. Attachment plate 586 and screw holes 590 operate in the same manner as attachment plate 556 and screw holes 566 of literature holder bracket 550. Attachment plate 588 can thus be inserted into any one of the channels 544–548 in utility pole 522 and secured therein by way of the tightening of screws in screw holes 590. Dispenser bracket 586 further includes a pair of support arms 592. Support arms 592 support the body of product dispenser 112.

Figure 73:
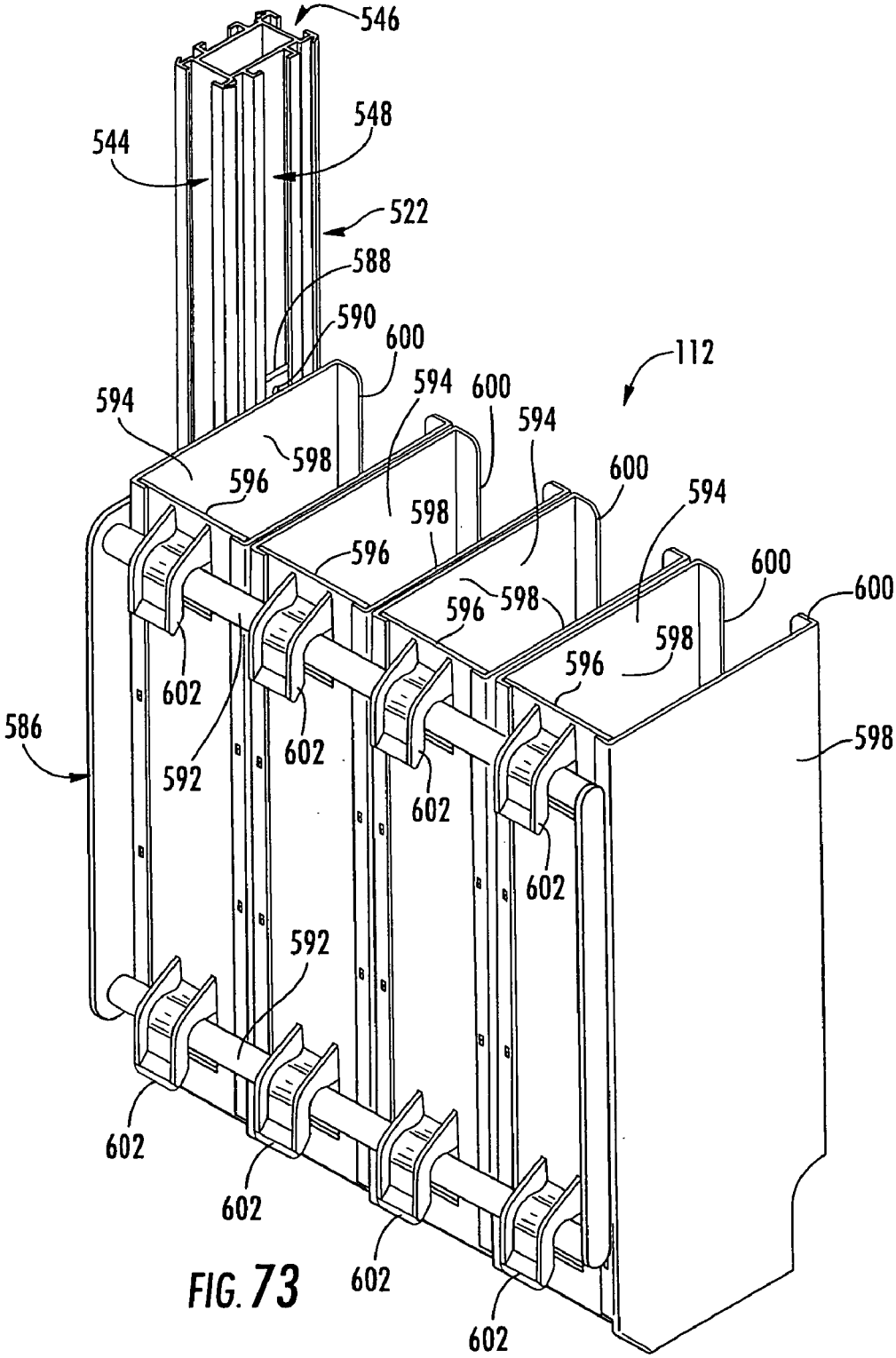
FIG. 73 is a rear, perspective view of the gravity fed, product dispenser and utility pole of FIG. 72.

Product dispenser 112 is comprised of a plurality of vertical channels 594 that are each defined by a back wall 596 and a pair of side walls 598. Each vertical channel 594 is adapted to receive and hold a vertical stack of products. The product dispenser 112 depicted in FIGS. 72–74 is specifically designed for holding packs of cigarettes. Each side wall 598 includes a front wall 600 at the front end of the vertical channels 594. Front walls 600 are bent inwardly sufficiently far to prevent product from being moved into and out of channels 594 through the space defined between two adjacent front walls 600. In order to fill a channel 594 with product, the product is dropped into the channel 594 from above. A customer can remove a product from channel 594 by grasping the bottom most one of the products in a given stack within channel 594 and pulling it forwardly. Forward movement of the product is not prevented in this bottom area because front walls 600 terminate above this bottom area. After a consumer has removed a desired number of products, the remaining products fall down to the bottom of the channel 594. The force of gravity thus ensures that a product will always be positioned adjacent the bottom area of the vertical channel 594 whenever there are products in channel 594.

The side walls 598 and back wall 596 that define each channel 594 are supported on support arms 592 by way of a pair of hooks 602 (FIGS. 73–74). Each hook 602 fits over one of the support arms 592. The hook 602 may be partially flexible such that they must be flexed before sufficient clearance is provided for support arms 592. In this manner, hooks 602 provide a certain amount of resistance to simply lifting dispenser 112 off of support arms 592. In order to remove dispenser 112 from support arms 592, the hook 602 must be partially flexed to allow sufficient clearance for support arms 592 to move out of hook 602. Bracket 586 may be constructed such that support arms 592 have different lengths than that depicted in FIG. 73 and 74. If support arms 592 are constructed to be longer than that depicted in these drawings, additional vertical channels 594 defined by a pair of side walls 598 and a back wall 596 can be attached to support arms 592. If support arms 592 are constructed to be shorter than that illustrated, one or more of the vertical channels 594 can be removed. The user of display stand 100 thus has the option of implementing a gravity dispenser 112 of different sizes on the display stand 100.

Figure 76:
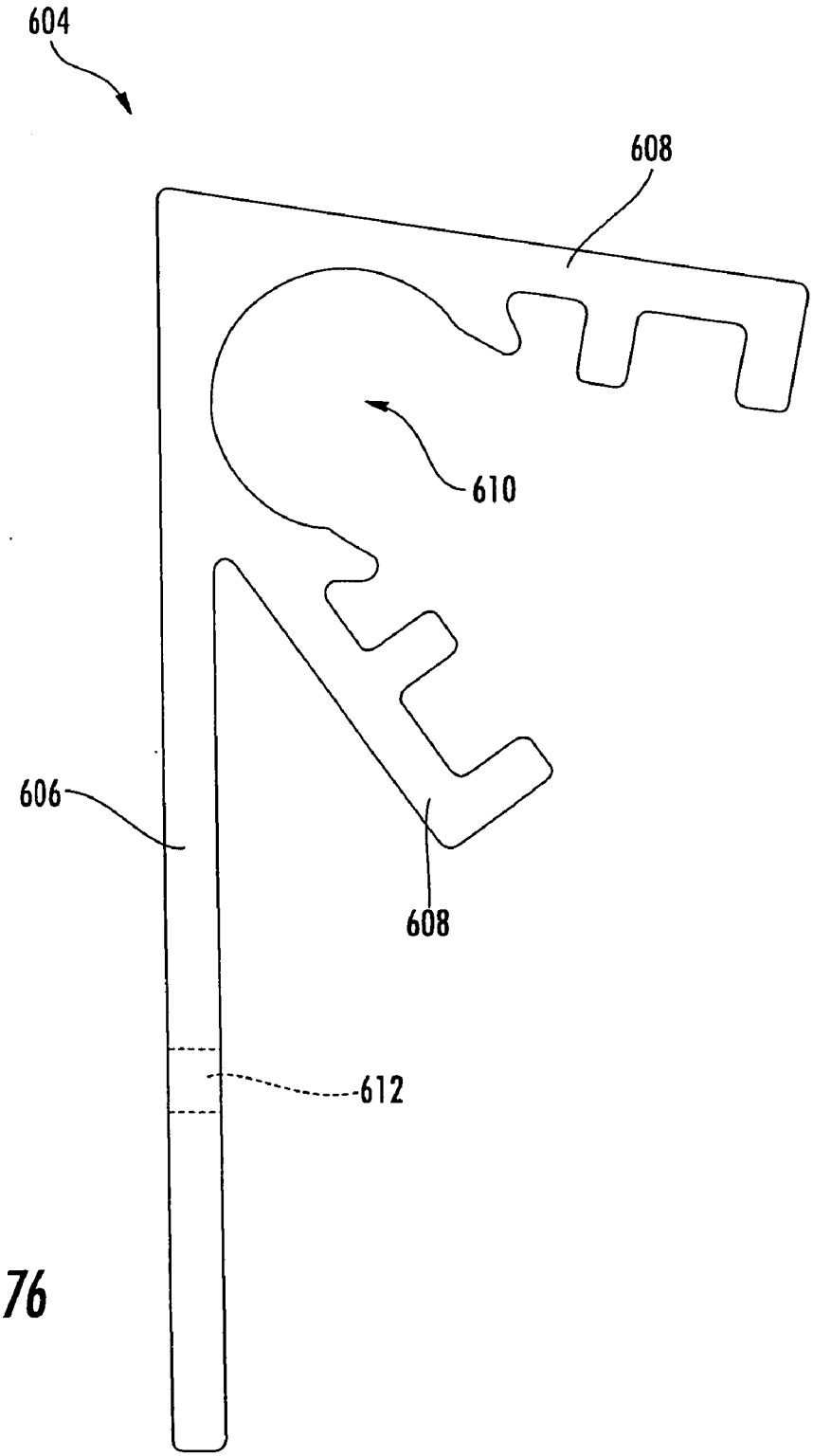
FIG. 76 is a side, elevational view of a shelf light support.
Figure 77:
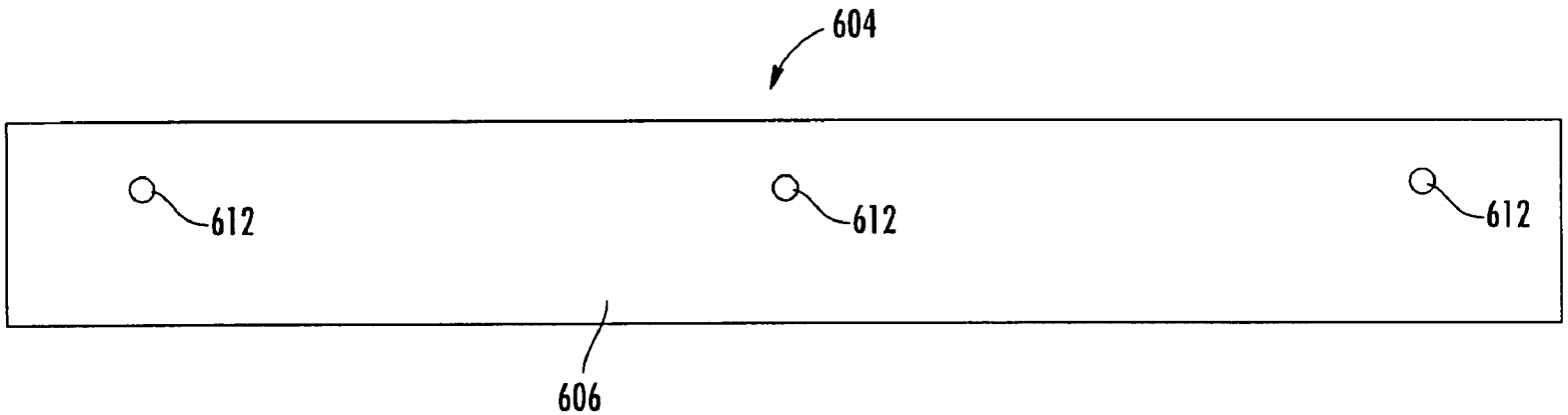
FIG. 77 is a plan view of the shelf light support of FIG. 76.

In some instances it may be desirable to provide more lighting to display stand 100 than that provided by the lights held up by light brackets 116. As has been described, light brackets 116 are positioned near the top of display stand 100. The light from the lights in these brackets therefore may not illuminate all of the products on display stand 100, particularly those products positioned near the bottom of display stand 100. In order to provide additional lighting for the products on display stand 100, one or more shelf lights may be added to display stand 100. These shelf lights are attached to display stand 100 by way of a shelf light support 604 that attaches to the underside of a shelf base 326. One of such shelf light supports 604 is depicted in FIGS. 76 and 77. Shelf light support 604 includes a top wall 606 and a pair of arms 608. A cylindrical recess 610 is defined in shelf light support 604 near the intersection of arms 608 with top wall 606. Cylindrical recess 610 provides a space for securing a cold cathode light, a fluorescent light bulb, or another suitable type of light to shelf light support 604. One or more fixtures (not shown) may be attached between arms 608 in order to fully secure the light bulb in cylindrical recess 610.

Top wall 606 includes a plurality of fastener apertures 612 which are used to secure shelf light support 604 to the underside of a shelf base 326. Specifically, a screw may be inserted into the two outer most fastener apertures 612 in support 604 and into each of the side screw bosses 414 defined in shelf base 326. The screws, or other fasteners, inserted through apertures 612 into bosses 414 thereby secure shelf light support 604 to the underside of shelf base 326. Shelf light support 604 may be secured to the underside of shelf base 326 such that wall 606 extends rearwardly from arms 608. Arms 608 thus conceal the light bulb or light source from direct viewing by the customers. The light from the bulb or source shines generally downwardly and illuminates the products disposed underneath shelf light support 604. Caps may be provided at either end of shelf light support 604 to further conceal from view the light bulb or source and its associated structures.

Figure 79:
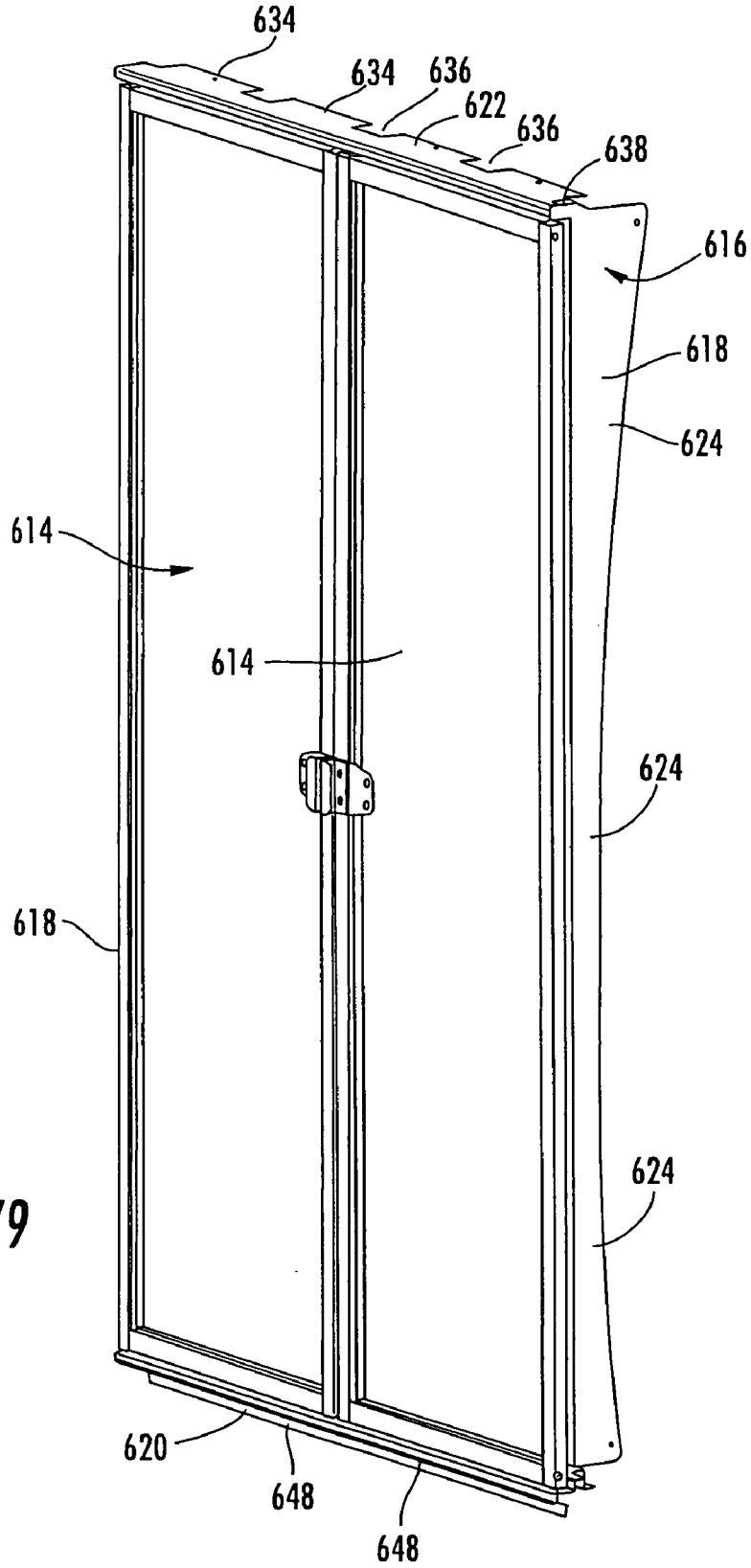
FIG. 79 is a perspective view of a pair of security doors.

While not illustrated in the embodiment of display stand 100 depicted in FIG. 1, a pair of security doors 614 may be added to display stand 100. Security doors 614 are depicted in more detail in FIG. 79. Security doors 614 are positioned in front of the entire display stand 100 and prevent access to any of the products on display stand 100 without opening one or more of the security doors 614. Security doors 614 are housed within a frame 616 that is made up of two side members 618, a bottom member 620, and a top member 622. Each side member 618 includes a plurality of fastener apertures 624 which receive suitable fasteners for attaching side members 618 to one of the end panels 102. Such fasteners may be screws, rivets, or any other suitable fastener. Side members 618 are thus spaced apart a distance equal to the horizontal separation between end panels 102.

Figure 24:
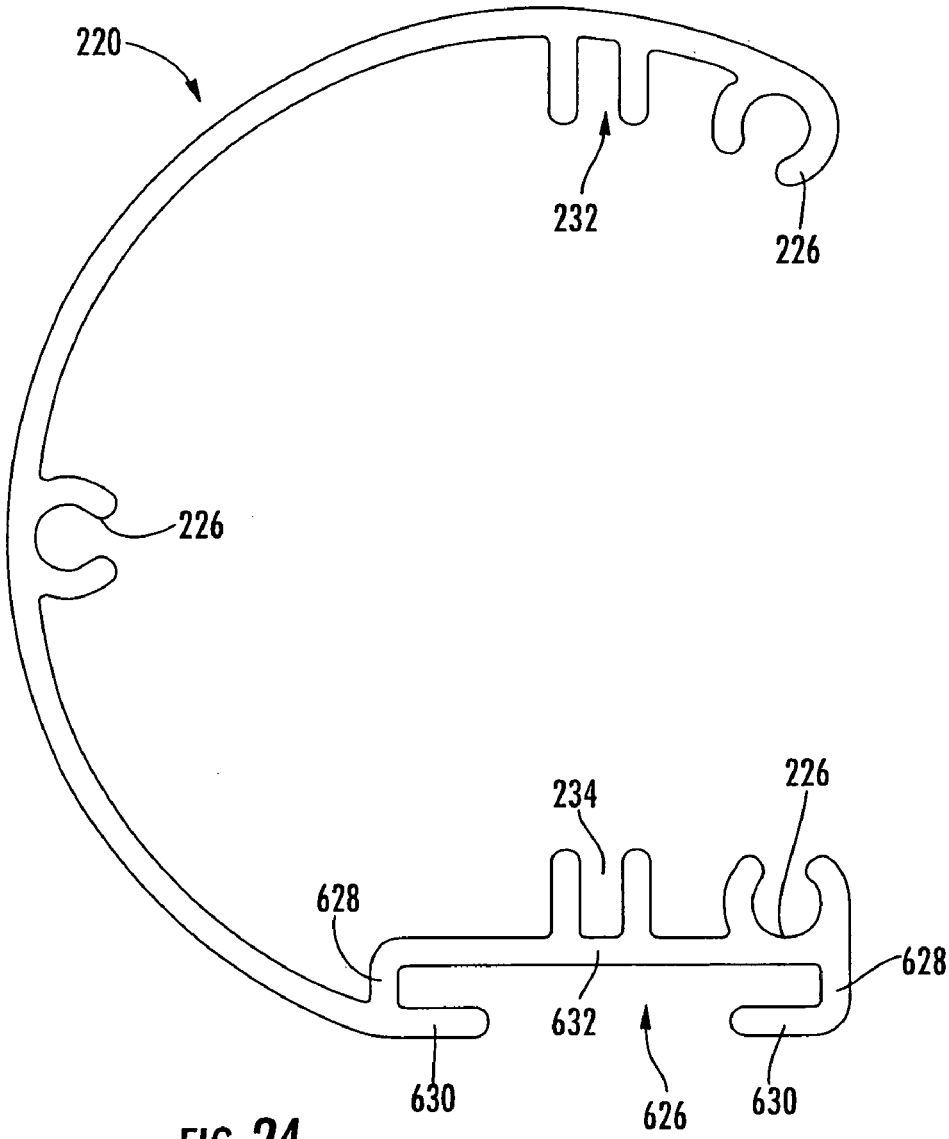
FIG. 24 is a side, elevational view of a light bar for the light bracket of FIG. 20.

Top member 622 is secured to the underside of horizontal light bars 220. As illustrated more clearly in FIG. 24, light bar 220 includes a bottom channel 626 that is defined by two side walls 628, two horizontal front walls 630, and a back wall 632. Top member 622 is secured in bottom channel 626 by way of a suitable number of tap plates 266. More specifically, top member 622 includes a plurality of upper fastener apertures 634 which are unthreaded and which receive screws, each of which is inserted into a single tap plate 266. The tap plates 266 used to secure top member 622 in bottom channel 626 have a width W that is less than the distance between the inner edges of front wall 630. These tap plates 266 also have a length L that is greater than the distance between the inner edges of front wall 630, but less than the distance between side wall 628. Thus, the tap plates 266 can be inserted into bottom channel 626 when their length dimension is oriented parallel to the longitudinal extent of bottom channel 626. Once a screw is inserted into the aperture in tap plate 266 and the screw is initially rotated, tap plate 266 will rotate 90° until its square corners 278 contact side walls 628. Thereafter, further rotation of the screws will not cause any further rotation of the tap plate 266. As the screws are rotated more and more, the front walls 630 of channel 626 become more and more sandwiched between tap plates 266 and the upper wall of top member 622 in which upper fastener apertures 634 are defined. By sufficient tightening of the screws, top member 622 can be secured to bottom channel 626 in light bar 220.

Figure 80:
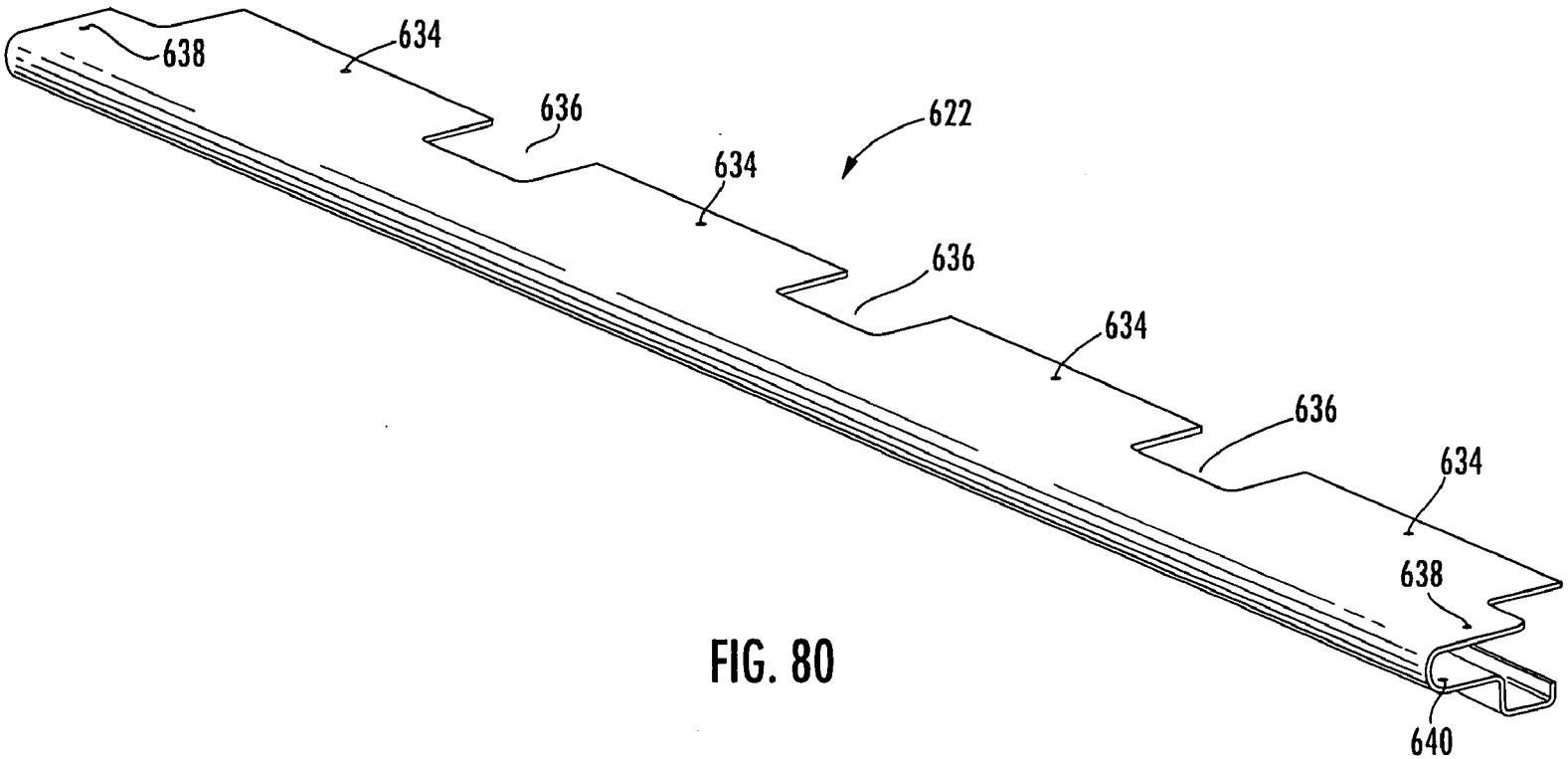
FIG. 80 is a perspective view of a top member of the security door frame.

As illustrated in FIG. 80, top member 622 includes a plurality of cut outs 636. Cut outs 636 provide clearance for light brackets 116. Top member 622 further includes two side fastener apertures 638 which receive a suitable fastener used to secure top member 622 to each side member 618. A pivot hole 640 is also defined in top member 622. Pivot hole 640 provides a place for inserting a pivot pin attached to one of the doors 614 to thereby allow the doors to pivot open about a vertical axis.

Figure 81:
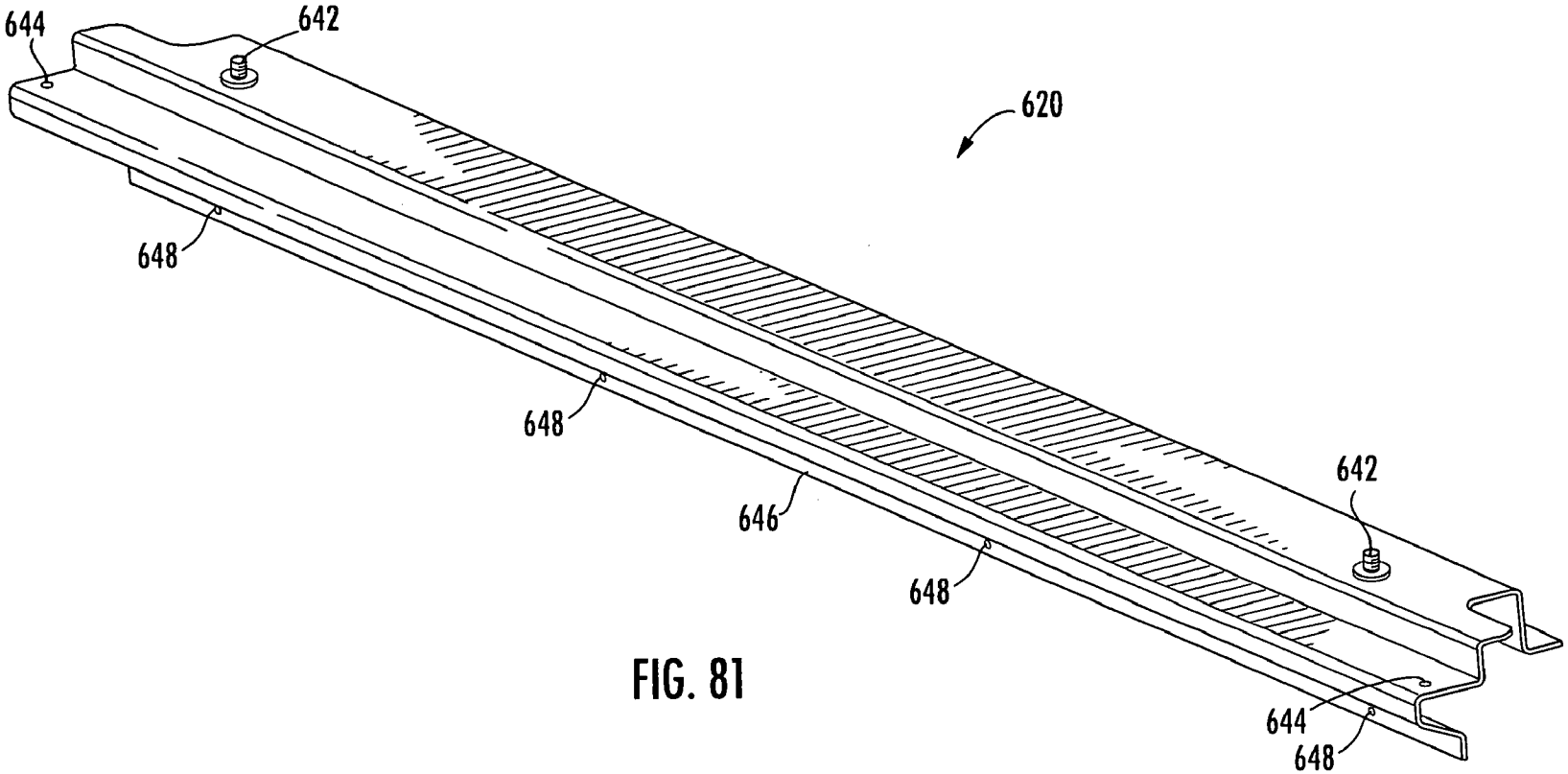
FIG. 81 is a perspective view of a bottom member of the security door frame.

Bottom member 620 of frame 616 is illustrated in more detail in FIG. 81. Bottom member 620 includes a pair of pivot pins 642 that are vertically aligned with the pivot holes 640 defined in top member 622. Pivot pins 642 insert into the security door 614 and define the vertical pivot axis about which security doors 614 may rotate. Bottom member 620 further includes a pair of side fastener apertures 644 which receive suitable fasteners for attaching bottom member 620 to each side member 618. Bottom member 620 further includes a bottom flange 646 in which a plurality of attachment apertures 648 are defined. Attachment apertures 648 are used to secure the bottom member 620 to front rail 148 of base 120. As illustrated in FIGS. 12 and 13, front rail 148 includes a plurality of fastener apertures 650 which are aligned with the attachment apertures 648 on bottom member 620. Screws, or other appropriate fasteners, can thus be inserted through attachment apertures 648 and into fastener apertures 650 to thereby secure bottom member 620 to front rail 148.

The security doors 614 may include locks which allow them to be selectively locked. These security doors 614 may also be constructed to have different heights and widths to allow them to be attached to display stand 100 having different sizes. When security doors 614 are attached to the front of display stand and lock, access to the products in display stand 100 is prevented with the exception of the openings defined by, and surrounded by, light brackets 116, light bar 220, and back wall 118. These openings are confined to the top portion of display stand 100 and normally cannot be accessed without some kind of vertical assistance. There is therefore very limited access to the contents of display stand 100 in this situation. If it is desired to completely block access to the contents of display stand 100, covers may be added in these spaces and secured to light brackets 116 and back wall 118.

Figure 82:
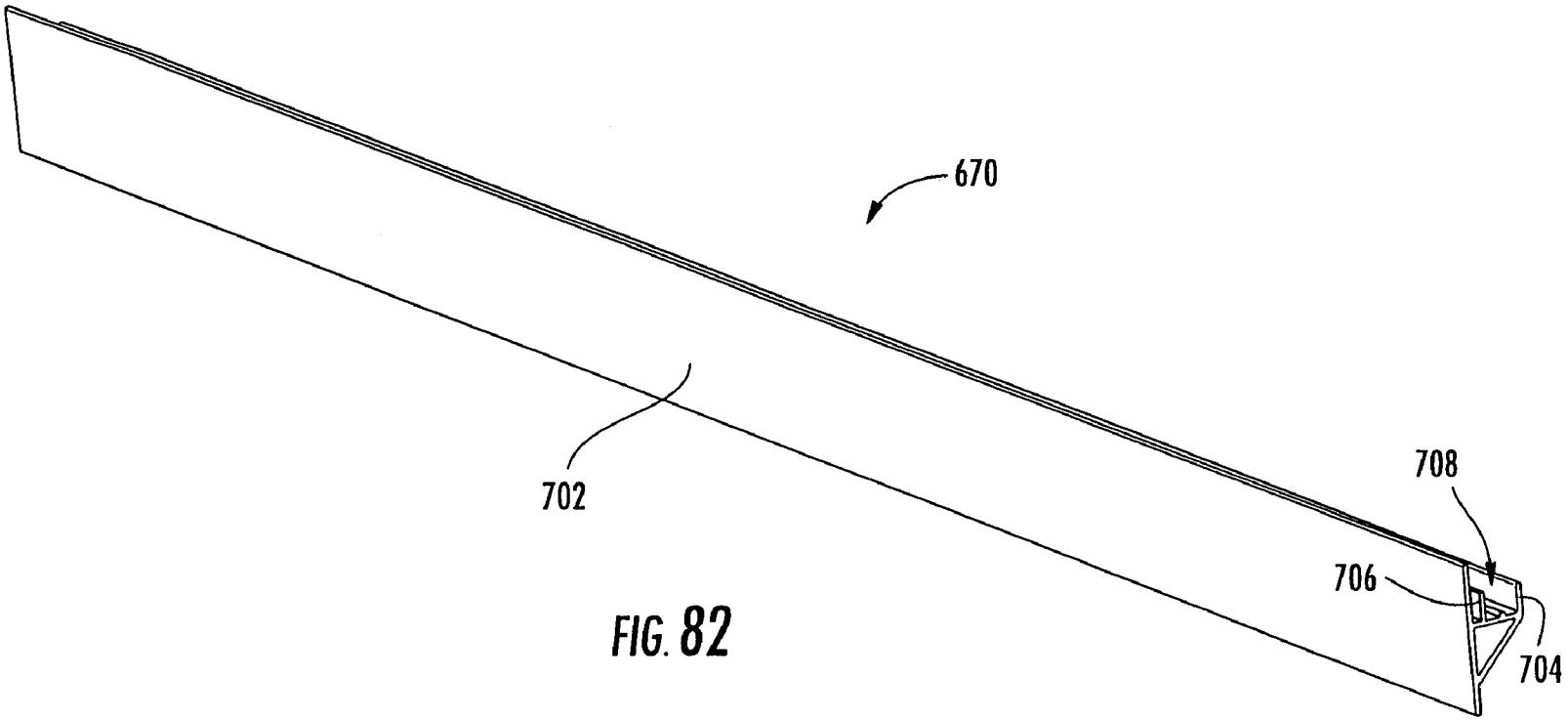
FIG. 82 is a perspective view of a rear, bottom track segment for sliding doors.
Figure 88:
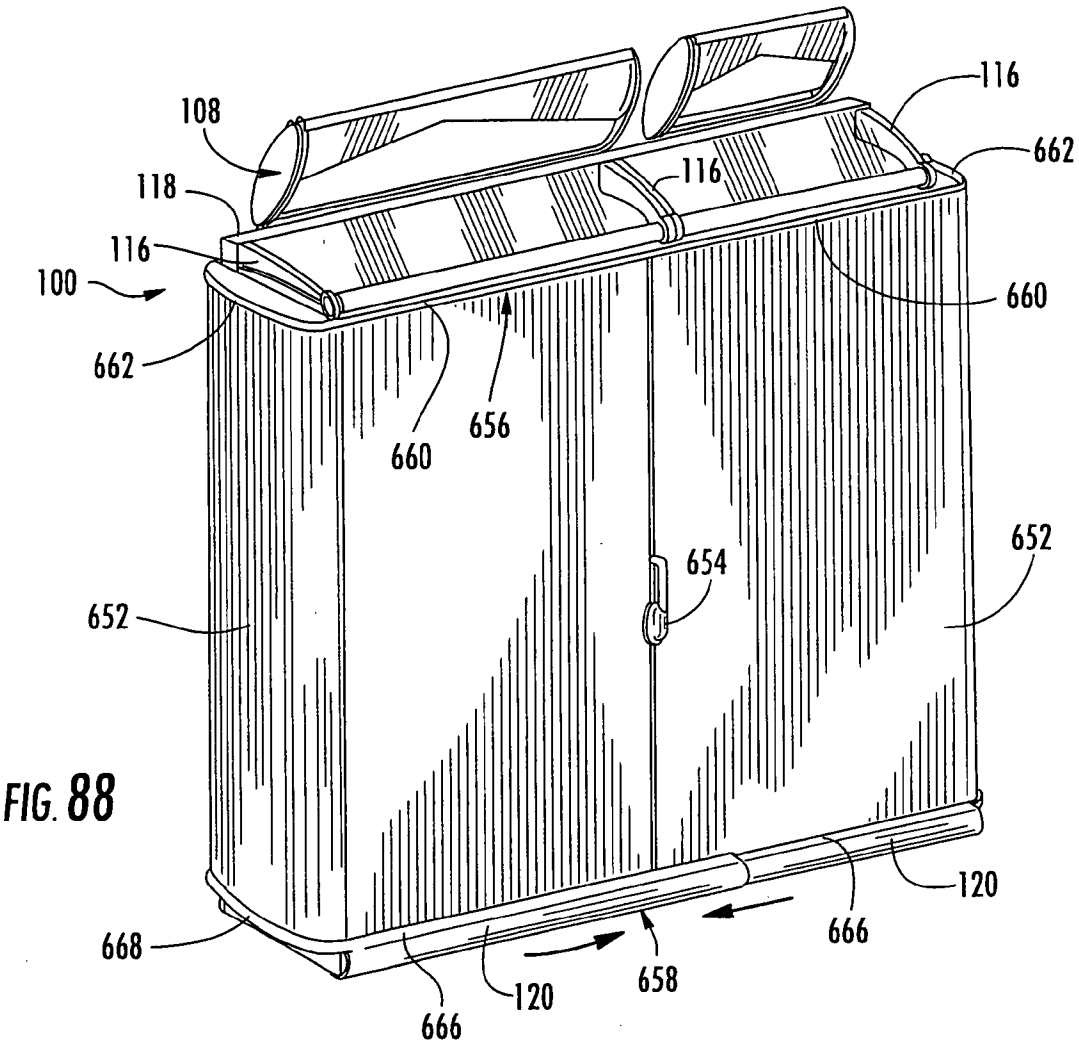
FIG. 88 is a perspective view of the display stand illustrating sliding doors attached in their closed position.
Figure 89:
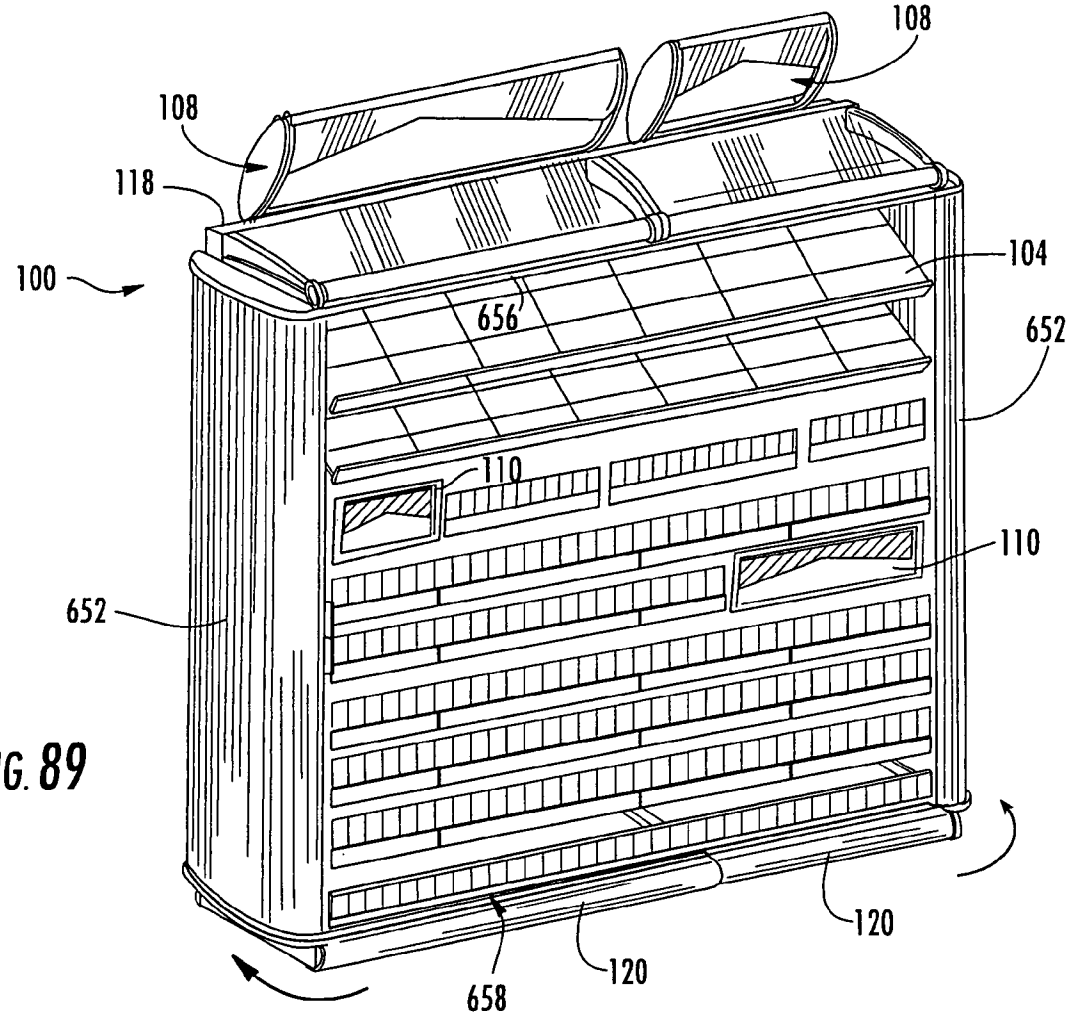
FIG. 89 is a perspective view of the display stand illustrating sliding doors attached and moved to an open position.

As an alternative to the security doors 614, a user of display stand 100 may elect to utilize a set of sliding doors 652, such as the sliding doors 652 depicted in FIGS. 88 and 89. FIG. 88 depicts the sliding doors slid to a closed position in which they may be locked together via a lock 654. FIG. 89 depicts the sliding doors 652 slid to an open position in which the bulk of the sliding door 652 is positioned behind display stand 100, thereby allowing access to the front side of display stand 100. The sliding doors 652 may be tamboured doors, or any other type of door that can be slid in a set of upper and lower tracks. In the configuration of display stand 100 illustrated in FIGS. 88 and 89, an upper track 656 and a lower track 658 are provided to guide the sliding movement of sliding door 652. Upper track 656 is specifically made up of a pair of front upper track segments 660, a pair of side upper track segments 662, and a pair of rear upper track segments 664. Similarly, lower track 658 is made up of a pair of front lower track segments 666, a pair of side lower track segments 668, and a pair of rear lower track segments 670. A rear upper track segment 664 is depicted in FIG. 83 and a rear lower track segment 670 is depicted in FIG. 82.

Figure 5:
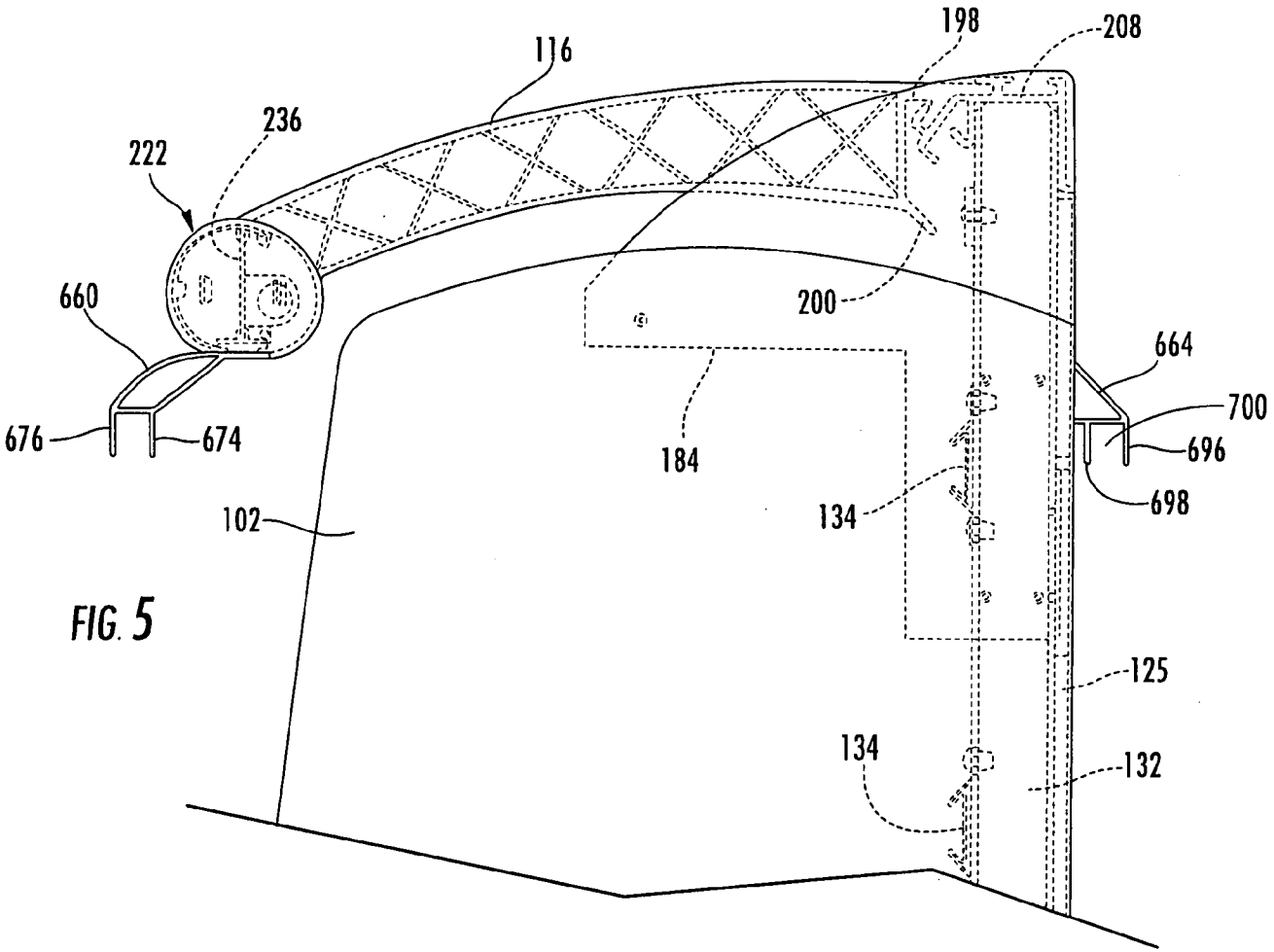
FIG. 5 is a partial, elevational view of the upper portion of the components of FIG. 4.
Figure 85:
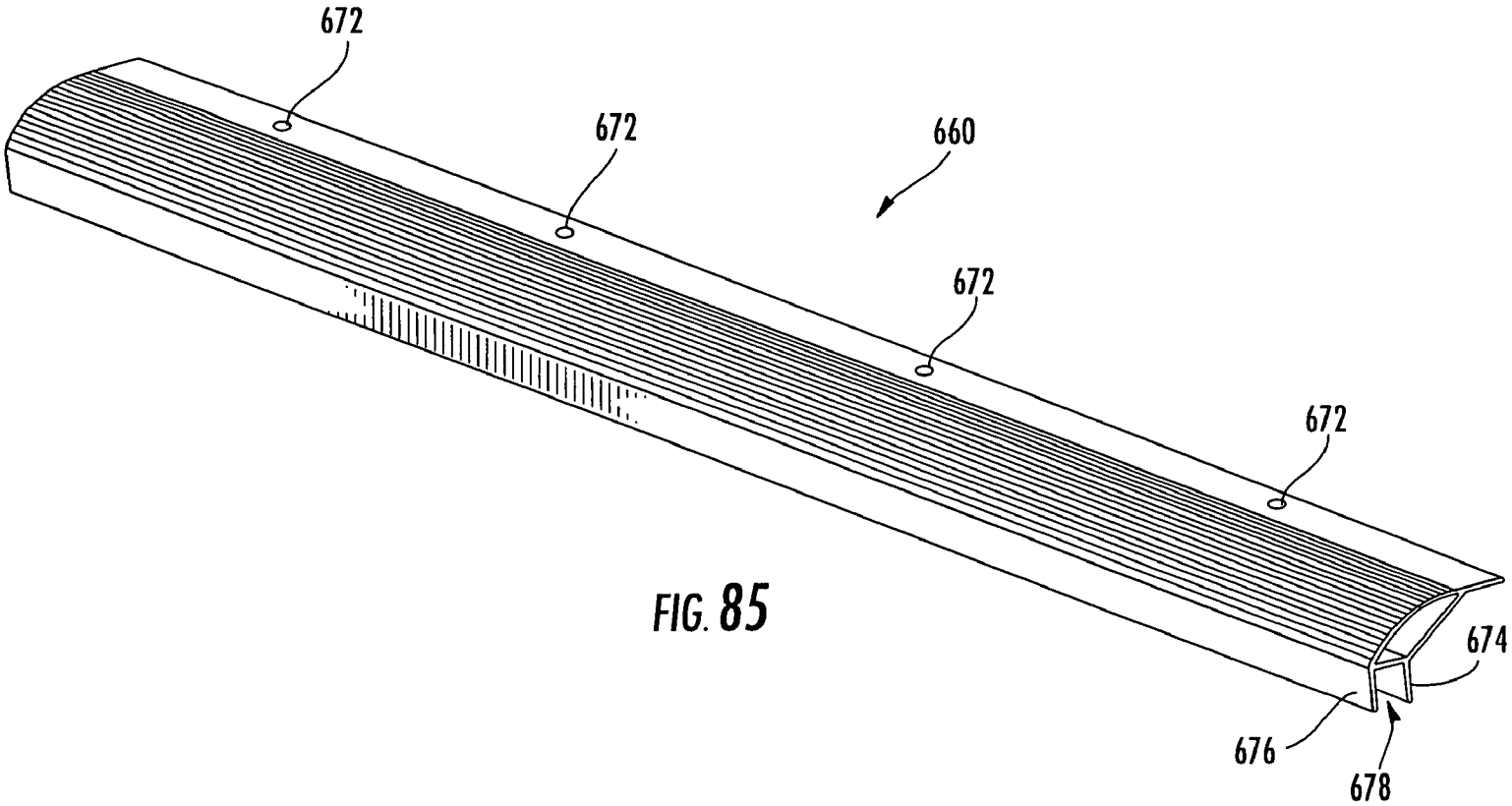
FIG. 85 is a perspective view of a front, top track segment for the sliding doors.

Each front upper track segment 660 is secured to the underside of light bar 220 in the same manner that top member 622 of door frame 616 is secured. FIG. 5 illustrates a side view of a front upper track segment 660 shown attached to a light bar 220. Front upper track segment 660 includes a plurality of fastener apertures 672 which receive screws that are inserted into a plurality of taps plates 266 (FIG. 85). Tap plates 266 are inserted into the bottom channel 626 of light bar 220 and secured therein in the manner that has been previously described with respect to top member 622. Front upper track segment 660 further includes an inner vertical wall 674 and an outer vertical wall 676. Inner and outer vertical walls 674 and 676 are spaced apart from each other and define a channel 678. Channel 678 provides a track or raceway in which the upper ends of sliding doors 652 may slide. Front upper track segment 660 may include a plurality of cut outs, similar to cut outs 636 in top member 622, to accommodate light brackets 116.

Figure 84:
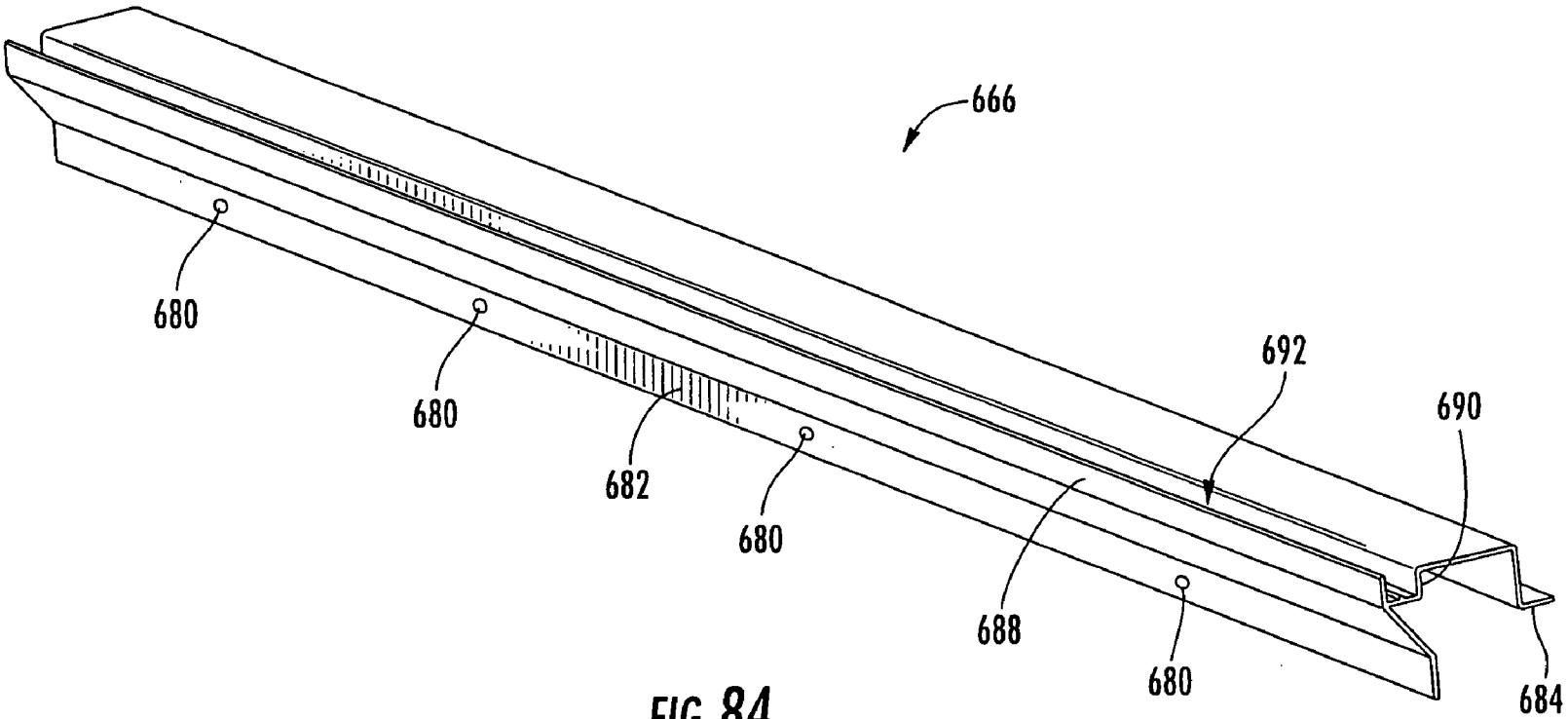
FIG. 84 is a perspective view of a front, bottom track segment for the sliding doors.

Each front lower track segment 666 includes a plurality of fastener apertures 680 defined in a bottom wall 682 (FIG. 84). Fastener apertures 680 receive screws, or other suitable fasteners, which are then inserted into fastener aperture 650 defined in front rail 148 of base 120. These screws, or other fasteners, thereby secure front lower track segment 666 to front rail 148. Front lower track segment 666 further includes a rear horizontal wall 684 that extends for the length of segment 666. Rear horizontal wall 684 is positioned on top of a horizontal step 686 defined in the stepped back 180 of front rail 148 (FIGS. 6 and 18). Front lower track segment 666 further includes an outer vertical wall 688 and an inner vertical wall 690. Outer and inner wall 688 and 690 are spaced apart from each other to define a channel 692 therebetween. Channel 692 provides a track or raceway for the bottom edge of sliding door 652 to slide in. The attachment of front lower track segment 666 to front rail 148 is illustrated in more detail in FIG. 6.

Figure 83:
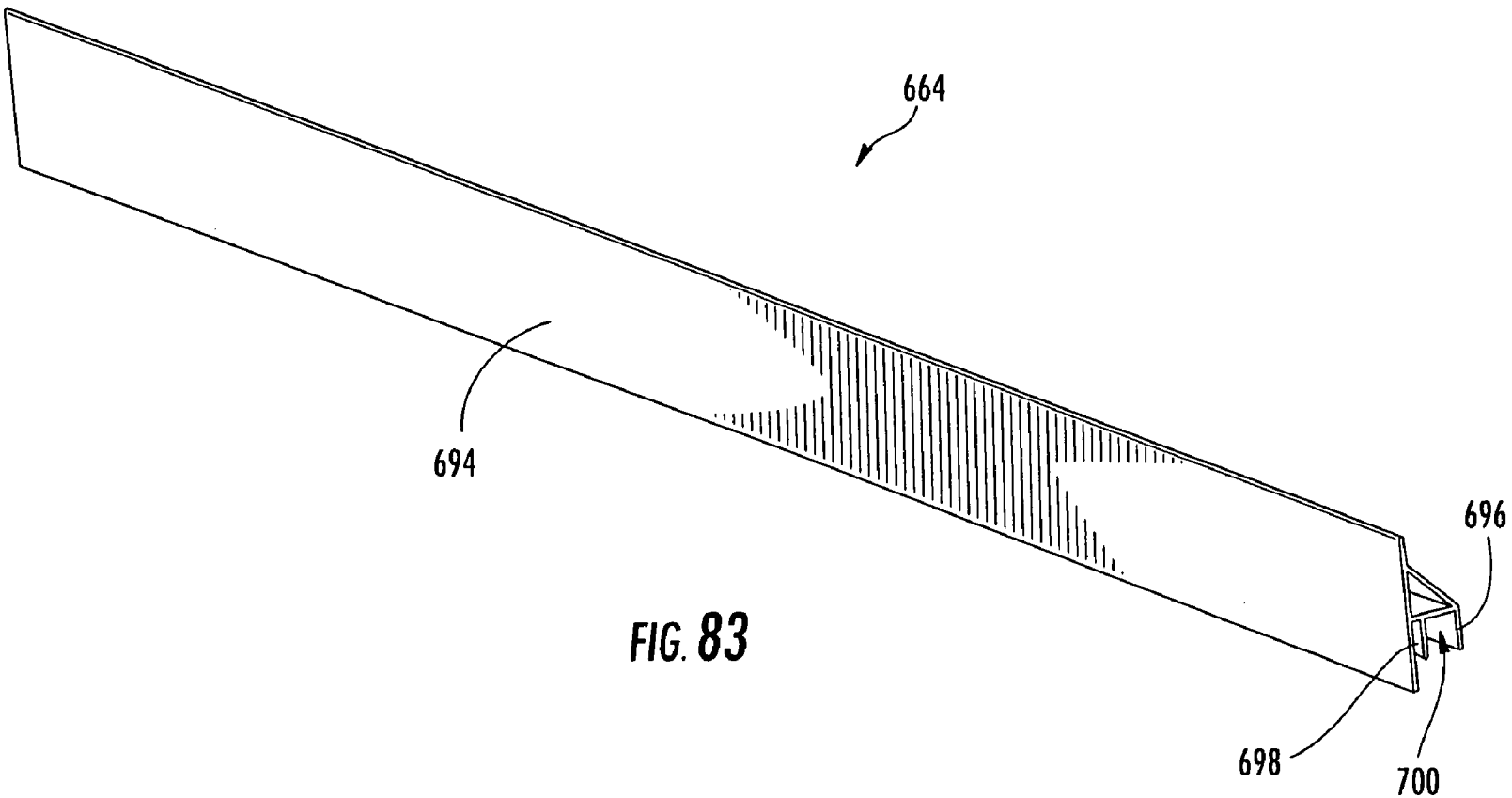
FIG. 83 is a perspective view of a rear, top track segment for the sliding doors.

Rear upper track segment 664, which is depicted in more detail in FIG. 83, includes a back wall 694 to which is attached an outer vertical wall 696 and an inner vertical wall 698. Inner and outer vertical wall 698 and 696 are spaced apart from each other to thereby define a channel 700. Channel 700 provides a track or raceway for the upper end of sliding doors 652 when they have been slid behind display stand 100. Wall 694 of segment 664 is attached to the back of back wall 118 by any suitable method. FIG. 5 illustrates segment 664 attached to back wall 118.

Rear lower track segment 670, which is depicted in more detail in FIG. 82, includes a wall 702 which is attached to an outer vertical wall 704 and an inner vertical wall 706. Outer and inner vertical walls 704 and 706 are spaced apart from each other to thereby define a channel 708. Channel 708 provides a track or raceway for the bottom edges of sliding door 652 when they have been slid behind display stand 100. Wall 702 may be secured to the back side of back wall 118 in any suitable manner. FIG. 6 illustrates segment 670 secured to the back side of back wall 118.

Upper side segments 662 and lower side segments 668 may be secured to end panels 102 or feet 146 in any suitable fashion. Each of the side segments 662 and 668 include a channel that is curved and aligned with the channels defined in track segments 660, 664, 666, and 670. Thus, the channels in upper track segments 660–664 are all aligned with each other and provide a smooth channel for the sliding movement of the upper edge of sliding door 652. Similarly, the channels defined in lower track segments 666–670 are all aligned with each other to provide a continuous and smooth channel for the movement of the lower edge of sliding door 652.

In order to provide electrical power to display stand 100, an electrical box (not shown) may be attached to the back side of back wall 118 in any suitable location. The electrical box 118 preferably would include one wire for insertion into a standard 110 volt electrical wall outlet. Electrical power would thereby be delivered to the electrical box. The electrical box would preferably include at least three separate outlets for delivering power. A first outlet would allow 110 volt power to be drawn from the electrical box for adjacent sections of display stand 100. For example, if display stand 100 is made up of multiple bases 120, each having a slot wall 122 attached, each of these sections may be plugged in to the electrical box on the back of the first section. Electrical power can thereby be delivered to multiple sections in a daisy chain type of fashion. The second outlet on the electrical box is preferably a 110 volt, AC outlet which runs wires to the lights in tops signs 108.

Figure 87:
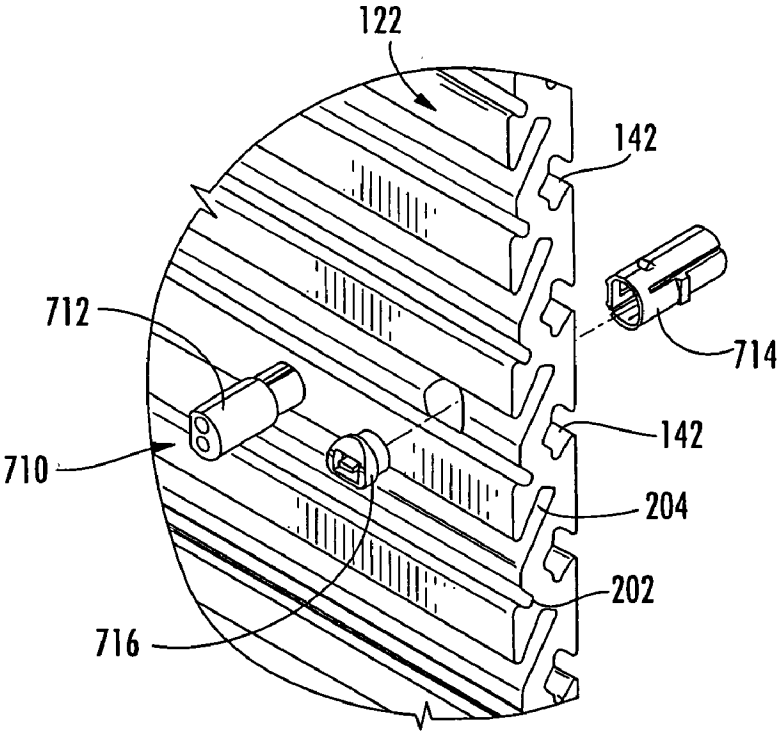
FIG. 87 is a partial, perspective, exploded view of the slot wall and electrical outlet illustrating an optional cap for the outlet.
Figure 86:
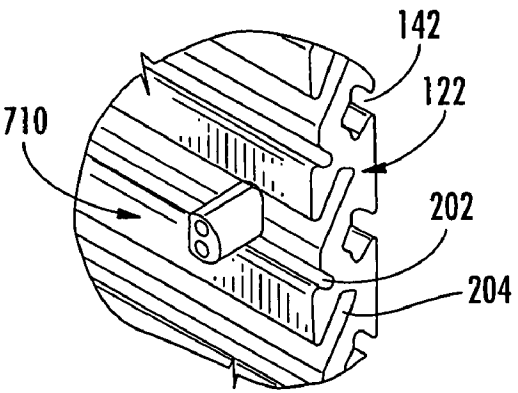
FIG. 86 is a partial, perspective view of the slot wall and an electrical outlet.

The third outlet on the electrical box is preferably a twelve volt DC outlet that is connected to a plurality of DC outlets 710 defined in slot wall 122 (FIGS. 86–87). While not illustrated in FIG. 2, slot wall 122 preferably includes a plurality of apertures evenly spaced about the front face of display stand 100. Into each of these apertures a DC outlet 710 may be inserted. The DC outlet may be accessed to provide electrical power to the shelf lights or the lights in light boxes 526. Each DC outlet 710 may be made of a front section 712 and a rear section 714 that are frictionally held together. Wires may be inserted into front section 712 to run electrical power to one of the aforementioned lights. If a given DC outlet 710 defined in slot wall 122 is not going to be used for a particular configuration of display stand 100, a cap 716 may be inserted into rear section 714. Cap 716 prevents wires from being inserted into rear section 714. Cap 716 also prevents inadvertent contact with the live voltage contacts within rear section 714. As noted above, DC outlets 710 are defined in slot wall 122 throughout the entirety of slot wall 122. While any spacing may be chosen between outlets 710, they may each be horizontally separated and vertically separated from each other by one to two feet.

Figure 90:
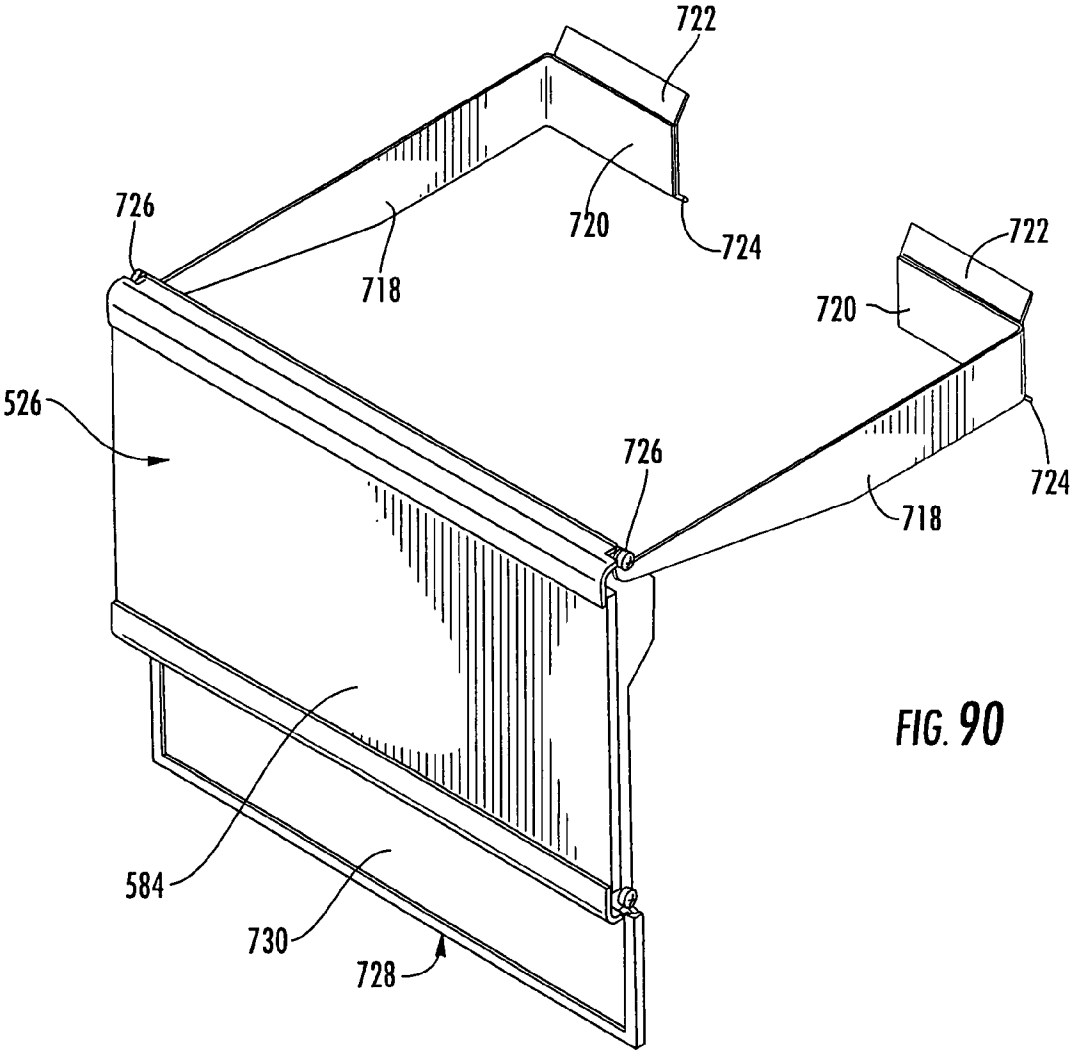
FIG. 90 is a perspective view of a light box and bracket for supporting the light box directly on the slot wall.
Figure 91:
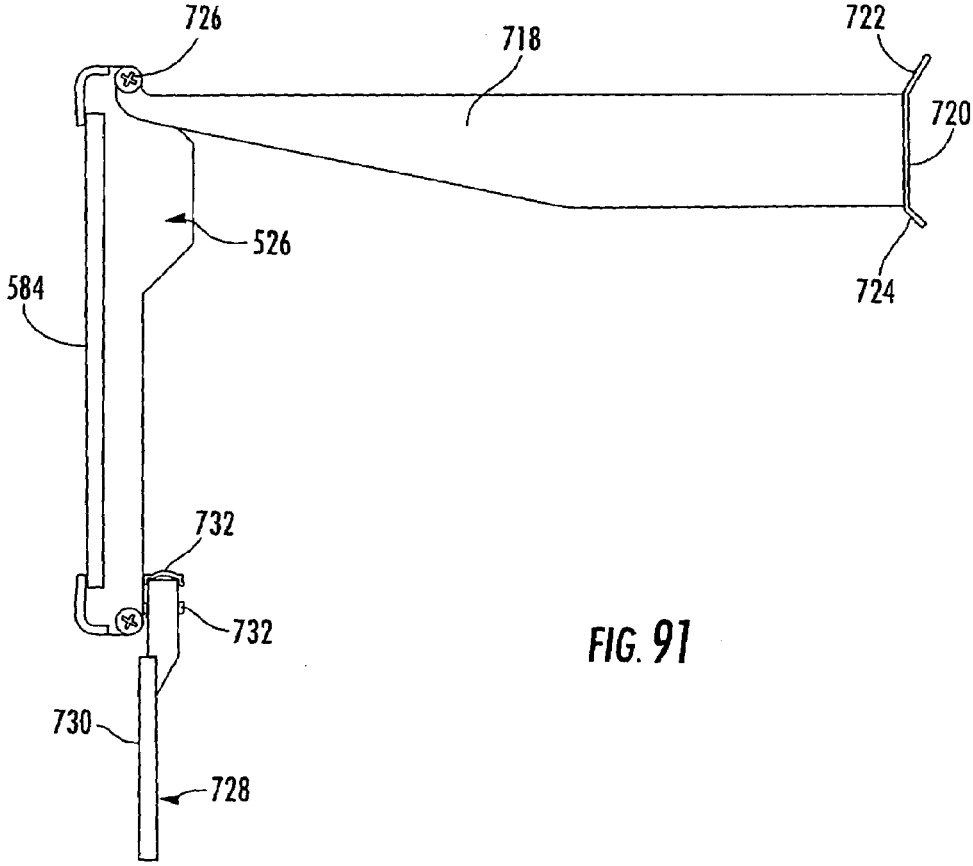
FIG. 91 is a side, elevational view of the light box and bracket of FIG. 90.

Another manner in which light box 526 may be mounted to back wall 118 of display stand 110 is depicted in FIGS. 90 and 91. Light box 526 includes a pair of light box brackets 718 that each have an attachment plate 720 at their back end. Attachment plate 720 includes an upper flange 722 and a lower flange 724. Upper flange 722 is shaped and dimensioned to be received within a large slot 204 defined on slot wall 122. Lower flange 724 is shaped and dimensioned to be received within a small slot 202 defined on slot wall 122. The front end of each light box bracket 718 is attached directly to light box 526 by way of a pair of pivot screws 726. Pivot screws 726 define a pivot axis about which light box 526 may swing. Light box 526 includes a front panel 584 which may display graphics, such as advertising, or other printed indicia. One or more lights may be positioned within light box 526 to provide illumination to front panel 584. An optional sign 728 may be attached to the bottom end of light box 526. Sign 728 may house additional printed material, such as advertising, or the like. It includes a front panel 730 which displays this printed material. Sign 728 may be detached from light box 526. Sign 728 is frictionally retained on light box 526 by inserting a horizontal bar on sign 728 into a pair of locking arms 732 (FIG. 91). Locking arms 732 are flexible and must be flexed in order to insert the horizontal arm on sign 728 therein. Once inserted therein, sign 728 is securely attached to light box 526. Sign 728 may pivot about the horizontal axis defined by the bar locked within locking arm 732.

While the foregoing description and the attached drawings illustrate a number of different signs for displaying printed graphics, these signs could be modified to display electronically generated images. Such modified signs could use Liquid Crystal Displays (LCDs), flat-screen television technology, or other electronic technology to electronically display advertising and/or other graphical information. Such modified signs would preferably be in communication with a controller integrated into display stand 100. The display stand controller would be adapted to communicate with a remote controller that could remotely control and change the content of the images being displayed on the signs. Such communications could be via an Internet connection between the controllers, a direct telephone line between modems associated with each controller, or by any other known means. Such connections to a remote controller would allow easy updates and changes to be made from a centralized location to the advertising used on the display stands. Furthermore, moving images, rather than still images, could also be displayed on the display stand. Speakers could also be added to the display stand to allow it to broadcast audio signals in addition to, or in conjunction with, the visual images displayed on the signs.

While the invention has been described in terms of the embodiments discussed above and illustrated in the accompanying drawings, it will be understood by one skilled in the art that the present invention is not limited to these particular embodiments, but includes any and all such modifications that are within the spirit and scope of the present invention as defined in the appended claims.

What is claimed is:

1. A display stand comprising:

a generally vertical back wall having a front face, a back face, a first side, and a second side, said front face including a plurality of parallel, generally horizontal slots that continuously extend for a majority of the distance from said first side to said second side;

a shelf releasably attachable to said front face of said back wall, said shelf adapted to be selectively inserted into at least one of said slots to thereby support said shelf on said back wall, said shelf being attachable to said back wall at a plurality of different heights and at a plurality of different side-to-side positions between said first and second sides;

wherein said shelf includes a shelf base and a bracket, said bracket including an insert that fits into said at least one of said slots to thereby support said bracket and said shelf base on said back wall, said shelf base including a bracket engaging portion and a wall engaging portion, said bracket engaging portion of said shelf base being adjustably engaged at said bracket, said shelf base being adapted to be adjusted relative to said bracket of said shelf to support said shelf base of said shelf in a selected one of a plurality of different angular orientations relative to said back wall, said wall engaging portion of said shelf base engaging another one of said slots of said back wall when said shelf base is supported at said bracket and said back wall; and a vertical end panel attached to the back wall adjacent each one of the sides of the back wall, said end panel being oriented generally perpendicular to said back wall.

2. The display stand of claim 1 wherein said shelf includes said shelf base and a shelf tray, said shelf tray being releasably attachable to said shelf base.

3. The display stand of claim 2 further including a light bracket attachable to said shelf base, said light bracket adapted to support a light positioned underneath said shelf base.

4. The display stand of claim 2 wherein said shelf tray is slidingly attached to said shelf base such that said shelf tray can slide with respect to said shelf base.

5. The display stand of claim 4 wherein said shelf includes a plurality of dividers adapted to separate products supported on said shelf.

6. The display stand of claim 5 further including a second shelf having a second shelf base and a second shelf tray, said second shelf tray adapted to slidingly attach to said second shelf base, said second shelf base being insertable into at least one of said slots.

7. The display stand of claim 6 wherein said second shelf includes no dividers.

8. The display stand of claim 7 wherein said shelf tray is adapted to be slidingly coupled to said second shelf base, and said second shelf tray is adapted to be slidingly coupled to said shelf base.

9. The display stand of claim 1 wherein said shelf base selectively engages said bracket at one of at least two positions to adjustably mount said shelf base at said rear wall in one of at least two orientations.

10. The display stand of claim 1 wherein said shelf includes first and second sides and a connector, said connector adapted to couple to a second shelf positioned adjacent one of the first or second sides of said shelf, said connector maintaining said shelf and said second shelf in horizontal alignment with each other when said connector is coupled to said second shelf.

11. The display stand of claim 1 further including at least one sign and at least one sign bracket, said sign being coupled to said sign bracket, said sign bracket adapted to be attached to, and detached from, said back wall.

12. The display stand of claim 11 wherein said sign is pivotally attached to said bracket such that said sign can be pivoted to a plurality of different orientations with respect to said sign bracket, said sign including a lock for maintaining said sign in a selected orientation with respect to said sign bracket.

13. The display stand of claim 11 wherein said sign includes a graphic panel and at least one light positioned behind said graphic panel and adapted to illuminate said graphic panel, said graphic panel being made of an at least partially translucent material.

14. The display stand of claim 1 further including an arm having a slot insert that is adapted to be inserted into at least one of said slots, said arm supporting at least one light.

15. The display stand of claim 14 further including at least one channel defined adjacent a top of said back wall, said arm further including a channel insert adapted to be inserted into said channel and help support said arm on said back wall.

16. The display stand of claim 1 further including an arm adapted to be secured to said back wall in a snap-fitting manner, said arm having a light supported thereon.

17. The display stand of claim 1 further including a vertical divider panel releasably attachable to said back wall at a plurality of side-to-side positions between said first and second sides.

18. The display stand of claim 17 further including a plurality of divider panel brackets that each have at least one insert adapted to be inserted into at least one of said slots and to support each of said brackets on said back wall, said divider panel brackets each including at least one pin and said divider panel including a plurality of channels adapted to receive at least one of said pins to allow said divider panel to be releasably coupled to said plurality of divider panel brackets.

19. The display stand of claim 1 further including a cabinet having at least two sidewalls, a top wall, and at least one pivotable door, said cabinet including at least one insert adapted to be inserted into said slots and to thereby releasably support said cabinet on said back wall.

20. The display stand of claim 1 further including a plurality of electrical outlets positioned on said front face of said back wall.

21. The display stand of claim 20 wherein said plurality of electrical outlets are connected to a source of direct electrical current having a voltage of less than 110 volts.

22. The display stand of claim 1 wherein said slots have at least two different shapes.

23. The display stand of claim 1 wherein said slots have first and second shapes, said first shapes extending vertically upward into said back wall, said second shapes extending vertically downward into said back wall, said slots being arranged in a horizontally alternating fashion between slots having said first shape and slots having said second shape.

24. The display stand of claim 1 further including a base attached to said back wall, said base extending forwardly from said back wall and including a leveler mechanism for changing the horizontal orientation of said base.

25. The display stand of claim 1 further including:

a base attached to said back wall; and at least one door positioned in front of said back wall such that said at least one drawer is surrounded by said base, said end panels, said back wall, and said at least one door.

26. The display stand of claim 25 further including an arm having a slot insert that is adapted to be inserted into at least one of said slots, said arm supporting at least one light and at least a portion of a frame surrounding said at least one door.

27. The display stand of claim 26 wherein said at least one door opens by pivoting about a vertical axis.

28. The display stand of claim 26 wherein said at least one door opens by sliding in an upper track and a lower track, said upper and lower tracks defining a path for movement of said at least one door.

29. The display stand of claim 1 wherein said back wall comprises a plurality of extruded slot wall segments attached to a metal frame.

30. The display stand of claim 1 wherein said bracket and said self base include a plurality of inserts adapted to be inserted into said slots to releasably support said shelf on said back wall, said inserts and said slots being configured such that said shelf must be rotated to be removed from said back wall, said shelf requiring no more than forty degrees of rotation to be removed from said back wall.

31. The display stand of claim 1 further including:

a vertical utility pole spaced from, and positioned in front of, the front face of said back wall;

at least one bracket having a plurality of inserts adapted to be inserted into at least one of said slots whereby said at least one bracket can be releasably supported on said back wall, said bracket adapted to support said vertical utility pole; and an item holder releasably coupled to said vertical utility pole, said item holder adapted to hold and support an item.

32. The display stand of claim 31 wherein said item is at least one cigarette pack and said item holder is a dispenser for dispensing a plurality of the cigarette packs.

33. The display stand of claim 31 wherein said item is at least one piece of literature and said item holder is a bin adapted to hold a plurality of said pieces of literature.

34. The display stand of claim 31 wherein said item is at least one graphic panel and said item holder is a container for at least one of said graphic panels.

35. A display stand comprising:

a generally vertical back wall having a front face, a back face, a first side, and a second side, said front face including a plurality of slots; and a plurality of shelves having first and second sides and being releasably attachable to said front face of said back wall, said shelves each including inserts that fit into said slots to thereby support said shelves on said back wall, said shelves being attachable to said back wall at a plurality of different heights and at a plurality of different side-to-side positions between said first and second sides of said back wall;

each of said shelves including a shelf base and at least one bracket releasably attachable to said shelf base, each of said brackets including at least one insert that fits into at least one of said slots to thereby support said bracket and an associated shelf base on said back wall, said shelf base including a bracket engaging portion and a wall engaging portion, said bracket engaging portion of said shelf base being adjustably engaged at said bracket, said bracket being adapted to selectively support the associated shelf base in one of a plurality of different angular orientations via adjustment of said bracket engaging portion relative to said bracket, said wall engaging portion of said shelf base engaging another one of said slots of said back wall when said shelf base is supported at said bracket and said back wall;

at least one panel attached to said back wall and extending generally vertically along said back wall, said panel being oriented generally perpendicular to said back wall to provide an end panel generally at at least one of said first and second sides of said back wall; and a connector attached to each of said shelves, said connector adapted to couple a first one of said shelves with a second one of said shelves when the second one or said shelves is positioned adjacent one of the sides of said first one of said shelves, said connector maintaining said first and second ones of said shelf bases in alignment with each other when said first and second ones of said shelves are coupled together by said connector.

36. The display stand of claim 35 wherein said shelves each include a shelf tray, said shelf tray being slidably attached to said shelf base such that said shelf tray can slide with respect to said shelf base.

37. A display stand comprising:

a generally vertical back wall having a front face, a back face, a first side, and a second side, said front face including a plurality of slots;

a plurality of shelves having first and second sides and being releasably attachable to said front face of said back wall, said shelves being attachable to said back wall at a plurality of different heights and at a plurality of different side-to-side positions between said first and second sides of said back wall;

at least one bracket releasably attachable to each one of said shelves, said bracket including an insert that fits into at least one of said slots to thereby support said bracket and an associated shelf on said back wall, said shelf including a bracket engaging portion and a wall engaging portion, said bracket engaging portion of said shelf being adjustably engaged at a plurality of shelf engaging portions of said bracket, said bracket being adapted to selectively support the associated shelf in one of a plurality of different angular orientations via adjustment of said bracket engaging portion of said shelf relative to said shelf engaging portions of said bracket, said wall engaging portion of said shelf engaging another one of said slots of said back wall when said shelf is supported at said bracket and said back wall;

a connector attached to each of said shelves, said connector adapted to couple a first one of said shelves with a second one of said shelves when the second one of said shelves is positioned adjacent one of the sides of said first one of said shelves, said connector maintaining said first and second ones of said shelves in horizontal alignment with each other when said first and second ones of said shelves are coupled together by said connector, said shelves each including a shelf base and a shelf tray, said shelf tray being slidably attached to said shelf base such that said shelf tray can slide with respect to said shelf base, wherein a first set of said shelf trays includes dividers adapted to separate products supported thereon; a second set of said shelf trays includes no dividers; and said first and second sets of shelf trays are both adapted to be releasably and interchangeably attachable to said shelf bases.

38. The display stand of claim 35 wherein said bracket selectively engages said shelf base at one of at least two positions to adjustably mount said shelf base to said rear wall in one of at least two orientations.

39. The display stand of claim 35 further including at least one sign and at least one sign bracket, said sign being coupled to said sign bracket, said sign bracket adapted to be attached to, and detached from, said back wall, said sign further being pivotally attached to said bracket such that said sign can be pivoted to a plurality of different orientations with respect to said sign bracket, and said sign including a lock for maintaining said sign in a selected orientation with respect to said sign bracket.

40. The display stand of claim 36 further including an arm adapted to be secured to said back wall in a snap-fitting manner, said arm having a light supported thereon.

41. The display stand of claim 35 further including:

a vertical divider panel releasably attachable to said back wall at a plurality of side-to-side positions between said first and second sides of said back wall; and a plurality of divider panel brackets that each have at least one insert adapted to be inserted into at least one of said slots and to support each of said brackets on said back wall, said divider panel brackets each including at least one pin and said divider panel including a plurality of channels adapted to receive at least one of said pins to allow said divider panel to be releasably coupled to said plurality of divider panel brackets.

42. The display stand of claim 35 wherein said slots are generally horizontal slots that continuously extend for a majority of the distance from said first side of said back wall to said second side of said back wall, said slots being arranged in a horizontally alternating fashion between slots having a first shape and slots having a second shape, said first shapes extending vertically upward into said back wall, and said second shapes extending vertically downward into said back wall.

43. The display stand of claim 35 further including:

a base attached to said back wall;

wherein said at least one panel comprises at least two end panels attached to said back wall adjacent the first and second sides of said back wall; and at least one door positioned in front of said back wall such that said at least one drawer is surrounded by said base, said end panels, said back wall, and said at least one door.

44. The display stand of claim 43 further including an arm having a slot insert that is adapted to be inserted into at least one of said slots, said arm supporting at least one light and at least a portion of a frame surrounding said at least one door.

45. The display stand of claim 35 wherein said shelves each include a plurality of inserts adapted to be inserted into a plurality of said slots to releasably support said shelves on said back wall, said inserts and said slots being configured such that said shelves must be rotated to be removed from said back wall, said shelves requiring no more than forty degrees of rotation to be removed from said back wall.

46. The display stand of claim 42 wherein said shelves each include a plurality of inserts adapted to be inserted into a plurality of said slots to releasably support said shelves on said back wall, said inserts and said slots being configured such that said shelves must be rotated to be removed from said back wall, said shelves requiring no more than twenty degrees of rotation to be removed from said back wall.

47. A display stand comprising:

a generally vertical back wall having a front face, a back face, a first side, and a second side, said front face including a plurality of slots; and at least one end panel attached to said back wall adjacent at least one of said first and second sides of said back wall, said at least one end panel extending generally vertically along said back wall; and a plurality of shelves releasably attachable to said front face of said back wall, said shelves each including an upper insert and a lower insert, said upper and lower inserts adapted to fit into separate ones of said slots to thereby support said shelves on said back wall, said shelves being attachable to said back wall at a plurality of different heights and at a plurality of different side-to-side positions between said first and second sides, said slots and said upper and lower inserts being configured such that said shelves must be rotated to be removed from said back wall, said shelves requiring no more than thirty degrees of rotation to be removed from said back wall;

wherein said upper insert comprises a bracket that engages at least one of said slots, said bracket comprising an arcuate bracket element having a plurality of shelf mounting portions along an upper surface thereof, said shelf comprising a shelf base having a bracket engaging portion adapted to selectively and adjustably engage said shelf mounting portions of said bracket, said shelf base being adjustable relative to said bracket to adjust an orientation of said shelf base relative to said back wall via adjustment of said bracket engaging portion relative to said shelf mounting portions; and wherein said lower insert comprises a wall engaging portion of said shelf base that extends from a lower portion of said shelf base for engaging another one of said slots of said back wall when said shelf base is supported at said bracket and said back wall.

48. The display stand of claim 47 wherein said slots are generally horizontal slots that continuously extend for a majority of the distance from said first side of said back wall to said second side of said back wall, said slots being arranged in a horizontally alternating fashion between slots having a first shape and slots having a second shape, said first shapes extending vertically upward into said back wall, and said second shapes extending vertically downward into said back wall.

49. The display stand of claim 48 further including:

a base attached to said back wall and extending forwardly from said front face of the back wall; and wherein said at least one end panel comprises at least two end panels attached to said back wall adjacent the first and second sides of said back wall.

50. The display stand of claim 49 wherein said shelves each include said shelf base and a shelf tray, said shelf tray being slidably attached to said shelf base such that said shelf tray can slide with respect to said shelf base.

51. The display stand of claim 50 wherein a first set of said shelf trays includes dividers adapted to separate products supported on thereon; a second set of said shelf trays includes no dividers; and said first and second sets of shelf trays are both adapted to be releasably and interchangeably attachable to said shelf bases.

52. The display stand of claim 49 wherein said bracket selectively engages said shelf base at one of at least two positions to adjustably mount said shelf base to said rear wall in one of at least two orientations, said lower insert pivoting at the respective one of said slots when said shelf base is adjusted.

53. The display stand of claim 49 wherein said shelves each include a connector, said connector adapted to couple a first one of said shelves with a second one of said shelves when the second one of said shelves is positioned adjacent a side of said first one of said shelves, said connector maintaining said first and second ones of said shelf bases in alignment with each other when said first and second ones of said shelves are coupled together by said connector.

54. The display stand of claim 49 further including:

at least one sign;

at least one sign bracket pivotally attached to said sign such that said sign can be pivoted to a plurality of different orientations with respect to said sign bracket, said sign bracket adapted to be attached to, and detached from, said back wall; and a lock for maintaining said sign in a selected orientation with respect to said sign bracket.

55. The display stand of claim 49 further including an arm having a slot insert that is adapted to be inserted into at least one of said slots, said arm supporting at least one light.

56. The display stand of claim 49 further including an arm adapted to be secured to said back wall in a snap-fitting manner, said arm having a light supported thereon.

57. The display stand of claim 49 further including:

a vertical divider panel releasably attachable to said back wall at a plurality of side-to-side positions between said first and second sides of said back wall; and a plurality of divider panel brackets that each have at least one insert adapted to be inserted into at least one of said slots and to support each of said brackets on said back wall, each said bracket further including at least one pin and said divider panel further including a plurality of channels adapted to receive at least one of said pins to allow said divider panel to be releasably coupled to said plurality of divider panel brackets.

58. A display stand comprising:

a generally vertical back wall having a front face, a back face, a first side, and a second side, said front face including a plurality of slots;

a plurality of shelves releasably attachable to said front face of said back wall;

at least one panel attached to said back wall and extending generally vertically therealong, said at least one panel being positioned at an end of at least one of said shelves to define an end panel at said end of said at least one of said shelves; and a plurality of shelf brackets, each said shelf bracket including at least one insert adapted to fit into at least one of said slots to thereby support an associated shelf on said back wall, each of said shelves being attachable to the associated shelf bracket in a plurality of different configurations such that said shelf bracket supports the associated shelf in a selected one of a plurality of different orientations with respect to said back wall, said shelf including a wall engaging portion that engages another one of said slots of said back wall when said shelf base is supported at said shelf bracket and said back wall.

59. The display stand of claim 58 wherein said plurality of different orientations includes a first orientation in which said shelves are generally perpendicular to said back wall, and a second orientation in which said shelves are angled downwardly from said back wall.

60. The display stand of claim 59 wherein said slots are generally horizontal slots that continuously extend for a majority of the distance from said first side of said back wall to said second side of said back wall, said slots being arranged in a horizontally alternating fashion between slots having a first shape and slots having a second shape, said first shapes extending vertically upward into said back wall, and said second shapes extending vertically downward into said back wall, each said shelf bracket including a plurality of inserts, one of said inserts adapted to insert into said slots having said first shape, and another of said inserts adapted to insert into said slots having said second shape.

61. The display stand of claim 60 wherein said shelves each include a shelf base and a shelf tray, said shelf base being insertable into at least one of said slots and said shelf tray being slidably attached to said shelf base such that said shelf tray can slide with respect to said shelf base.

62. The display stand of claim 61 wherein a first set of said shelf trays includes dividers adapted to separate products supported on thereon; a second set of said shelf trays includes no dividers; and said first and second sets of shelf trays are both adapted to be releasably and interchangeably attachable to said shelf bases.

63. The display stand of claim 1, wherein said bracket comprises an arcuate bracket element having a plurality of shelf mounting portions along an upper surface thereof, said bracket engaging portion of said shelf base being adapted to selectively and adjustably engage said shelf mounting portions of said bracket.

* * * * *